US008235423B2

(12) United States Patent
Starry

(10) Patent No.: US 8,235,423 B2
(45) Date of Patent: Aug. 7, 2012

(54) INTEGRATED POLE-TO-SKI COUPLING ARRANGEMENT

(76) Inventor: Stuart John Starry, Waller, TX (US)

( * ) Notice: Subject to any disclaimer, the term of this patent is extended or adjusted under 35 U.S.C. 154(b) by 612 days.

(21) Appl. No.: 12/402,383

(22) Filed: Mar. 11, 2009

(65) Prior Publication Data

US 2009/0230667 A1 Sep. 17, 2009

Related U.S. Application Data

(60) Provisional application No. 61/069,064, filed on Mar. 12, 2008.

(51) Int. Cl.
*A63C 11/00* (2006.01)

(52) U.S. Cl. ..... 280/814; 280/819

(58) Field of Classification Search ..... 280/809, 280/812, 814, 816, 819–822; 224/917, 917.5
See application file for complete search history.

(56) References Cited

U.S. PATENT DOCUMENTS

| | | | | |
|---|---|---|---|---|
| 3,337,226 | A | 8/1967 | Kato | |
| 3,576,332 | A * | 4/1971 | Bruckl | 280/820 |
| 3,623,622 | A | 11/1971 | Sullivan | |
| 3,687,472 | A | 8/1972 | Struble, Jr. | |
| 3,747,815 | A | 7/1973 | Ettl | |
| 3,941,397 | A | 3/1976 | Kidder | |
| 4,002,349 | A | 1/1977 | Dopp | |
| 4,040,551 | A | 8/1977 | Brumbaugh | |
| 4,102,163 | A | 7/1978 | Bosch | |
| 4,129,312 | A | 12/1978 | Loffelholz | |
| 4,165,027 | A | 8/1979 | Briggs | |
| 4,175,683 | A | 11/1979 | Shields | |
| 4,181,321 | A | 1/1980 | Riedel | |
| 4,190,182 | A | 2/1980 | Hickey | |
| 4,247,132 | A | 1/1981 | Shields | |
| 4,361,347 | A * | 11/1982 | MacIntyre | 280/814 |
| 4,364,585 | A | 12/1982 | Shields | |
| 4,377,306 | A | 3/1983 | Abatecola | |
| 4,494,787 | A | 1/1985 | Gainey | |
| 4,630,842 | A | 12/1986 | Roda | |
| 4,688,820 | A | 8/1987 | Spitaler | |

(Continued)

FOREIGN PATENT DOCUMENTS

EP 1238687 A2 6/2001

(Continued)

OTHER PUBLICATIONS

Versales, Inc., Bungee Central, Retrieved from the Internet: <URL:http://www.bungeecentral.com/fittings/bungee_fittings.html>, retrieved Dec. 16, 2011.

*Primary Examiner* — Katy M Ebner
(74) *Attorney, Agent, or Firm* — Anthony Edw. J Campbell; Loren Smith; William Hulsey

(57) ABSTRACT

An integrated pole-to-ski coupling arrangement that provides coupling formations on a ski pole and ski that releasably connect the pole and ski to create a unitary ski-pole combination that leaves the rear tail of the ski clear and unencumbered. A pole coupling formation may be placed on either the shaft or the grip of the pole, and a ski coupling formation may be placed on the boot bindings or attachments thereto. Optionally, the surface formation of the boot bindings may be employed as ski coupling formations. Multiple pole and ski coupling formations allow for a secure and rigid connection.

48 Claims, 55 Drawing Sheets

U.S. PATENT DOCUMENTS

| | | | | | |
|---|---|---|---|---|---|
| 4,702,495 | A | * | 10/1987 | Roda | 280/814 |
| 4,750,760 | A | | 6/1988 | Gurley | |
| 4,786,097 | A | | 11/1988 | Howard | |
| 4,793,627 | A | | 12/1988 | Monreal | |
| 4,861,072 | A | | 8/1989 | Humphrey | |
| 4,953,892 | A | * | 9/1990 | Adkins | 280/814 |
| 5,005,854 | A | | 4/1991 | Szafranski | |
| 5,015,005 | A | | 5/1991 | Hornschemeyer et al. | |
| 5,060,966 | A | | 10/1991 | Sedlmair | |
| 5,141,251 | A | | 8/1992 | Smith | |
| 5,160,074 | A | | 11/1992 | Coates | |
| 5,228,633 | A | | 7/1993 | Johnson et al. | |
| 5,951,047 | A | | 9/1999 | Dungan | |
| 6,217,073 | B1 | | 4/2001 | Hoffman | |
| 6,347,808 | B1 | | 2/2002 | Pennington | |
| D529,567 | S | * | 10/2006 | Bishop | D21/771 |
| 7,249,785 | B2 | | 7/2007 | Resch | |
| 7,272,233 | B2 | | 9/2007 | Moller | |
| 2005/0015933 | A1 | | 1/2005 | Hasegawa | |
| 2005/0199660 | A1 | | 9/2005 | Rolf | |
| 2006/0076378 | A1 | | 4/2006 | Hall | |
| 2007/0125818 | A1 | | 6/2007 | Forster et al. | |
| 2007/0210570 | A1 | | 9/2007 | Erichsen | |
| 2007/0222168 | A1 | * | 9/2007 | Sellers et al. | 280/79.7 |

FOREIGN PATENT DOCUMENTS

| | | | |
|---|---|---|---|
| WO | 93/24032 | A1 | 12/1993 |
| WO | 94/28986 | A1 | 12/1994 |
| WO | 2007/140754 | A1 | 6/2007 |

* cited by examiner

INTEGRATED POLE-TO-SKI COUPLING ARRANGEMENT

CROSS-REFERENCE TO RELATED APPLICATION

This application claims the priority of U.S. Provisional Patent Application No. 61/069,064, filed Mar. 12, 2008, and incorporated by reference herein.

BACKGROUND OF THE INVENTION

1. Field of the Invention

The present invention relates to snow skiing, specifically to a system of attaching skis and poles together for convenient carriage.

2. Discussion of the Prior Art

A difficult task for a snow skier is any trip on foot with skis and poles in hand, particularly when a skier is tired. Snow skis are heavy, awkwardly shaped, long, and have sharp edges. Skis do not have handles. Skiers often must carry two skis in one hand and at the same time carrying two ski poles in the other hand when their hands are covered by bulky ski gloves. Most skiers take time to arrange the running surfaces, or "bases," of the skis together and may attempt to use the "interlocking" ski brakes to hold skis together in order to hoist the skis over their shoulder and carry them while walking in heavy, stiff ski boots. It is often difficult to hold both skis and poles when attempting to insert the tail of the skis into the vertical racks found at lodges, on gondolas and buses.

Skis and ski poles are usually hand carried in situations that may be classified by distance into four categories. The first is a short haul. This haul can measure from just a few meters to possibly fifty meters long. A common short haul trip is from the house, hotel, or car to the ski bus stop, or from the base of the slope to a gondola or lift. It can be from the ski bus to the vertical ski racks next to the lodge or the center of the ski village. Various short hauls between rental shops, bars, restaurants or retailers are also common with today's modern ski villages. The second carrying situation is an intermediate haul, which often involves transport between a car, condominium, hotel, restaurant or other location to the base of the slope where the lift and gondola are located. This intermediate haul is often performed while wearing ski boots, but if more comfortable walking shoes are donned, ski boots may also need to be carried.

The remaining two situations are the long haul, which may arise in the context of cross country and extreme skiing, and the travel by conveyance, wherein the skis are transported over long distances on airplanes, on boats, or in cars. In long haul cases, the time it takes to place the skis in an over-the-shoulder bag, holster, or other apparatus may be justified; for travel by conveyance, large bag enclosures, tubes and automobile racks are more practical for travel from one's home to a remote ski resort hundreds or thousands of miles away.

Many adequate systems are known in the art that are practical for long haul and travel by conveyance. However, prior art devices which focus on short and intermediate haul situations often require significant time to employ. Most attempts to solve the ski carriage problem have used non-integrated separate devices which are cumbersome, bulky and take significant time to attach. This is because much of the prior art has focused on the long and intermediate hauls, such as up a mountain, or from a parked automobile to the ski village, in which case some bulk and a moderate amount of time spent attaching the device to the skis and poles may be acceptable to some skiers. Many current solutions bind the skis together in order to attach the poles, limiting the flexibility of the device to situations which demand the skis be bound together. Thus, the skis cannot be kept apart for handling by a child or petite person or for use with an automobile rooftop racks. Now, with this invention such efforts in time and placement are not needed for short and intermediated hauls.

Prior art fails in solving six basic needs presented by the short and intermediate hauls: (1) the need for speedy attachment; (2) the need for a convenient handle; (3) the need for rigid control in handling; (4) the need to keep the back end of the skis clear for vertical rack insertion; (5) the need for versatility, such as keeping the skis apart for use in automobile racks; and (6) the need to eliminate separately carried items, which must be stored or can be lost. While some devices meet some of these needs, none of the currently available methods meet all six needs simultaneously.

Most prior art for the hand carriage of skis and poles falls into five categories: (1) bags or tubes which totally enclose both skis and both poles; (2) holsters which usually incorporate belts or over-the-shoulder straps along with a securing or hooking device; (3) straps which act to hold the skis together and sometimes act as a handle; (4) clamps or totes which hold the skis and poles together and sometimes act as a handle, and (5) integrated devices and features which use the existing qualities of the skis and poles and/or attach devices to the skis and/or poles so as to eliminate the need to carry separate items.

Bags and other large enclosures are useful for long haul and travel by conveyance situations, and may be adequate for intermediate hauls, but are impractical for use on the slopes. Most of them are designed for travel from a home to a remote ski resort hundreds or thousands of miles away. While a bag or tube may be used for transport around a ski village, the size of such a device and the time required to use it make it difficult to use on the slopes. Opening the enclosure, removing all four items, closing it back up, and then finding a place to store it is impractical for short hauls.

For short and intermediate hauls, holsters have discernable disadvantages. They are somewhat bulky and require time to put on or take off. If left on, they can interfere with a skier's movement and may be uncomfortable. Many holsters, such as those disclosed by U.S. Publication 2007/0125818 to Forster and U.S. Publication 2007/0210570 to Erichsen, do not provide for the poles. Also, holster arrangements are limited to conditions when it is necessary to couple the skis together, are inconvenient for short hauls, and do not provide speed of attachment. The handle usually consists of fabric from the holster, which is not necessarily convenient. For the most part they fail to provide rigid control as many require a free hand to guide the skis which are hoisted at only one point and tend to pivot wildly. As soon as skis are removed from the holster they are devoid of easy handling properties. Although once out of the holster, skis are not encumbered for insertion into racks, one still has the problem of handling the poles and skis simultaneously while trying to insert the skis into the rack.

Various straps have been marketed and patented as solving some of the six needs. Strapping solutions tend to use a loop or configuration of loops of fabric strapping around the skis, bindings, and/or the poles. A strap handle is usually attached as well. Most strap systems use hook and loop fabrics, buckles, ladder lock retainers, snaps and the like to wrap the straps around either the skis, bindings, and/or poles and then to adjust and tighten them into a desired position. For example, the strap of U.S. Publication No. 2005/0199660 to Rolf uses loose, non adjustable loops to avoid detailed snapping, threading and pulling (which can be difficult when wearing thick ski gloves). U.S. Pat. No. 4,377,306 to Abatecola endeavors to create a separate handle out of the strapping which can be held in one hand. U.S. Pat. No. 5,160,074 to Coates and WO 93/24032 to Sieber endeavor to create a shoulder strapping system for freeing both hands. U.S. Publication No. 2006/0076378 to Hall discloses a strapping system that may be handheld or shoulder mounted, while U.S. Pat. No. 4,165,027 to Briggs and WO 94/28986 to Burr seek to position the poles as handles.

WO 94/28986 to Burr is significant as it teaches the use of two straps are provided to enable the user to bind the poles tightly to the skis to form an easily graspable handle, however, the straps require time to place properly, constitute additional gear, do not leave the back end of the skis unencumbered, and do not readily create a rigid carrying system. Although the straps can be tightened to pull the poles down in a vertical fashion against the ski bindings, there is nothing on the ski bindings to keep the poles from sliding from side to side and falling off the binding, resulting in a loose strap. Further the Burr method contemplates that the handle end of the poles can be strapped to the skis. In order to accomplish that objective, the toe piece of the binding must have an extremely low profile. However, most modern toe pieces have a relatively high profile which would not allow the poles to be pushed down to the skis without bending the poles.

All strap systems leave several problems unsolved for the short and intermediate hauls. They all require the use of a non-integrated strapping device that must be stored on ones person or in ones ski clothing, and that must be removed from the storage location and then attached via a somewhat complex, time-intensive procedure.

The prior art also discloses multiple clamps, totes and other rigid grasping devices. U.S. Pat. No. 4,494,787 to Gainey; U.S. Pat. No. 4,190,182 to Hickey, U.S. Pat. No. 4,040,551 to Brumbaugh, U.S. Pat. No. 4,002,349 to Dopp, U.S. Pat. No. 3,747,815 to Ettl, and EP 1,238,687 to Geyerman all teach hard plastic or metal devices which must be carried separately. Employing any of these devices creates the problem of where to stow the device when one is skiing. Most of them are too big to keep in a jacket pocket. Even the small ones are hard and could potentially cause injury or at least pain if a skier falls on them. Many provide a relatively rigid handle, but some require assembly, and all of them require a considerable amount of time and effort to get to the assembled state. One must remove the device for use, and then place the skis and poles into position before securing the device. As mentioned earlier, skis and poles are difficult to handle with thick gloves and no handles. Again, these devices are limited to situations which demand that the skis be coupled together. Finally, most of these devices attach the poles in a mid-ski and mid-pole orientation, allowing the pole to extend over the tail of the ski and interfere with rack insertion.

Integrated devices eliminate separately carried items by definition, as their features are integrated into or permanently affixed to the poles and skis. Some current integrated solutions provide for rigid control, but not all provide handles, and often do not allow for quick attachment or a clean back end for rack insertion, and may require the skis to be arranged base-to-base.

One group of integrated devices constitute an single point, pivotal hoist, and involve using the tip end of the pole to connect to the ski near the toe piece and hoist the skis over the shoulders to be carried by the poles (like a knapsack or rucksack is carried with a walking stick). Although the planar connection between the ski poles and the skis may actually involve more than one geometric point, for all practical purposes, the system is connected at only one juncture. Such devices are described in U.S. Pat. Nos. 4,630,842 and 4,702,495 to Roda, and involve mounting an attachment with tubular hole to the top of the ski, at a point in front of the toe piece of the bindings, with the tubular hole oriented perpendicular to the length of the ski. The tips of the poles are inserted into the holes and the skis are then hoisted over the shoulder, hanging on the poles. Improvements to this method are evidenced in U.S. Pat. No. 4,861,072 to Humphrey, which teaches a chain used to keep the skis from falling off the poles and in U.S. Pat. No. 5,141,251 to Smith, which discloses a flexible multidirectional clip in place of a single tubular hole.

Although comprising an integrated handle of sorts, none of these methods answer the remaining needs. First, there is no speed of attachment. One must first attach the poles to the skis, and then arrange the skis together. This may be difficult in that the poles are perpendicular and attached. Then one must hold the skis vertical by the poles while stepping under to hoist them. For example, use of the device claimed in U.S. Pat. No. 4,861,072 to Humphrey involves six recited steps. Second, there is no rigid control for handling. Both Humphrey '072 and Smith '251 provide for a flexible connection. Given the inertial mass of the skis, and the short length of the connection, any rigidity created by the length of the tubular connection in Roda '842 could bend the tip of the pole. Unfortunately, this method leaves the skis gravitationally swinging from the poles and limits severely the orientation of handling positions. Third, although one could certainly place the skis with the attached poles into a rack, the attached poles would have to be removed from the skis or else become a hazard to passersby, and do not account for poles. Fourth, although it would be possible to carry the ski pole units separately, such as over each shoulder, there would be no point in the awkward arrangement because of the geometric size of the ski and pole at right angles.

Some single point arrangements do not attempt to utilize the poles as a hoist. U.S. Pat. No. 4,102,163 to Bosch, discloses an integrated locking system wherein the skis are fixed together with clamps permanently affixed to the ski, and requires substantial time to arrange the skis and complete the clamping and resulting in a package with no real handle. U.S. Pat. No. 7,273,233 to Moller describes a ski clip which constitutes a fold-out, two-pronged fork-like clip attached to the mid-portion of the pole which is designed to pivot out and then hold two skis together in a base-to-base orientation while simultaneously allowing the ski poles to hang at the pivot point of the clip attachment from the tip end of the skis. This requires orienting the skis in a base-to-base then vertical position for clamping, which slows speed of attachment. One must take the time to hold his poles in one hand, while picking up both skis from the ground and then arranging them together in a position to accommodate the clip. At the same time, the user must fold out the clips and then place the first pole and clip into position and slide it firmly into place while still holding the other pole somewhere and the two skis in position. Then time must be taken to attach the second pole and clip. Although Moller '233 clips the skis and poles into one unit, it leaves several problems of hand carriage unsolved. First, even after the proper attachment of the clips and poles there is no real handle. Both skis must be grasped by one hand somewhere in the vicinity of the bindings or the upper end of the skis without the aid of a handle. Getting ones glove-covered hand around the width of the skis is problematic. The positions of the clipped-on poles actually hinder the grasping of the unit by obstructing the area which would normally be occupied by a holder's arm. The holder is now forced to grab the skis by their width in order to avoid the poles. Moreover, an attempt to grab the unit by the poles results in a loose arrangement because of the single pivot point by which the poles have been attached. Applying enough force to the poles to actually pick up the unit may disengage the poles and clip from the skis, as there is no latch holding the forks to the skis. Instead, the ski clips are held in place by pressure generated by the forcing down of the clip to a thicker part of the ski. Thus, Moller '233 does not allow for rigidity in handling. Moller '233 keeps the items together to be held in one hand so that one could reach for a lift ticket or one could hold on to a stability bar while standing in a bus or gondola, and leaves the back end of the skis clear for rack insertion. However, it requires a cumbersome effort to get to the result, and does not provide a convenient handle. Moller '233 also demands the skis be clamped together.

A second group of integrated solutions modifies the ski pole basket. All of these devices require effort arranging the skis in a base-to-base configuration and then a cumbersome securing process. For example, U.S. Pat. No. 4,175,683 to Shields provides a basket with a pullout clamping assembly which is removed from the basket, then wrapped around a pair of base-to-base arranged skis and then reinserted into the basket, holding the ski's to the basket. Unfortunately, this process must be repeated after the poles are first joined together in opposite directions. Speed of attachment is completely absent in this method. Moreover, the actual success of attachment is suspect with many of today's skis, which are trending toward very wide configurations known as "fat" skis. Also, in order to keep the swing weight of the pole low, most performance oriented poles on the market today feature baskets only 2-3 inches in diameter. The big, wide baskets required by these methods are unattractive to many skiers. The Shields '683 basket arrangement leaves very little space between the poles and the skis, making use of the poles as handles difficult. Moreover, because baskets are usually made of a very pliable material, the rigidity of the connection is also suspect. Thus, rigid control in handling (need number two), is only partially met at best. This arrangement does not leave the tail of the ski clear for rack insertion (need number three). Plus, there is no flexibility (need number four), as the entire mass must be bundled as one. U.S. Pat. Nos. 4,247,132 and 4,364,585 to Shields disclose an evolution of the Shields '683 basket. Step one of attachment is the same: the poles are interlocked in opposing directions using recesses in the basket. Step two of the process is the same: one places the skis in a base-to-base orientation. Step three is the same: place the skis into the rectangular basket recess. However, the ski securement is different. Rather than using a plastic clip, the pole strap is wrapped around the entire unit. Again, need number one, speedy attachment, remains unsatisfied. The clearance of the poles from the skis (while improved) may not be sufficient for easy grasping by a glove clad hand only partially satisfying need number two. Although it is probably rigid, this method likewise does not leave the tail of the ski clear for rack insertion and eliminates the flexibility to keep the skis apart (needs three and four respectively). U.S. Pat. No. 3,687,472 to Struble Jr. modifies the pole basket, handles, and straps. The baskets contain recesses to accommodate the shaft of the other pole near the tip end such that the poles can be joined together near the tip. The pole handles are partially covered with "ribs" (and or hook and loop fabric) such that they can be connected together at the handle end. The baskets also have large rectangular cut-outs in them to accommodate the bodies of the skis. According to this arrangement, the poles are first joined together at the basket end then the handle end. Then the skis are inserted into the basket cut-outs in an orientation such that the skis are on the outside of the package and the poles are actually between the skis. Finally, the pole straps are wrapped around the package and snapped to posts on the handle of the opposite pole. The Struble '472 system requires a fair amount of time to assemble the package. There is not a handle, although the package is rigid. An alternate version leaves the back end of the skis clear; however, the bound package (with the poles between the skis) may be too wide for rack insertion. Additionally, the single bound package may be cumbersome and not fit onto a conventional automobile rack.

U.S. Pat. No. 4,361,347 to MacIntyre teaches another basket system. The MacIntyre '347 system employs the same basic method of transversely orienting the poles by way of basket recesses. However, the approach is different with respect to attaching the skis. This method employs detent receiving holes in surfaces mounted on one side of each ski, and detented clipping recesses formed into the basket. As in all of the basket methods, it takes significant time and work to place the skis and poles in the proper positions. Second, although the poles appear to be convenient handles, rigidity and integrity of the connection is not present. The flexible material of the baskets does not provide for rigidity, and any significant stress on the flexible basket material may dislodge the skis. The holes and mounts are placed on one side of each ski, reducing balance and symmetry. The skis cannot be carried separately. Also, the tail of the skis is not clear for rack insertion. Any attempt at rack insertion would likely dislodge the connection. Finally, its use is inconsistent with performance-oriented smaller baskets currently found in the art.

Many experienced skiers have at one time or another tried to create a single package by first placing the basket ends of each pole inside the strap loops of the other pole, then placing the skis base-to-base, then placing the tip and tail of the skis into the ski pole strap loops as well, then carrying the whole collection by the poles. This method is loose, unbalanced, and takes time to arrange. It does not allow the vertical handling of the skis (as they would simply slide through the loops). It also encumbers the back end of the skis, precluding insertion into racks.

The "carrying arrangement for the joint transportation of ski sticks and skis" of WO 2007/140754 A1 to Sperlich reveals a self contained apparatus comprising an eyelet attached to the lower ⅓ of the ski pole. Unlike most integrated solutions, the Sperlich '754 arrangement connects to the interlocking ski brake. The final arrangement achieved by this invention does results in a single unit which can be toted by grasping of the ski poles as handles. But the flexibility to carry them separately is removed. Also, to get to the Sperlich '754 arrangement a substantial amount of time and effort are required, negating the advantage of speedy attachment. After the skis are placed together with interlocking ski brakes and after the open loops of the ski pole straps are looped around the top end of the two interlocked ski poles then each ski pole eyelet is manually placed around each downward pointing ski brake claw. This placement task must be done when the ski brakes are not interlocked or one must risk disengagement of the interlocking ski brakes during the eyelet attaching process. Additionally, many of the larger protrusions and recessed areas on modern interlocking ski brake claws will not easily accommodate looping over of the eyelet for stability. Even after all of the above listed efforts the result of the Sperlich '754 arrangement is still a loose ski pole handle which relies on gravity to keep the skis oriented below the poles. There is no rigidity in handling. The arrangement does not accommodate vertical positioning of the skis for easy placement in ski racks on buses and gondolas. An attempt to vertically orient the ski's by use of the poles as handles may result in failure of the entire arrangement because the top ends of the poles are loosely attached to the front ends of the skis.

This equally allows the bottom ends of the skis to sway back and forth limiting the control over the entire ski set. Also, because the tip of the poles extends significantly beyond the heel piece, the Sperlich '754 arrangement further hinders insertion of the ski's tail into racks.

Another such device is shown in U.S. Pat. No. 3,941,397 to Kidder, which discloses a hook for the tip end of the ski pole is attached to the ski while the other end of poles are loosely attached to each other by the straps which merely sit under the skis and not around them. However, the Kidder '397 device fails to achieve speed of attachment; rigid control in handling; a clean ski for rack insertion; As well as the versatility to get underway without taking time to couple the skis together. Additionally, any attempt at vertical handling will result in the skis falling out of the stretcher formed by the ski pole straps because they do not even surround the skis.

Other patents disclose integrated locking systems, primarily to prevent theft. Two such systems claim an added benefit of convenient carriage, and are thus discussed herein. U.S. Pat. No. 4,129,312 to Loffelholz reveals a locking system which joins a pole and ski by way of circular rings connected to various parts of the ski. The pole is unique. The top portion of the pole separates from the remainder of the pole and the joining ends of the two pole segments constitute a combination lock. The purpose of separating the two pole parts is to allow them to be slipped loosely through the ski mounted rings and then recombined, by way of setting the lock, to form a single unit. Speedy attachment is sacrificed by requiring the setting of a combination sequence as well as the time it takes to separate the pole pieces and thread them through the rings and then the re-attaching of the pole pieces and the scrambling of the lock combination. Rigid handling is lost to the ring loops. Any attempt at vertical holding will result in the skis slipping down the pole on the rings. Any attempt at insertion into a rack, will allow the poles to slide downward until the pole basket is caught by the highest placed ring. This loose arrangement allows only stretcher-like carrying capacity.

U.S. Pat. No. 5,951,047 to Dungan, describes a locking arrangement which fixes the poles to the skis at only one point, in a configuration similar to the Moller '233 ski clip. The primary purpose of this device is theft prevention, although some benefits of carriage are mentioned. Like Moller '233, there is no speed of attachment. The Dungan '047 system requires the skis to be oriented base-to-base, the use of a key to unlock the shackles, the placement of the locking units together, the attachment of the shackles, and then the locking with the key. Afterwards, there is a one point attachment near the top of the pole, which sacrifices a rigid handle. The user of the Dungan '047 device is encouraged to use a separate and optional ski tie to improve "stability." The Dungan '047 arrangement will not offer any benefits different from Moller '233 ski clip unless the tie is used. Even with the tie, the invention obtains only the properties of the Sperlich arrangement, which leave one end of the ski only loosely connected—all this with the added burden of an additional item to carry and possibly loose.

Other solutions presented by prior art interlock skis base-to-base for easier handling. This has been done by means of an interlocking ski brake mechanism, which not only brakes the ski when the boot becomes dislodged from the binding, but doubles as a method by which the two skis can be temporarily interlocked. U.S. Pat. No. 7,249,785 B2 to Resch et al., U.S. Pat. No. 5,060,966 to Sedlmair, U.S. Pat. No. 4,688,820 to Spitaler et al., and U.S. Pat. No. 4,181,321 to Riedel teach such devices and methods. However, in these inventions, it remains difficult to quickly pick up the skis and put them in the proper position for interlocking. Because one must wrap his fingers around the ski itself, often the hands become pinched between the two skis during an attempt to use the interlocking feature of the ski brakes. Also, the interlocking process is not always easy. Often one must fidget with the brake alignment and the ski position for some time. Moreover, after interlocking the skis, there is still no handle and the poles must still be carried some way. To free up the other hand, many skiers loop the pole straps over the skis, hoist the skis over their shoulders, and let the poles dangle.

While the above-described devices fulfill their respective, particular objectives and requirements, the aforementioned patents do not describe an integrated pole-to-ski quick coupling arrangement that meets all six of the following needs simultaneously: (1) the need for speedy attachment; (3) the need for rigid control in handling; (4) the need to keep the back end of the skis clear for rack insertion; (5) the versatility to get underway without taking time to couple the skis together; and (6) the need to eliminate separately carried items which must be stored or can be lost. In addition to unique results, the methodology of the present invention is also unique. No prior art has sought to use a quick contact engagement and a quick release to hold and separate the skis and poles. No prior art has sought a separate handle for each of the skis so they may be carried immediately. No prior art seeks to position the poles in the forward part of the ski, leaving the entire tail of the ski unencumbered for insertion into modern ski racks. Prior art continues to attempt to solve problems presented by the long and intermediate haul situations, but does not focus on the recently emerging proliferation of short haul situations cause by increased industry use of gondolas and buses as well as more elaborate ski village designs. Therefore, a need exists for an integrated pole-to-ski quick coupling arrangement that can be used for the speedy and convenient carriage of poles and skis in short and intermediate haul situations. In this regard, the present invention substantially fulfills these needs. In this respect, the integrated pole-to-ski quick coupling arrangement according to the present invention substantially departs from the conventional concepts and designs of the prior art, and in doing so provides an apparatus primarily developed for the purpose of speedy and convenient carriage of poles and skis.

SUMMARY OF THE INVENTION

In view of the foregoing disadvantages inherent in the known types of ski and pole carriage devices now present in the prior art, the present invention provides an integrated pole-to-ski quick coupling arrangement and overcomes the above-mentioned disadvantages and drawbacks of the prior art. As such, the general purpose of the present invention, which will be described subsequently in greater detail, is to provide an integrated pole-to-ski quick coupling arrangement which has all the advantages of the prior art mentioned heretofore and many novel features that result in an integrated pole-to-ski quick coupling arrangement which is not anticipated, rendered obvious, suggested, or even implied by the prior art, either alone or in any combination thereof.

The present invention is an integrated pole-to-ski coupling arrangement that provides coupling formations on a ski pole and ski that releasably connect the pole and ski to create a unitary ski-pole combination that leaves the rear tail of the ski clear and unencumbered. A pole coupling formation may be placed on either the shaft or the grip of the pole. The number, shape, size, and orientation of the coupling formations ensure rapid attachment and a rigid connection. The invention may employ pole coupling formations to be attached to existing poles, either on the shaft or on both the grip and the shaft, and the pole formations may be shaped to use the contours of bindings known in the art as ski coupling formations, or such ski coupling formations may optionally be attached directly to the skis or to the bindings. Optionally, the invention may include poles and bindings that have complementary coupling arrangements. A variety of complementary coupling arrangements may be employed.

The present invention allows a skier that has stepped out of skis to simply place the poles over the skis and snap the poles onto the skis with a quick downward press. Each pole is quickly attached to each ski and acts as a convenient handle. After the quick coupling, the skier may simply pick up the skis by the poles and go. Because of the rigidity of the connection and its forward orientation on the ski, a skier may handle the skis in a variety of convenient ways. First, one ski may be carried in each hand, balanced at the location of the newly created handle between the bindings. Second, the skier can grab both newly created handles in one hand, as the rigid handles created by the invention allow for holding both skis in one hand, even when the skis are not coupled together. Third, the skier may optionally couple the skis together via interlocking ski brakes or other methods such as bands or straps. After the interlocking is complete, the result is a single unit which can be carried in one hand like a guitar case. Fourth, he may carry the skis vertically. This is because the top portion of a pole is coupled to the top of a ski near or on the heel piece of the bindings and the shaft of a pole is coupled to the top of a ski near or on the toe piece of the binding, such that the pole is parallel to the ski top and extends forward with its tip at or near the tip of the ski. This unique arrangement leaves the entirety of the ski tail clean for insertion into vertical ski racks. The skier may simply grip the pole at any position forward of the toe piece, lifting the ski in a vertical orientation and drop it into a rack.

Also, the invention makes it possible to more effectively market ski poles and/or skis by creating an impressive display with the poles attached to the skis at the retail location.

The present invention is faster and more flexible than the prior art, and solves the problem of quickly removing skis at the end of a ski run and transporting the skis to a rack on a gondola. The arrangement provides for two separate rigid pole-ski units. There is no need to interlock the skis together or put them over the shoulder. Grip is firm, balanced and comfortable: the poles, serving as a handles, are firmly affixed to each ski. The poles are parallel to the skis; moreover, the ski pole does not extend into the tail of the ski, leaving it clean for insertion into most modern racks. Much of the pole is over the top of the ski at a balance point between the ski bindings for easy horizontal carriage. But the bulk of the pole is over the top of the forward length of the ski, extending to the tip to create a long, rigid handle, so the skis may be handled in a vertical position by grabbing the poles nearer the tip using the poles as handles. The connection is so rigid that the poles may be used to twirl the ski like a baton without loss of the connection. This allows for quick insertion of both skis and poles into the rack of a moving gondola car, allowing a skier to easily board. In the absence of a gondola car with a rack, the skis may be interlocked and set down, or handled with a single hand. Also, even without interlocking the units, they may be stood vertically gripping both poles with a single hand, freeing the other hand for an onboard stabilizing bar. This scenario is equally applicable to buses.

Another advantage of the present invention is to allow ski poles to serve as handles for vertically pulling the skis out of a rack, such as that of a moving gondola at the top of a ski run. Disengagement of the pole-to-ski connection is accomplished with a quick jerk on the pole or, in alternate embodiments, with the touch of a small release lever.

The present invention further allows controlled handing during the process of interlocking the brakes, providing a stiff handle opposite each interlocking brake. The present invention allows for the continued refinement and improvement of interlocking ski brake mechanisms or the development of other means of quickly coupling the skis in a base-to-base orientation, and will enhance the ease by which such devices may be used.

Thus has been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently envisioned, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is a further objective of this invention to provide a new integrated pole-to-ski quick coupling arrangement that provides in the means, apparatuses, and methods of the prior art some of the advantages thereof, while simultaneously overcoming some of the disadvantages normally associated therewith.

Further objectives of this invention provide an integrated pole-to-ski quick coupling arrangement which assembles and disassembles quickly with a minimum amount of effort on the part of the skier, provide an integrated pole-to-ski quick coupling arrangement which presents a convenient and versatile handle, provide an integrated pole-to-ski quick coupling arrangement whose handles are rigidly connected to the skis for stability and ease of placement during carriage, provide an integrated pole-to-ski quick coupling arrangement which leaves the tail portion of the ski unencumbered and free of attachments for ease of insertion into ski racks, provide an integrated pole-to-ski quick coupling arrangement which does not require that the skis be bundled or placed together as part of the system, provide an integrated pole-to-ski quick coupling arrangement which does not require any items to be carried separate and apart from the skis and poles themselves, provide an integrated pole-to-ski quick coupling arrangement which enhances the commercial display and sale of skis and poles by allowing them to be displayed with the system in use, and provide a new and improved method of assembling skis and poles for convenient carriage.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated, current embodiments of the invention.

BRIEF DESCRIPTION OF THE DRAWINGS

The advantages, features, and exemplary embodiments of the present invention will be better understood by the following description when considered in conjunction with the accompanying drawings in which.

The same reference numerals refer to the same parts throughout the various figures.

DESCRIPTION OF THE ILLUSTRATED EMBODIMENTS

Figure 1:
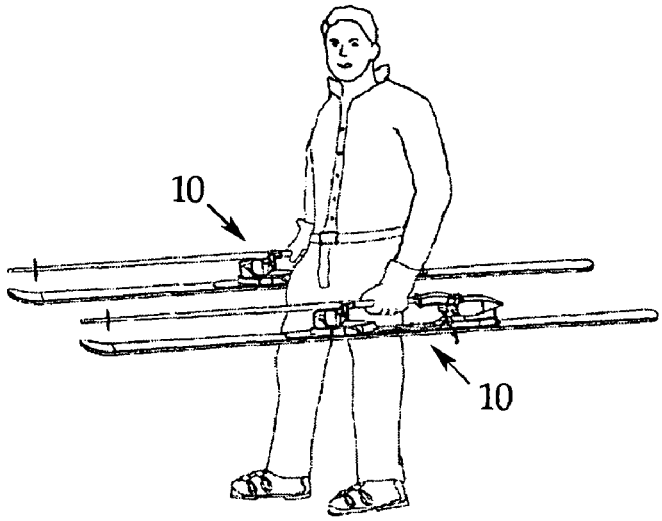
FIG. 1 is a view of a person holding one coupled pole-ski unit in each hand in a non-interlocked arrangement.
Figure 75:
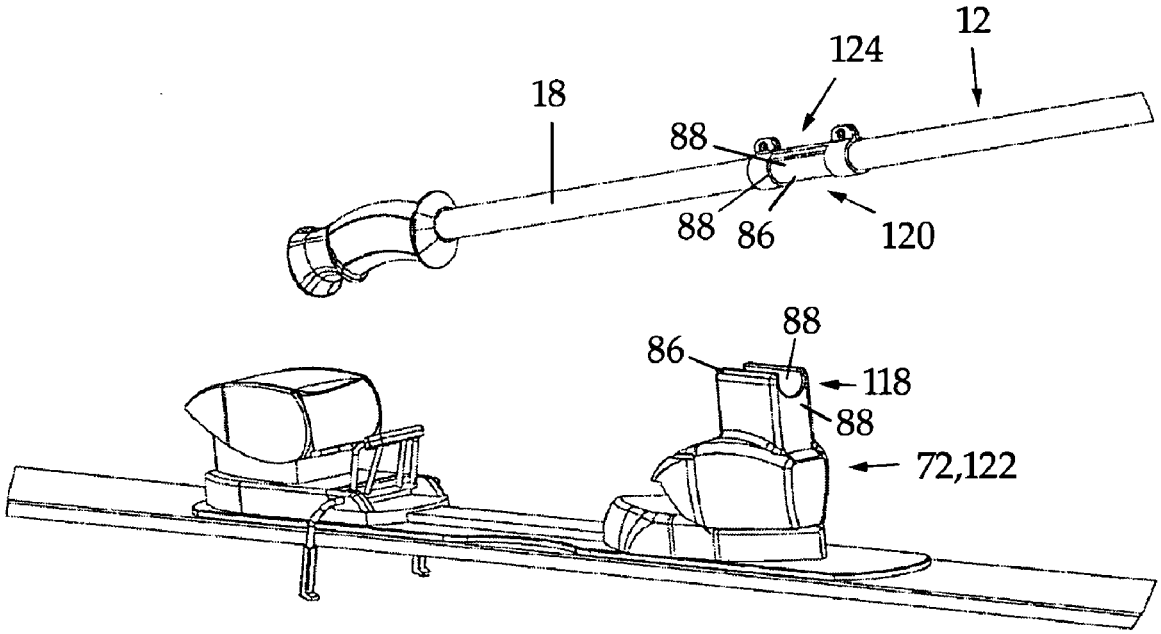
FIG. 75 is a perspective view of a front ski binding servings as a ski mounted base for the elongated clamp version of the ski coupling formation and a pole shaft and dual collar serving as the pole coupling formation.

Referring now to the drawings, and particularly to FIGS. 1-75, embodiments of the integrated pole-to-ski quick coupling arrangement are illustrated and described. Because each embodiment utilizes various parts of the typical ski pole, ski, and binding, those items and their properties require explanation throughout the accompanying claims the terms "on," "attach to," and "attached to" are used interchangeably and mean either a semi-permanent connection (e.g. able to be removed, but generally not intended to be removed once affixed), or "forming an integral part of" or "formed into and extending from." Additionally, throughout the accompanying claims the words "couple," "coupled," and "connect" are used interchangeably and mean a more temporary connection (e.g. a connection that is intended to be released and reattached during use).

Figure 2:
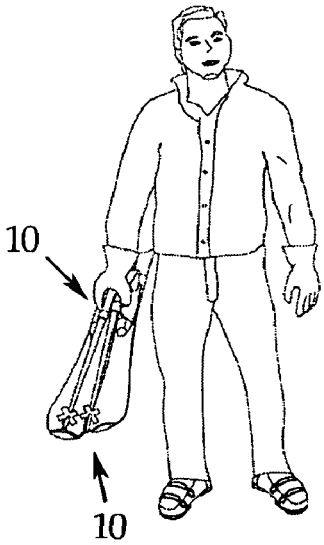
FIG. 2 is a view of a person holding both coupled pole-ski units in one hand in a non-interlocked arrangement.
Figure 3:
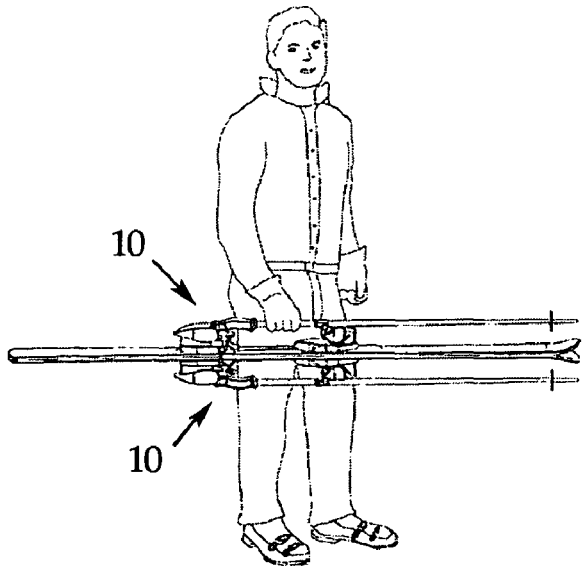
FIG. 3 is a view of a person holding both coupled pole-ski units in one hand in an interlocked arrangement.

FIGS. 1-3 display the use of the pole-to-ski-quick coupling arrangement 10 in its intended settings. In FIG. 1, a skier carries poles and skis attached by the pole-to-ski-quick coupling arrangement 10 as two separate units, each exhibiting a pole attached to a ski, in each hand. Each pole and ski unit may be carried horizontally at a balance point as shown, may be carried vertically, may be carried at any other desired angle or twirled about like batons.

FIG. 2 illustrates a skier using the pole-to-ski-quick coupling arrangement 10 to carry two separate pole and ski units in a single hand, thus freeing the opposite hand for grasping objects, such as a stabilizing post in a moving gondola, or for holding other objects, such as ski boots, a cup of coffee, or a child's skis and poles.

FIG. 3 illustrates a skier using the pole-to-ski-quick coupling arrangement 10 wherein the skier has further used the ski brake mechanisms to further couple each individual pole and ski unit of the present invention to create a unitary package. Those skilled in the art will readily recognize that this can also be accomplished or enhanced by use of a strap or other method taught by prior art, or invented in the future.

Figure 4:
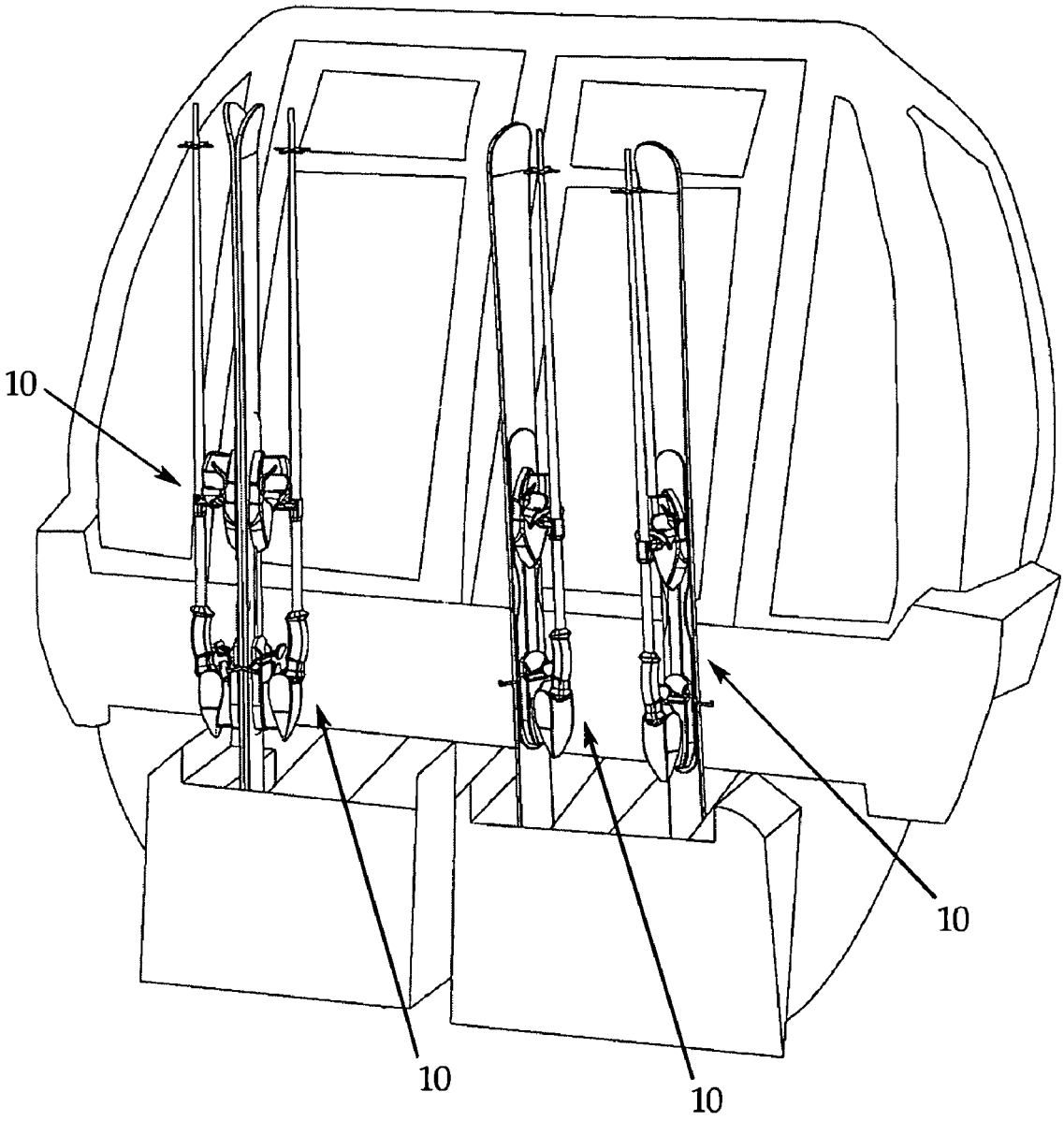
FIG. 4 is a view of a gondola rack holding the coupled pole-ski units for transport.

FIG. 4 displays ski and pole units coupled by the pole-to-ski-quick coupling arrangement 10 in a conventional ski rack, such as that commonly found on a bus or a gondola. In FIG. 4, it can readily be appreciated that the present invention does not add bulk to the tail of the ski, and therefore the ski and pole combination allowed by the present invention may be used in existing ski racks.

Figure 5:
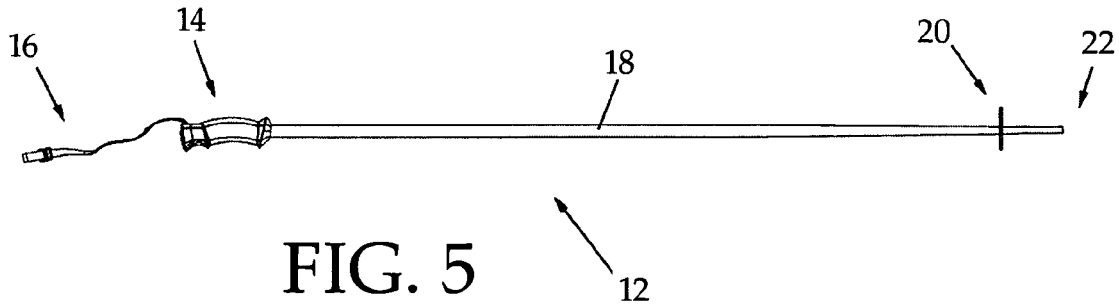
FIG. 5 is a side view of a typical ski pole and its components.

FIG. 5 reveals a ski pole 12 with its grip 14, strap 16, and shaft 18 whose form is usually tapered as it approaches the basket 20 and pole tip 22. Because some pole systems use a detachable strap or a glove-integrated strap, many of the ski pole 12 depictions in the figures do not feature a strap. However, because all embodiments are also consistent with a strap permanently attached to the grip, some of the figures feature a strap in a position that does not interfere with the function of the invention.

Figure 6:
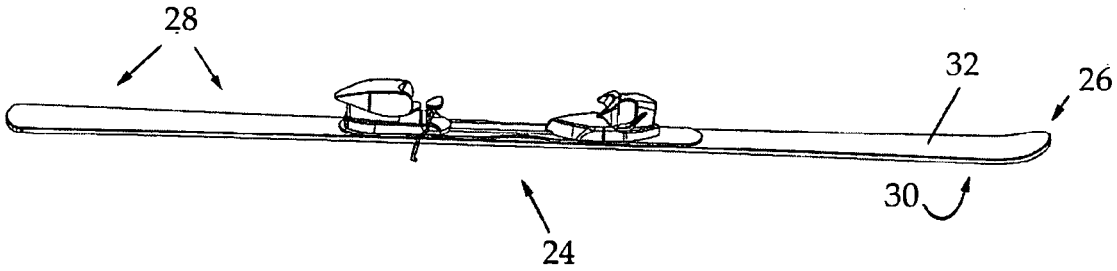
FIG. 6 is a side perspective view of a typical ski and binding group.

FIG. 6 depicts a typical ski 24 whose relevant anatomy includes it upwardly bent tip 26 which is in the front of the ski, a base 30 which contacts the snow during use, a tail 28 (which includes the entire portion of the ski rear of the bindings for purposes of this patent), and a top 32 which faces up when the skis are on the snow and upon which the bindings are attached, often by a means, such as a binding track (shown here) or a channel, and sometimes screws or other means.

Figure 7:
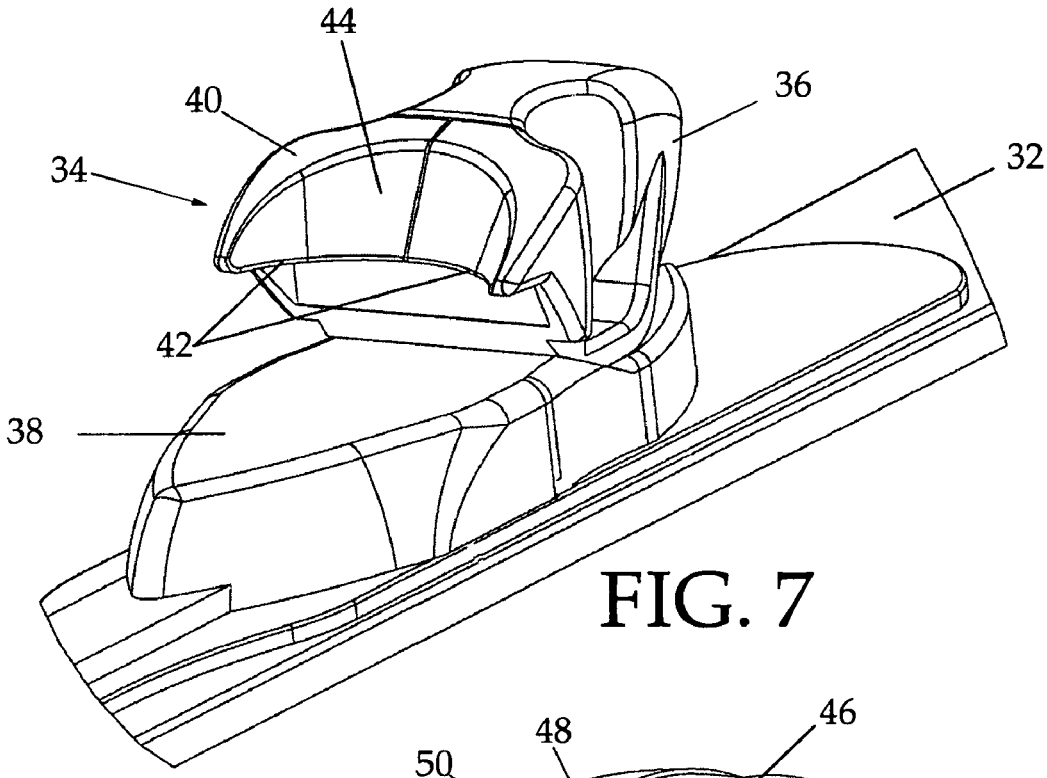
FIG. 7 is a perspective view of a typical front binding.
Figure 8:
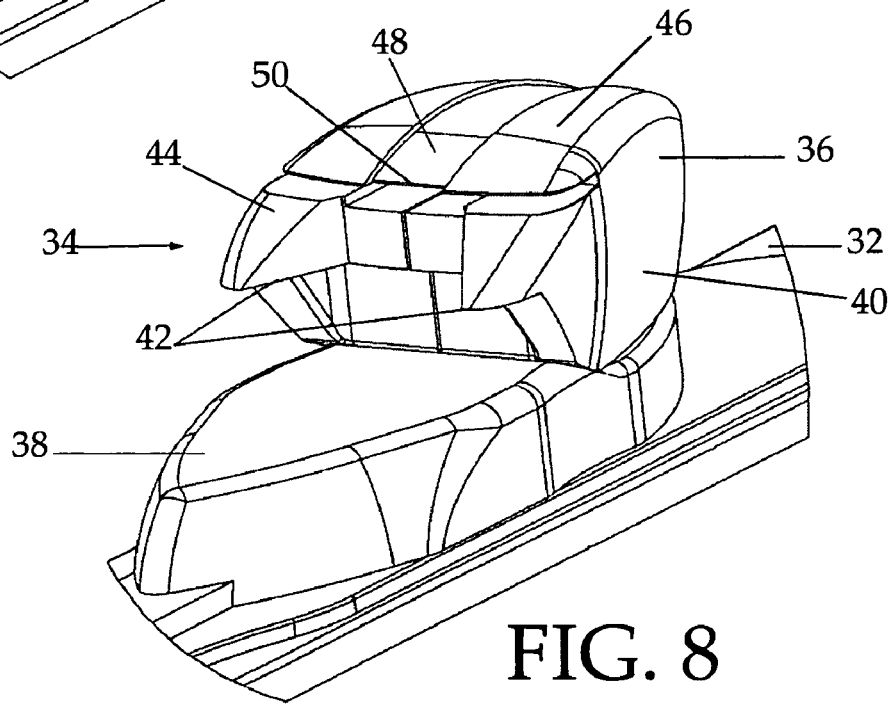
FIG. 8 is a perspective view of a shrouded front binding.

FIGS. 7 and 8 reveal two common front binding mechanisms. FIG. 7 represents the most common form of front binding 34 (referred to in this patent as the "beveled" binding), which includes a toe piece 36 which is the main body of the front binding. The toe piece 36 usually sits upon a toe piece platform 38, which not only holds the toe piece 36 to the ski top 32 but also supports the front sole of the ski boot when in use. On the beveled binding, the rear of the toe piece 36, houses a toe securing abutment 40 on which is formed a toe securing lip 42, which normally lies over and secures the toe of the boot. The toe securing abutment 40 can move side-to-side, split open, (and sometimes move upward) to release the boot when a skier's fall applies a sufficient amount of force in the direction of the release, thereby avoiding damage to the skier's legs. The toe securing abutment 40 is often a combination of complex mechanics composed of many internal pieces, not relevant here. The amount of force necessary to cause the release is set by a ski technician based upon the skill level and weight of the skier. Preceding the toe securing lip is a toe guiding bevel 44 (shown here to be quite large) which can vary in width, height and angle depending on the binding brand and model. This bevel is normally employed by the skier to guide the toe of the boot into place when stepping into the binding. On some bindings the toe guiding bevel 44 can be quite minimal and appear as a nearly flat top to the binding. Some bindings have a grouping of lips and shapes playing the roles of toe securing lip 42 and toe guiding bevel 44, and/or toe securing abutment 40. To engage the boot, the skier usually inserts the toe of the boot under the toe securing lip of the toe piece and then pushes the heel of the boot straight down into the heel binding. FIG. 8 shows another popular front binding (referred to in this patent as the "shrouded" binding). The shrouded binding has its toe securing abutment 40 covered by a non-moving toe piece shroud 46, which has its own shroud bevel 48 and shroud lip 50 which is above the toe securing abutment 40, toe guiding bevel 44 and toe securing lip 42. The shroud lip 50 plays no role in securing the boot. It is a mere fortuitous result of the termination of the toe piece shroud 46. In FIGS. 7 and 8, both front binding types are pictured in the state in which they normally house a boot. In both binding types, any temporary movement of the parts requires great force, is brief, and takes place only during a release of the boot. After a boot release, the components return immediately to their original positions shown.

Figure 9:
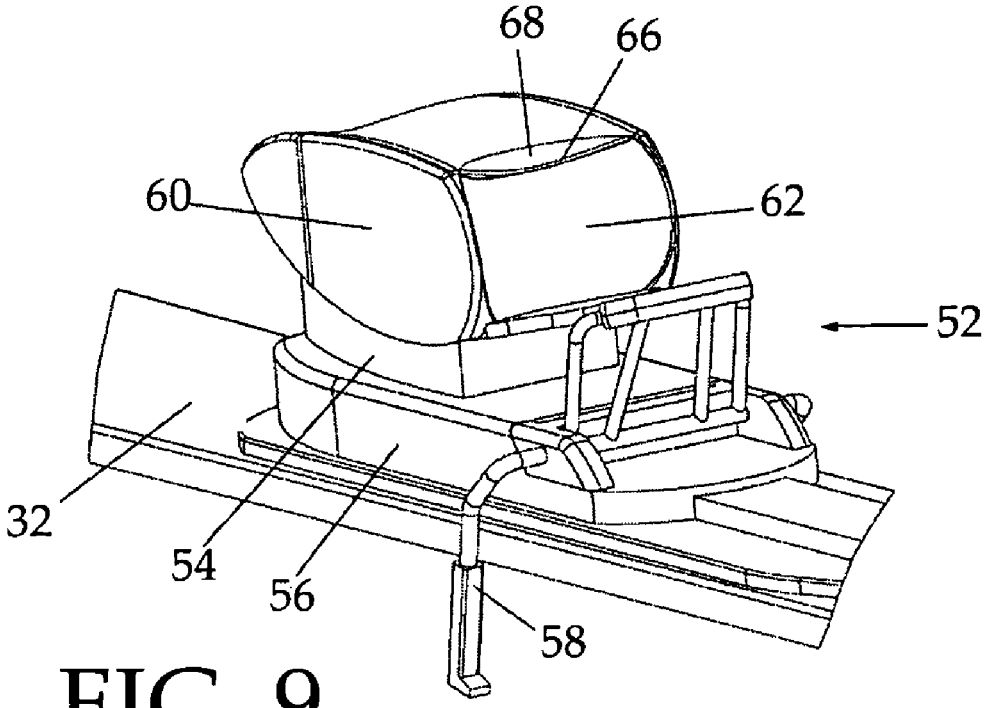
FIG. 9 is a perspective view of a rear binding with the release lever in the up position for releasing the boot heel.
Figure 10:
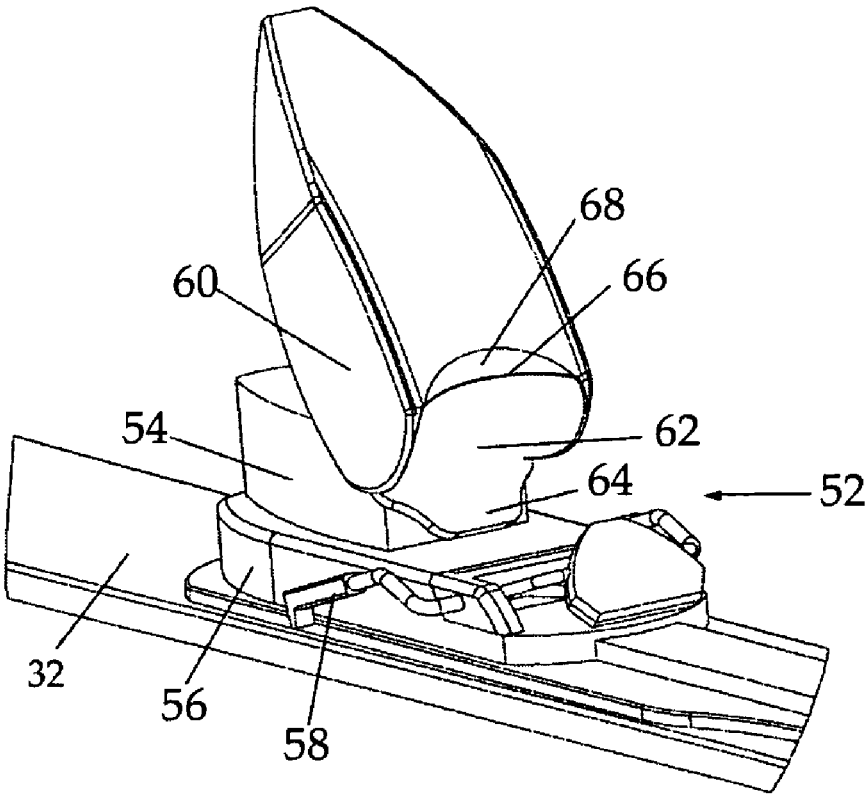
FIG. 10 is a perspective view of a rear binding with the heel piece release lever in the down position for securing the boot heel.

Both types of front bindings are typically grouped with what appears in FIGS. 9 and 10 with little relevant variation. FIG. 9 depicts the rear binding 52 in its "up" position with its parts positioned as they would be if the skier had not yet stepped into the bindings. The heel piece 54 rests upon the heel piece platform 56 and is usually capable of sliding rearward along the heel piece platform 56 if a rearward force is applied. The amount of force necessary to act against this spring action is usually set by a technician based upon the skill level, height, and weight of the skier. The heel piece platform 56 also holds a ski brake 58 (shown here in its natural braking position which engages the snow and stops the ski). Mounted on the heel piece 54 to pivot up and down, the heel piece release lever 60 is the part which directly engages the heel of a ski boot. The boot engaging process is as follows: First, the skier slips the toe of the boot under the toe securing lip 42 of the front binding 34. Then, guided by the heel guiding bevel 68, the skier presses the heel downward against the heel receiving surface 62 and the heel receiving seat 64 (more clearly depicted in FIG. 10). The heel piece release lever 60 is forced back and down and springs into a securing position as depicted in FIG. 10. This amount of force required to release the lever back to the up position is usually set by a technician based upon the skill level, height, and weight of the skier. The boot heel is then secured in a downward state by the heel securing lip 66.

FIG. 10 depicts the rear binding 52 in its "down" state with the pieces positioned as they would be if a boot were engaged for skiing. The heel piece release lever 60 is locked down and the ski brake 58 is forced up, disengaged by the downward pressure of the boot. To step out of his skis, the skier usually uses the ski pole tip 22 to press down on the back portion of the heel piece release lever 60 while lifting up on the heel of the boot. This rocks the heel piece release lever 60 back and frees the boot. The skier steps out, with the resulting problem of how to pick up his skis.

The invention takes advantage of the fact that the heel piece release lever is in the "up" position when not in use, with the ironic consequence that the bulk of its body is actually "down" and out of the way, as depicted in FIG. 9. As a result of the different front binding types, when paired with the same rear binding type, the result is two different binding groups: one binding group with a standard rear binding and a beveled front binding, and another binding group with a standard rear binding and a shrouded front binding. Although the bindings depicted are "alpine" or "touring" bindings, the invention's application is not limited to skis with alpine bindings. Some of the embodiments described below are suitable for use on skis with "free ride," "down hill," "telemark," "cross-country," "backcountry," or "Nordic" bindings, as well as a variety of other binding groups, including Kandahar bindings, and other pin and cable systems.

Figure 11:
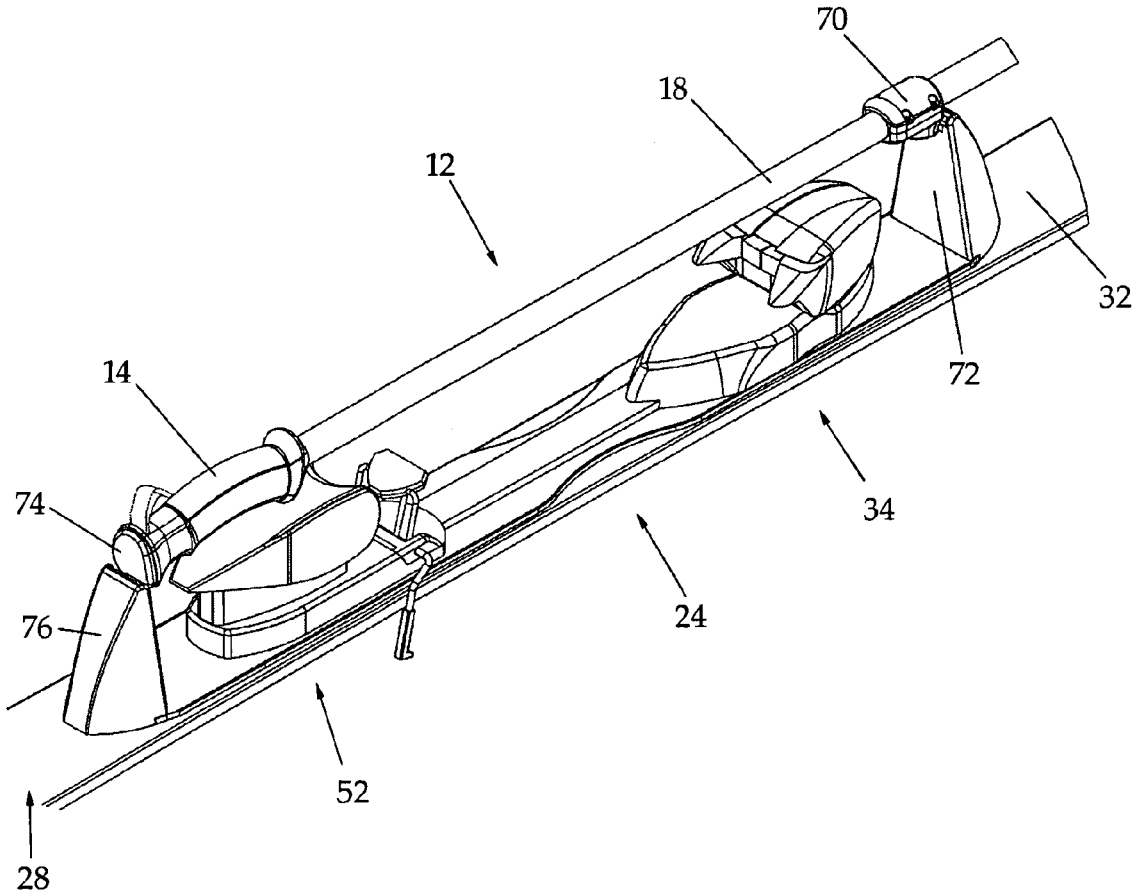
FIG. 11 is a rear perspective view of the basic configuration of the invention, using ski mounted bases which are separate and apart from the bindings.

One such embodiment is depicted in FIG. 11. This figure shows a basic configuration. The ski pole 12 is attached to the ski 24 using means of coupling which join the two in a configuration such that the grip end of the pole 12 is firmly coupled near the rear binding 52 and the forward extending pole shaft 18 is firmly coupled near the front binding 34. The pole 12 is in a position above the top 32 and the bindings, parallel with the ski, and extending forward. This position is unique and leaves the tail 28 of the ski clear and unencumbered. Although such means of coupling could be incorporated into the surface of the top 32 and the material of the shaft 18 and grip 14, this particular example employs a front pole mounted base 70 and a front ski mounted base 72 to support the front means of coupling; and it uses a rear pole mounted base 74 and a rear ski mounted base 76 to support the rear means of coupling.

Figure 12:
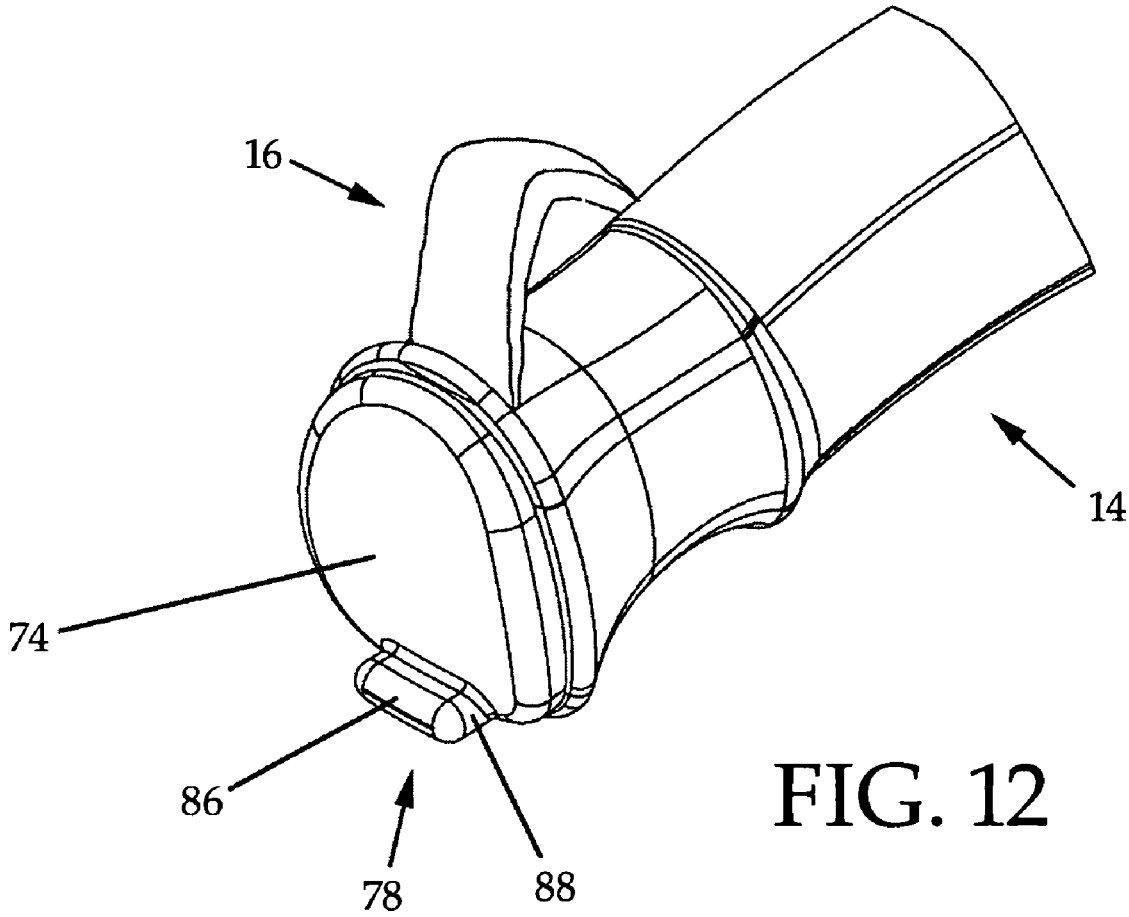
FIG. 12 is a perspective view of the ski pole handle serving as a base for the elongate node version of the rear pole coupling formation.
Figure 13:
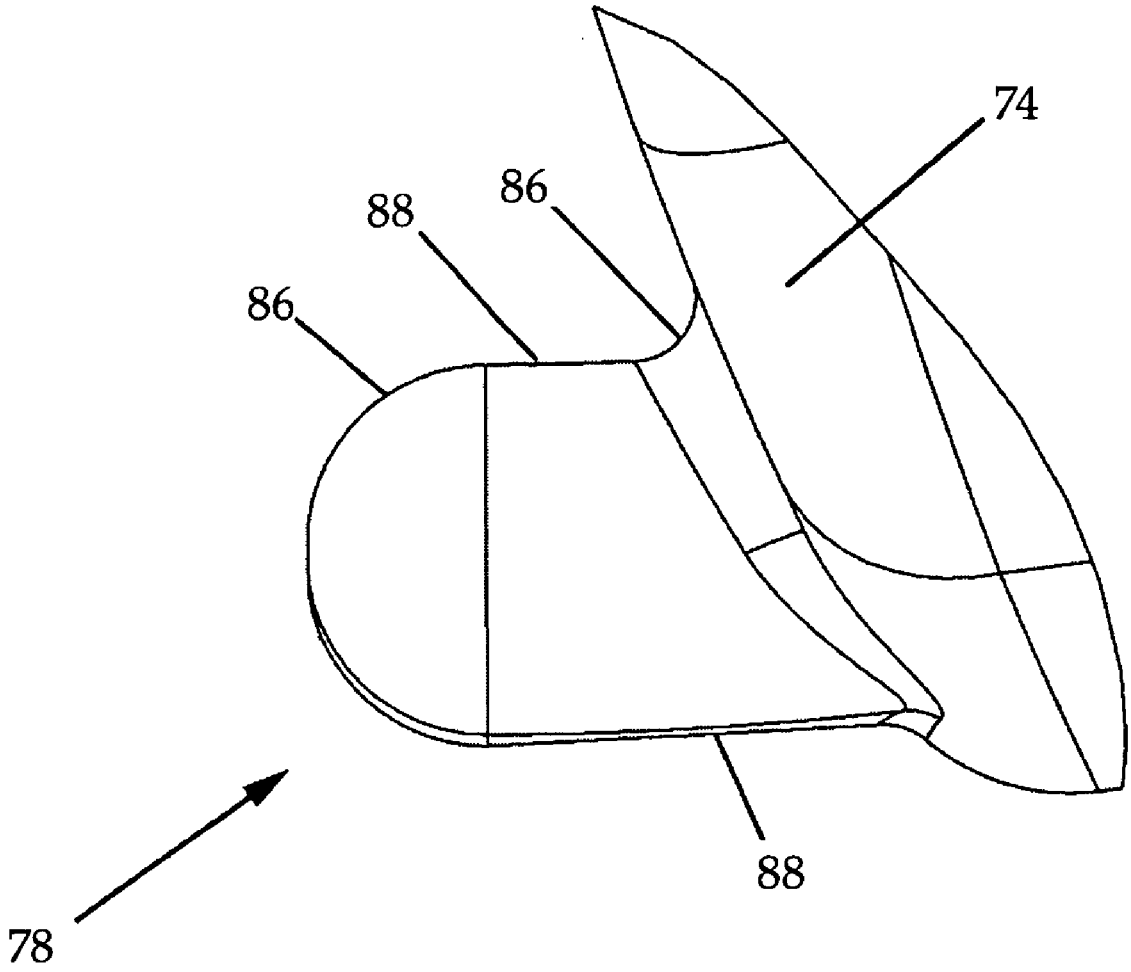
FIG. 13 is a side view detail of the ski pole handle serving as a base for the elongated node version of the rear pole coupling formation.

FIGS. 12 and 13 show the detail of the particular means of coupling borne by the grip 14 of the pole 12 in this embodiment. A rear pole coupling formation 78 including the shape of an elongated node is borne by the rear pole mounted base 74. The rear pole mounted base 74 here, is in the shape of a cap, and is affixed on the top of the grip 14 just above the strap 16. The rear pole mounted base 74 could be affixed to the top of the grip 14 by glue or other fastening means (as a retrofit of existing poles); or it could be manufactured as a molded part of an original equipment grip. As a retrofit the rear pole coupling formation 78 could also be directly affixed to the top of a grip (serving as the rear pole mounted base 74) by a plug, dowel, or other fastening means. The molded rear pole mounted base 74 depicted in the figures to this patent are only illustrative of the various fastening means for the rear pole coupling formation 78 or its parent coupling means. The rear pole coupling formation 78 includes surfaces whose number, orientation, size and shape are sufficient to guide the formation into place (positioning surfaces 86) and surfaces whose number, orientation, size and shape are sufficient to prevent movement once the formation is in place (securing surfaces 88). Securing surfaces 88 and positioning surfaces 86 can overlap or be one in the same, depending on the phase of the process at the time of their identification as such. As the nature of these surfaces varies greatly and one may curve into another, or play the other's role at differing times, a line or arrow identification mark in the figures should not be considered limiting, but rather illustrative.

Figure 14:
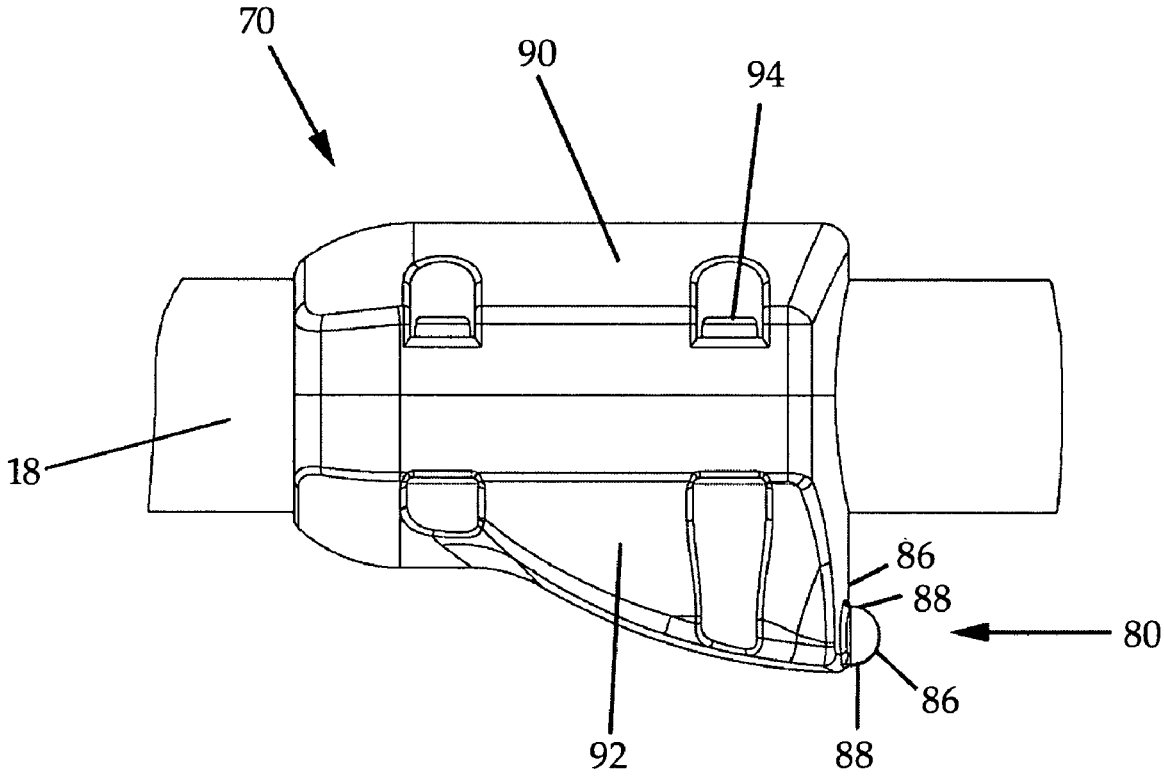
FIG. 14 is a side view of the front pole mounted base supporting the elongated node version of the front pole coupling formation.
Figure 15:
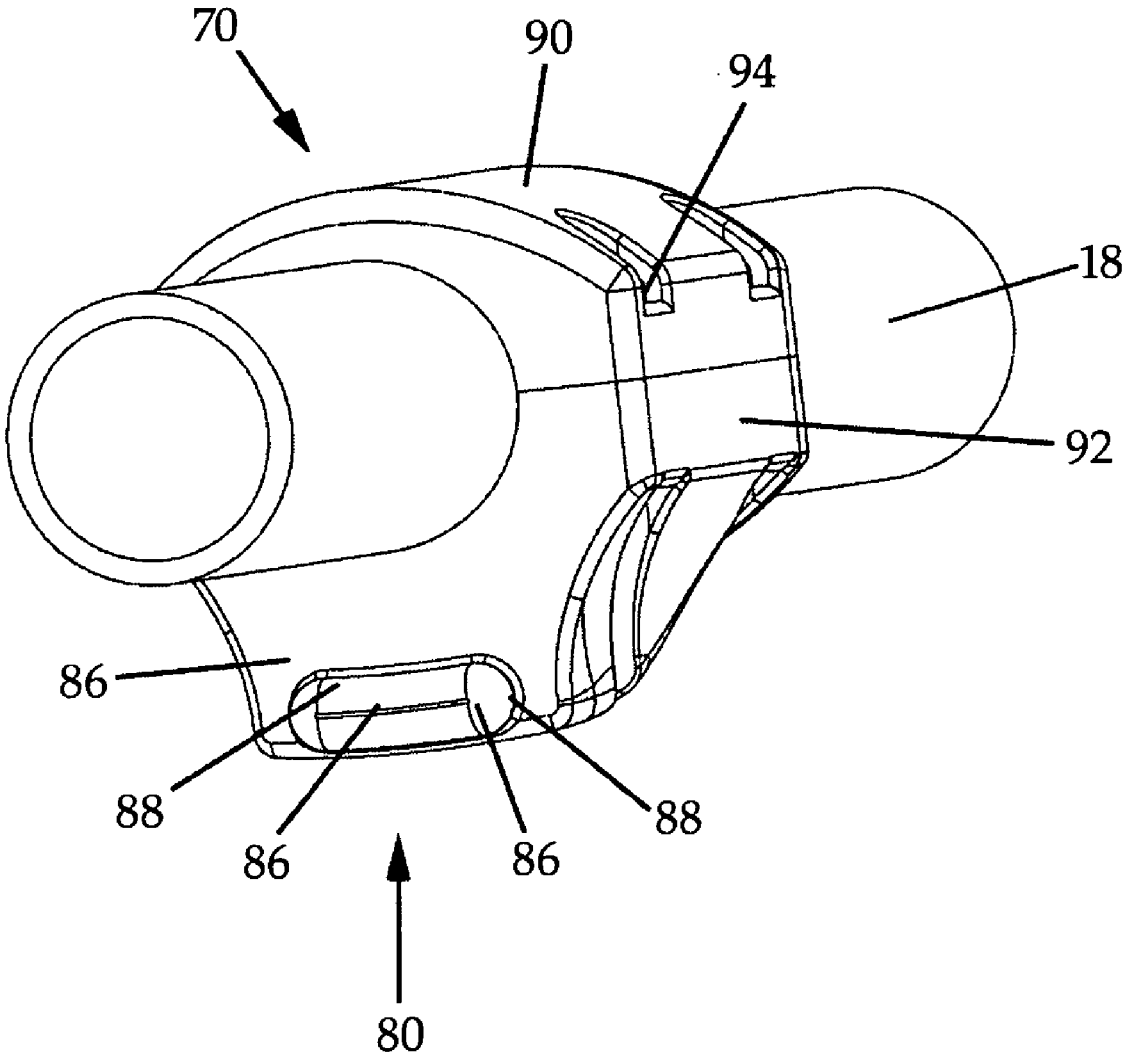
FIG. 15 is a perspective view of the front pole mounted base supporting the elongated node version of the front pole coupling formation.

FIGS. 14 and 15 show the detail of the particular means of attachment borne by the shaft 18 of the pole 12 in this embodiment. A front pole coupling formation 80 is borne by the front pole mounted base 70. The front pole mounted base 70 as depicted in FIGS. 14 and 15 is in the form of a top clamping piece 90 and a bottom clamping piece 92 tightened by four tightening screws 94; and as such could serve as a retrofit of existing poles (because it can be wrapped around the pole 12 without removing the grip 14 or the basket 20. The front pole mounted base could also be used in original equipment manufacture (OEM). A more convenient form for OEM might be a single piece with a single tightening screw, cam or lever, or other tightening means which may be placed over the pole before the basket or grip is affixed. The front pole mounted base 70 may be positioned along the shaft 18 of the pole 12 at a distance from the rear pole coupling formation 78 consistent with the distance between the coupling formations on the ski mounted bases which is in large part, determined by the length of the skier's boot. The front pole mounted base 70 may be incorporated into the surface of the shaft 18 or fastened to the shaft 18 by a variety of adjustable means, such as an expanding insert placed into a track built into the shaft 18 or a much smaller clamping unit placed over a rail affixed to the shaft 18. The clamping pieces depicted in the figures to this patent are only illustrative of the various fastening means for the front pole coupling formation 80 and its parent coupling means. The front pole coupling formation 80 includes the shape of an elongated node and has positioning surfaces 86 whose number, orientation, size and shape are sufficient to guide the formation into place. It also includes securing surfaces 88 whose number, orientation, size and shape are sufficient to prevent movement, once the formation is in place. The lower front portion of the front pole mounted base 70 also serves as part of the front pole coupling formation 80 by providing a securing surface 88 to keep the entire arrangement snug, urging the rear pole coupling formation 78 into the rear ski coupling formation 84.

Figure 16:
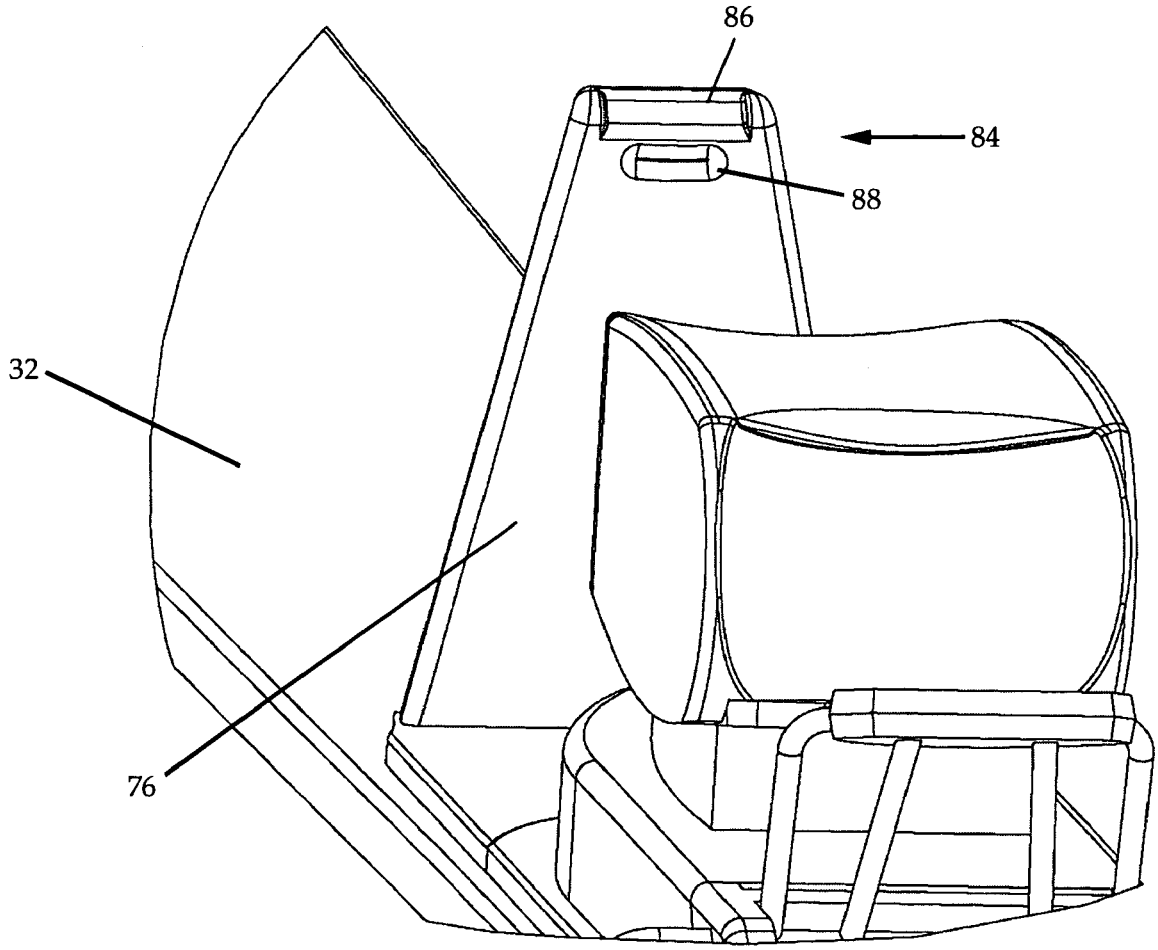
FIG. 16 is a perspective view of a rear ski mounted base supporting the elongated node version of the rear ski coupling formation.

FIG. 16 shows a detail of the rear ski mounted base 76 and the rear ski coupling formation 84 incorporated into its upper end. The rear ski coupling formation 84 includes positioning surfaces 86 whose number, orientation, size and shape are sufficient to guide the formation into place (here including the shape of a beveled striker) and securing surfaces 88 whose number, orientation, size and shape are sufficient to prevent movement of the coupling formations once in place (here including the shape of an elongated cavity). It should be noted that the protruded and indented nature of the positioning surfaces 86 and the securing surfaces 88 can be reversed in many cases without affecting their ability to achieve the coupling result.

Turning again to FIG. 16, in this embodiment a positioning surface 86, which is a beveled striker, is oriented to allow the rear pole coupling formation 78 to be pushed down and snapped into place if the front pole coupling formation 80 and the front ski coupling formation 82 have already been fitted together. The securing surfaces 88 in this embodiment include an elongated cavity to compliment and contact the rear securing surfaces 88 of the rear pole coupling formation 78 at all points. The rear ski mounted base 76 is attached to the top 32 of the ski using an attachment means such as an adhesive or screws. The front ski mounted base 72 would be substantially the same as shown in FIG. 11. The ski mounted bases, adhesives and screws mentioned in this patent are only illustrative of the various fastening means available for the front ski coupling formation 82 and the rear ski coupling formations 84 or their parent means of attachment.

In this embodiment, the rear ski mounted base 76 and the front ski mounted base 72 would be constructed of a strong polymer which has some flexion, such as nylon, in order to allow some separation of the rear ski coupling formation 84 and the front ski coupling formation 82 when their positioning surfaces 86 (beveled strikers) are engaged by the elongated nodes of the rear pole coupling formation 78 and/or the front pole coupling formation 80 and a downward force is applied by the skier. This downward force, applied while the ski 24 is lying base 30 down on the snow, will be of sufficient magnitude to urge the front ski coupling formation 82 and the rear ski coupling formation 84 apart a distance sufficient to allow the securing surfaces 88 of both pole coupling formations to come into parallel contact with their counterpart securing surfaces 88 of both ski coupling formations. In other words, the bases will be forced apart when the elongated nodes press on the strikers and will snap back into position when the nodes pop into the elongated cavities. Thus, the flexion properties of the material would allow the rigid carriage of the ski by the pole as shown in FIGS. 1, 2, and 3. Such flexion properties, along with the flexion of the ski itself, would allow the front ski coupling formation 82 and the rear ski coupling formation 84 to separate sufficiently to disengage from the front pole coupling formation 80 and the rear pole coupling formation 78 when a firm pull in the reverse direction is used on the pole while securing the movement of the ski.

Some figures describing the embodiments show features of the binding groups which act in dual capacities. In the originally intended capacity, such features are used as a means to engage and disengage a boot for the act of skiing. However, certain embodiments use these same features in a previously unimagined way: as a means to couple with a pole coupling means for the purpose of carrying the ski and pole as a single unit. When such features are shown in the drawings, two different numbers may be used to describe the same feature. The number (lower in denomination) indicates the originally contemplated function and its nomenclature according the list of reference numbers and the discussion of FIGS. 7, 8, 9, and 10. The number (higher in denomination) indicates the newly conceived function and its nomenclature according to the list of reference numbers and the discussion of the embodiment.

Figure 17:
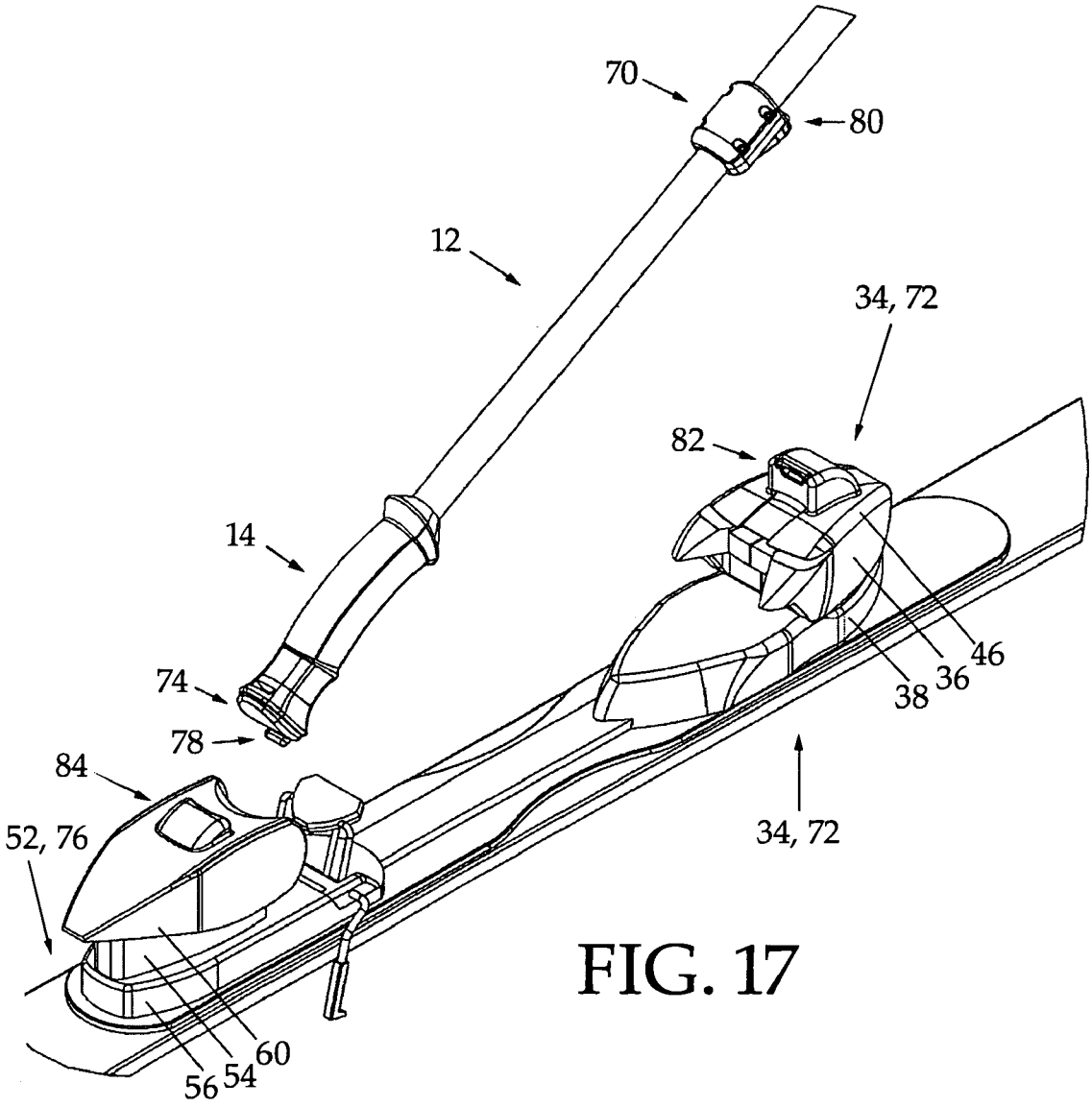
FIG. 17 is a perspective view of the front and rear bindings serving as ski mounted bases for the elongated node version of the pole coupling formations, and the ski pole supporting the front and rear pole coupling formations of the elongated node version of the pole coupling formations.

Another embodiment is shown in FIGS. 17, 18, 19, and 20. This embodiment employs the bindings as the ski mounted bases for the ski coupling means. The bindings play this role well, as they are already attached to the top 32 of the ski 24 in the proper orientation. In FIG. 17, the front binding 34 (including the toe piece shroud 46, the toe piece 36, and its supporting toe piece platform 38) serves as the front ski mounted base 72 upon which the front ski coupling formation 82 is affixed. The rear binding 52 (including the heel piece release lever 60, heel piece 54, and heel piece platform 56) serves as the rear ski mounted base 76 upon which the rear ski coupling formation 84 is affixed.

As FIG. 17 shows, the ski pole coupling means are the same in this embodiment as they are in the previous embodiment. The pole 12 supports a front pole mounted base 70 with a front pole coupling formation 80 in the shape of an elongated node. The grip 14 supports a rear pole mounted base 74 with a rear pole coupling formation 78, also in the shape of an elongated node. The specifics of the front pole mounted base 70, the front pole coupling formation 80, the rear pole mounted base 74 and the rear pole coupling formation 78 are also the same as in the previous embodiment.

Figure 18:
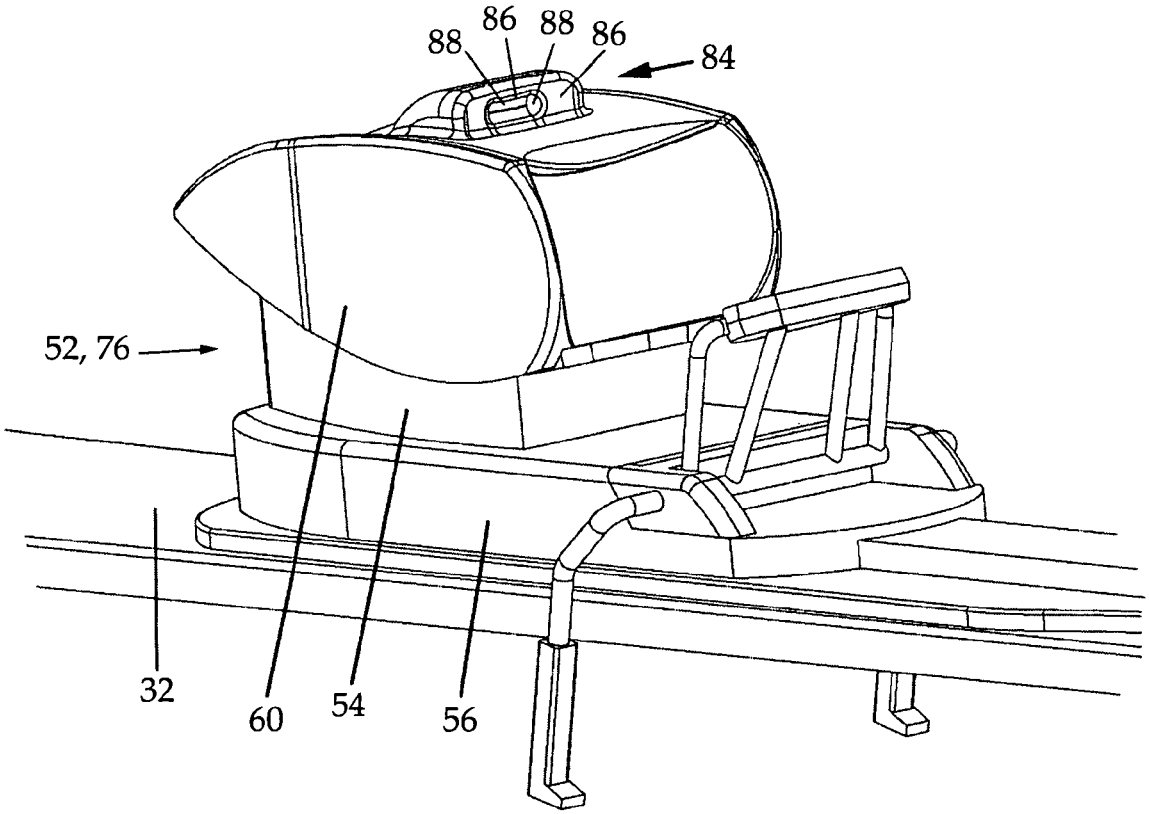
FIG. 18 is a perspective view of the rear binding used as a base for the elongated node version of the rear ski coupling formation.

FIG. 18 depicts the positioning surfaces 86 and securing surfaces 88 of the rear ski coupling formation 84 as it is affixed on the top 32 of the ski 24 via the rear ski mounted base 76, which in this embodiment happens to be the rear binding 52. Also shown are the subcomponents: heel piece platform 56, the heel piece 54, and the heel piece release lever 60. In this embodiment the rear ski coupling formation 84 also includes an elongated cavity. The rear ski coupling formation 84 may be incorporated into the material of the heel piece release lever 60 as original equipment or may be fastened; using adhesive, welding, or other fastening means to serve as a retrofit of existing bindings. As the positioning surfaces 86 on the rear ski coupling formation 84 are not beveled in this embodiment, the rear pole coupling formation 78 must be inserted into the rear ski coupling formation 84 first.

Figure 19:
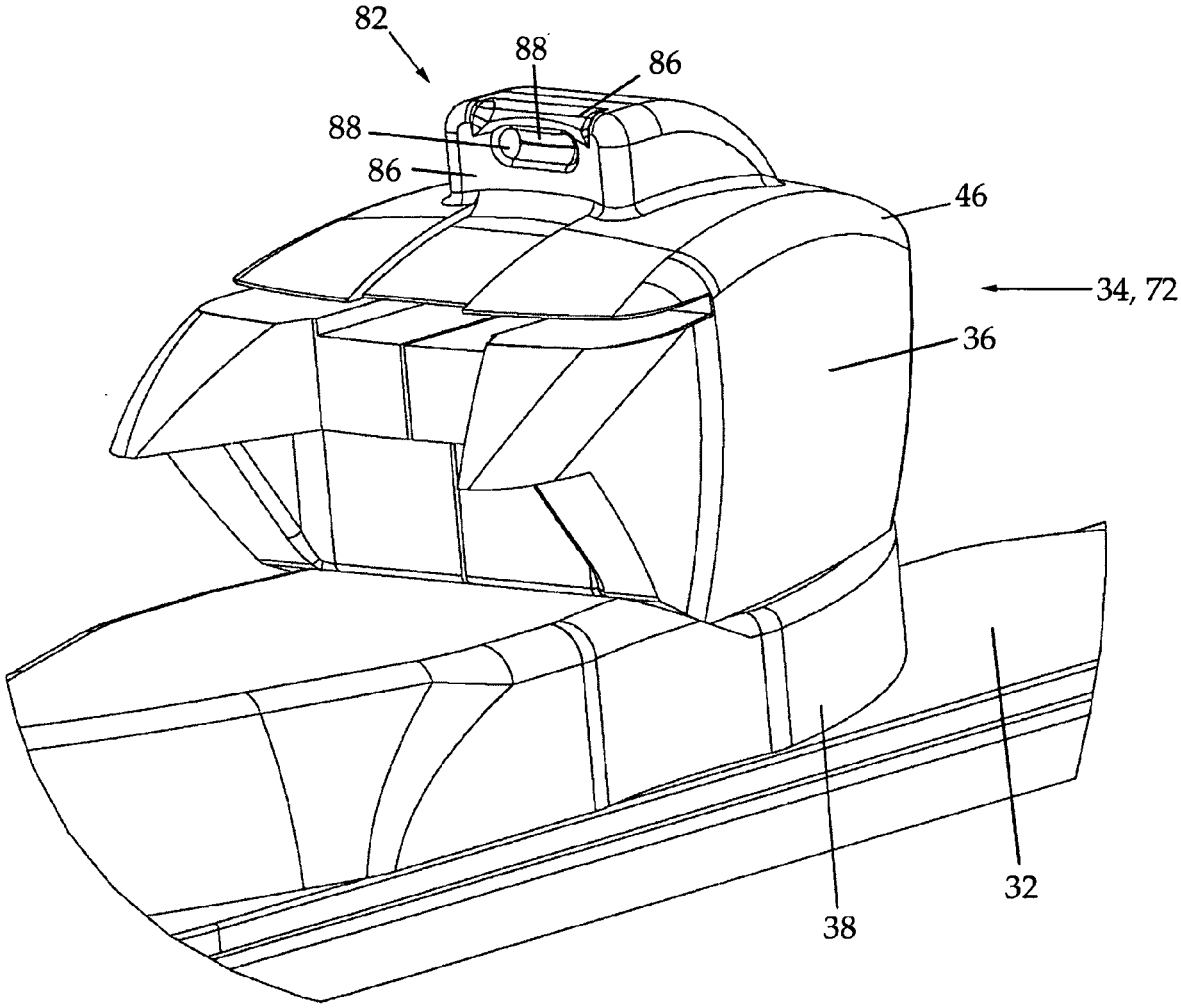
FIG. 19 is a perspective view of the front binding used as a base for the front ski coupling formation which accommodates the elongated node version of the front pole coupling formation.
Figure 20:
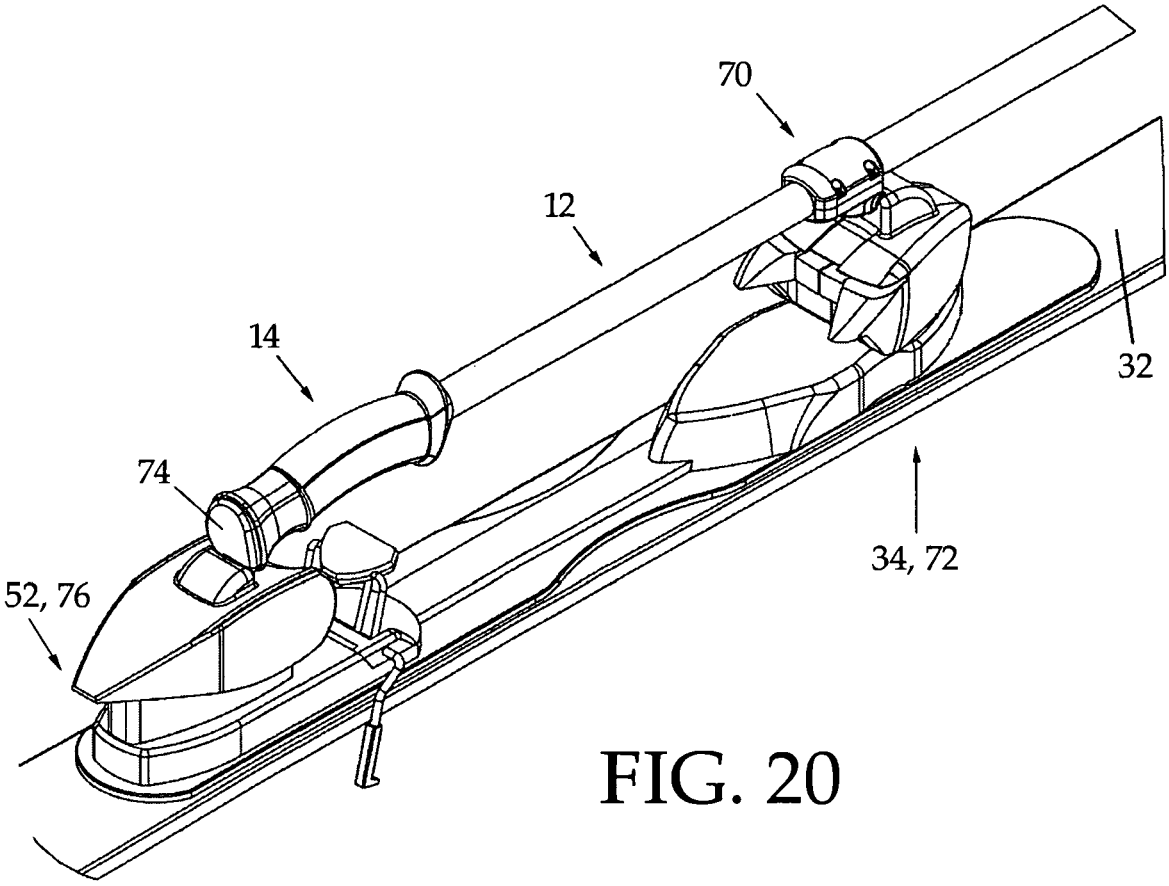
FIG. 20 is a perspective view of an engaged coupling performed by the elongated node embodiment of the invention.

FIG. 19 depicts the positioning surfaces 86 and securing surfaces 88 of the front ski coupling formation 82 as it is affixed on the top 32 of the ski 24 via the front binding 34 serving as the front ski mounted base 72. Shown also are the toe piece shroud 46, the toe piece 36 and the toe piece platform 38. In this embodiment the front ski coupling formation 82 includes the shape of an elongated cavity. The front ski coupling formation 82 may be incorporated into the material of the toe piece 36 or the toe piece shroud 46 as original equipment, or may be fastened using adhesive, welding, or other fastening means to serve as a retrofit of existing bindings. FIG. 19 reveals that, in this embodiment, one of the positioning surfaces 86 on the front pole coupling formation constitutes a beveled striker, placed above the securing surfaces on said formation. Thus, after the rear coupling formations are placed together, the downward movement of the front pole coupling formation 80 into the front ski coupling formation 82 will cause the bottom front positioning surfaces 86 on the front pole coupling formation 80 to contact with the beveled striker shaped positioning surface 86 on the front ski coupling formation 82. Continued downward force will cause these positioning surfaces 86 to slide over one another and the resulting movement will urge the entire ski pole 12, the heel piece 54, and the heel piece release lever 60 rearward, engaging the spring action of the rear binding and creating a tight coupling as shown in FIG. 20. The forward pressure applied by the spring action of the heel piece 54 as previously discussed, works in place of the flexion provided by the material of the ski mounted bases in the previous embodiment. Such spring action, along with the flexion of the ski itself, would allow the front ski coupling formation 82 and the rear ski coupling formation 84 to separate sufficiently to disengage from the front pole coupling formation 80 and the rear pole coupling formation 78 when a firm pull is used on the pole while securing the movement of the ski.

Figure 21:
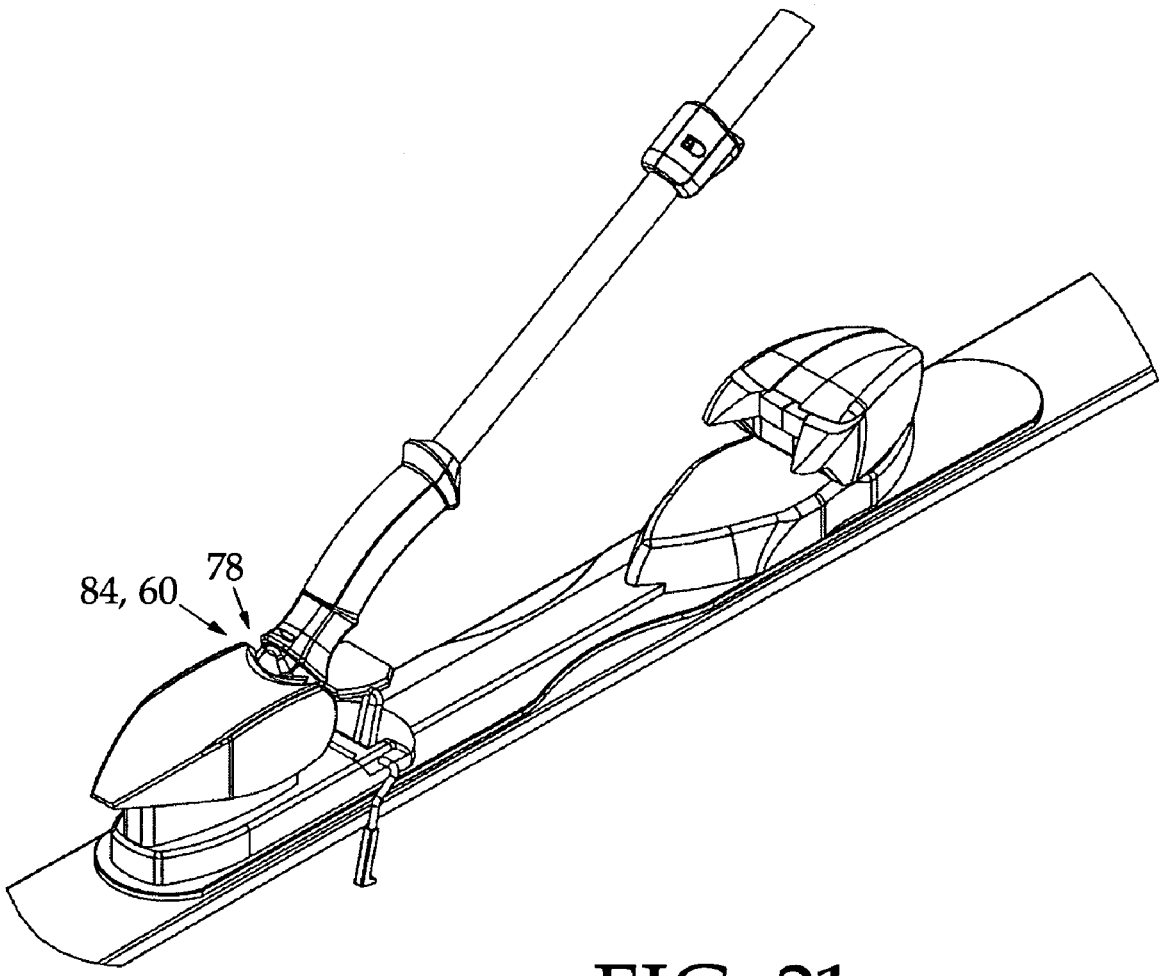
FIG. 21 is a perspective view of the pole grip supporting a canted seat embodiment of the rear pole coupling formation being placed into a rear binding serving as a base for the rear ski coupling formation which includes the heel piece release lever.

A current embodiment utilizes the standard features on a shrouded binding (shown in FIGS. 8 and 9) to act as bases and coupling means for the ski 24. Thus, no separate bases or any modification of the bindings system is necessary. This embodiment has the advantage that only the ski pole (which is much less expensive than the binding) requires modification (as retrofit or original equipment). FIG. 21 depicts the placement of the rear pole coupling formation 78 into, (as opposed to on) the heel piece release lever 60.

Figure 22:
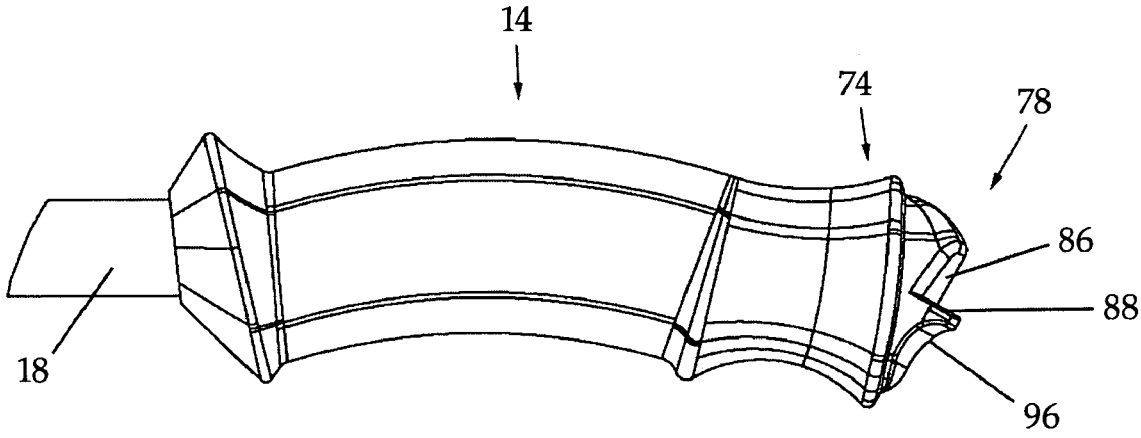
FIG. 22 is a side view of a grip serving a rear pole mounted base for the canted seat embodiment of the rear pole coupling formation.
Figure 23:
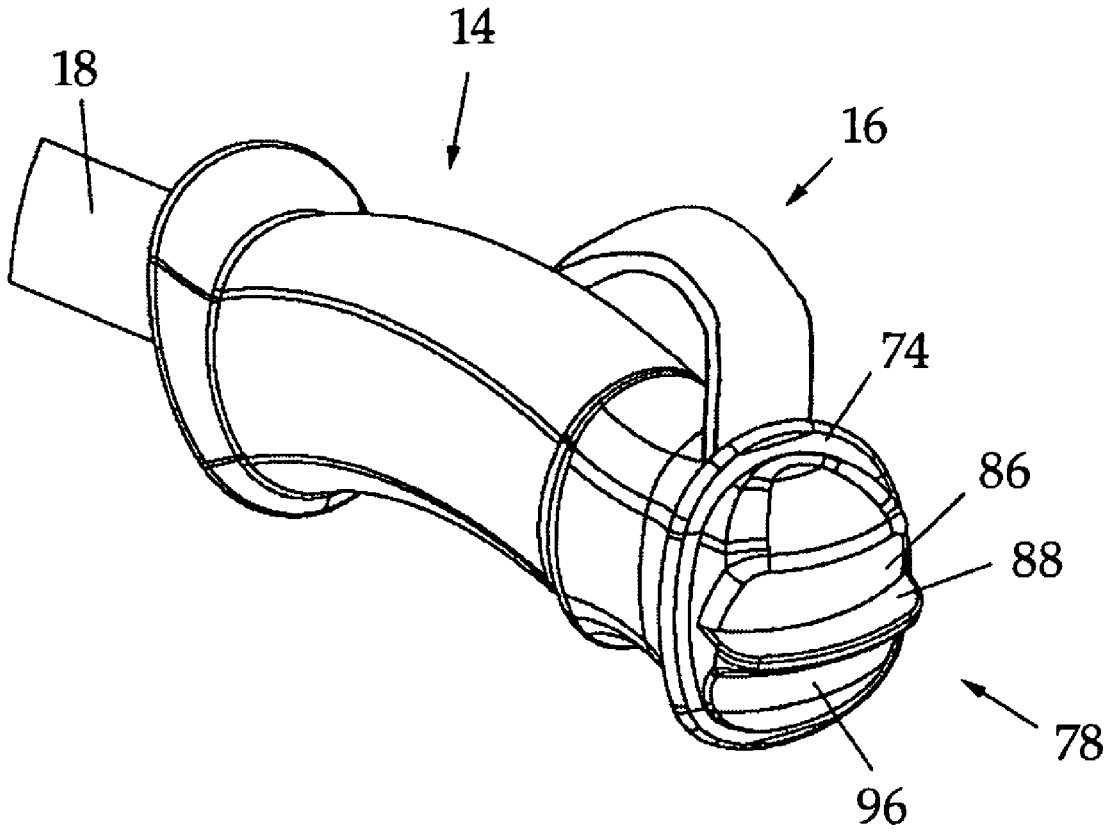
FIG. 23 is a side view of a grip serving a rear pole mounted base for the canted seat embodiment of the rear pole coupling formation.

The seating of rear pole coupling formation 78 into a standard heel piece release lever 60 while in the "up" position is accomplished by way of its unique shape and orientation, which resembles a "canted seat" as depicted in FIGS. 22 and 23. Unlike previous embodiments, the rear pole coupling formation 78 is affixed directly to the top portion of the handle 2 which doubles here as the rear pole mounted base 74. A positioning surface 86 and a securing surface 88 form a canted seat which lies above a contact avoidance recess 96. The contact avoidance recess 96 is instrumental in allowing the securing surface 88 and positioning surface 86 of the rear pole coupling formation 78 to reach back far enough to engage the heel piece release lever 60 properly.

Figure 24:
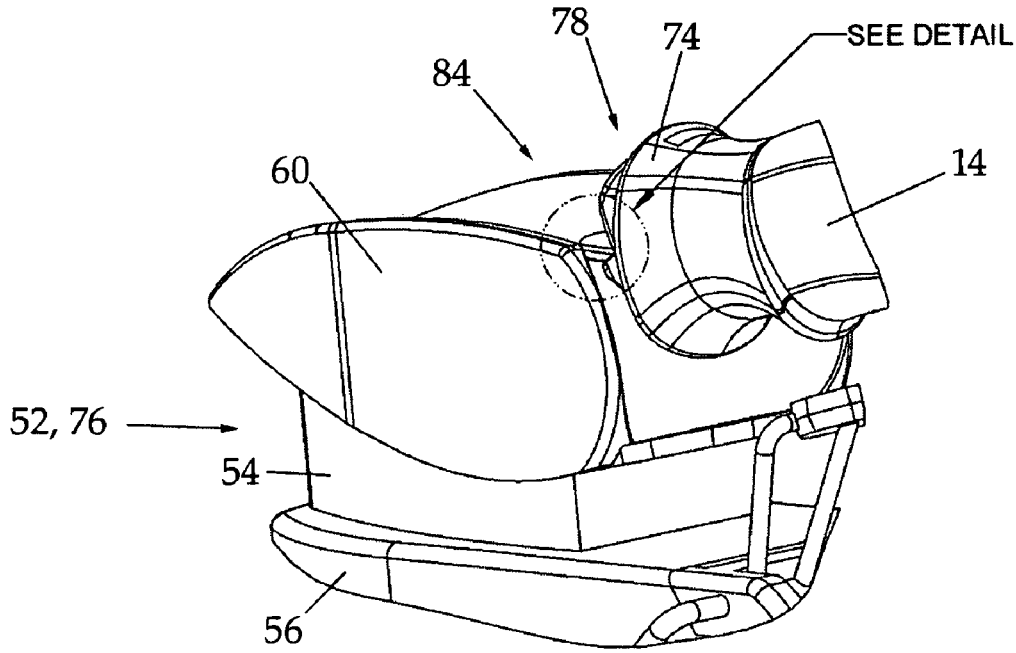
FIG. 24 is a perspective view of the grip serving a rear pole mounted base for the canted seat embodiment of the rear pole coupling formation which is being placed into a rear binding serving as a base for the rear ski coupling formation which includes the heel piece release lever.

FIG. 24 shows how this embodiment creatively uses standard pole and binding parts in a manner in which such parts were never before intended to be used. It shows the rear pole coupling formation 78 mounted on the grip 14 (doubling as the rear pole mounted base 74) as it engages the heel piece release lever 60 whose front portion includes the rear ski coupling formation 84. The rear binding 52 performs the role of the rear ski mounted base 76 in this embodiment. Also shown are binding subcomponents (heel piece 54, the heel piece platform 56, and the heel piece release lever 60.

Figure 25:
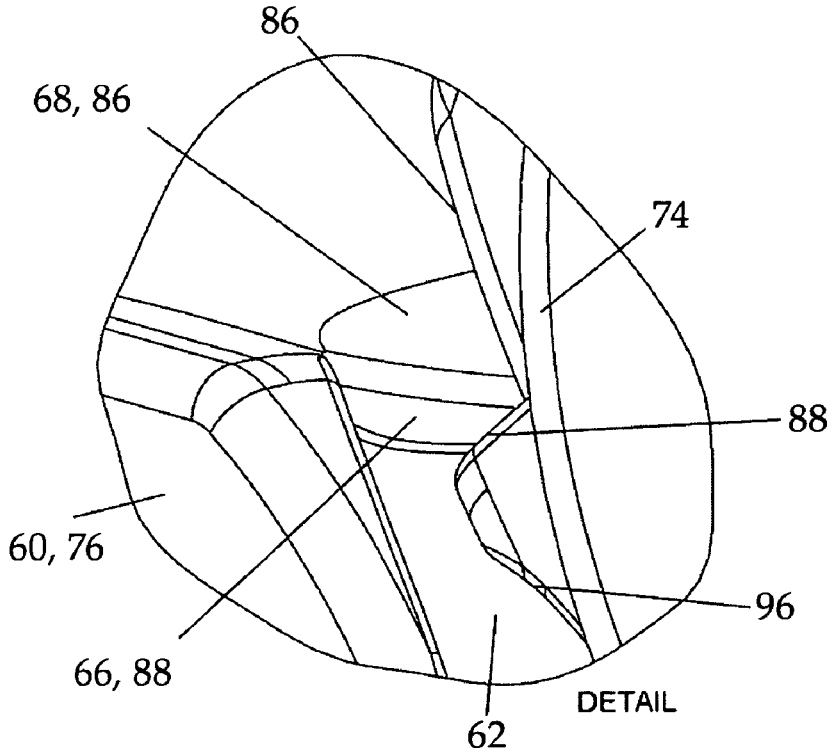
FIG. 25 is a close up detail of the placement shown in FIG. 24.

FIG. 25 shows the detail of how the surfaces of the rear pole coupling formation 78 and the rear ski coupling formation 84 interact. A securing surface 88 of the rear pole coupling formation 78 lies beneath the heel securing lip 66 which also doubles as a securing surface 88 of the rear ski coupling formation 84. Also, a positioning surface 86 of the rear pole coupling formation 78 rests against the heel guiding bevel 68 (more accurately shown in FIGS. 6 & 7) which also doubles here as a positioning surface 86 of the rear ski coupling formation 84. While the heel piece release lever 60 is in the up position, it will not accommodate a boot heel and its heel receiving surface 62 juts forward. To accommodate this unique position, the rear pole coupling formation 78 has a cleverly crafted contact avoidance recess 96 which, unlike the heel of a boot, gets out of the way, allowing positioning surfaces 86 and securing surfaces 88 of the rear pole coupling formation 78 to reach the corresponding securing surfaces 88 and positioning surfaces 86 of the rear ski coupling formation 84, which in this embodiment happen to include the heel securing lip 66, the heel guiding bevel 68, and the heel piece release lever 60, respectively.

The rear pole coupling formation 78 could be in the form of a cap affixed to the top of the grip 14 by glue or other fastening means (as a retrofit of existing poles); or it could be manufactured as a molded part of an original equipment grip. As a retrofit the rear pole coupling formation 78 could also be directly affixed to the top of a grip by a plug, dowel, or other fastening means. The molded rear pole coupling formation 78 depicted in the figures here is only illustrative of the various fastening means for the rear pole coupling formation 78 or its parent coupling means.

Figure 26:
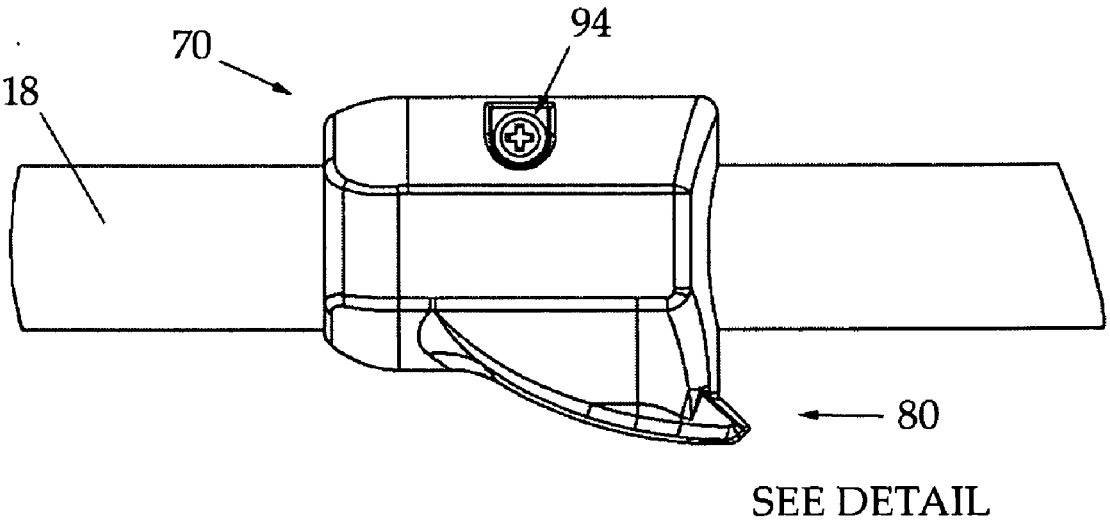
FIG. 26 is a side view of the front pole mounted base supporting the front pole coupling formation in the beveled tooth embodiment of the front pole coupling formation.
Figure 27:
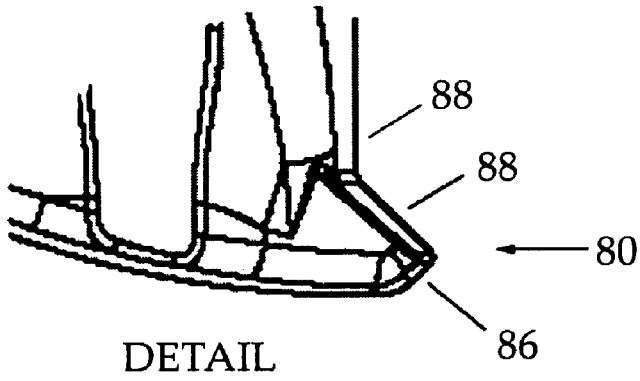
FIG. 27 is a close up detail view of the beveled tooth embodiment of the front pole coupling formation.
Figure 28:
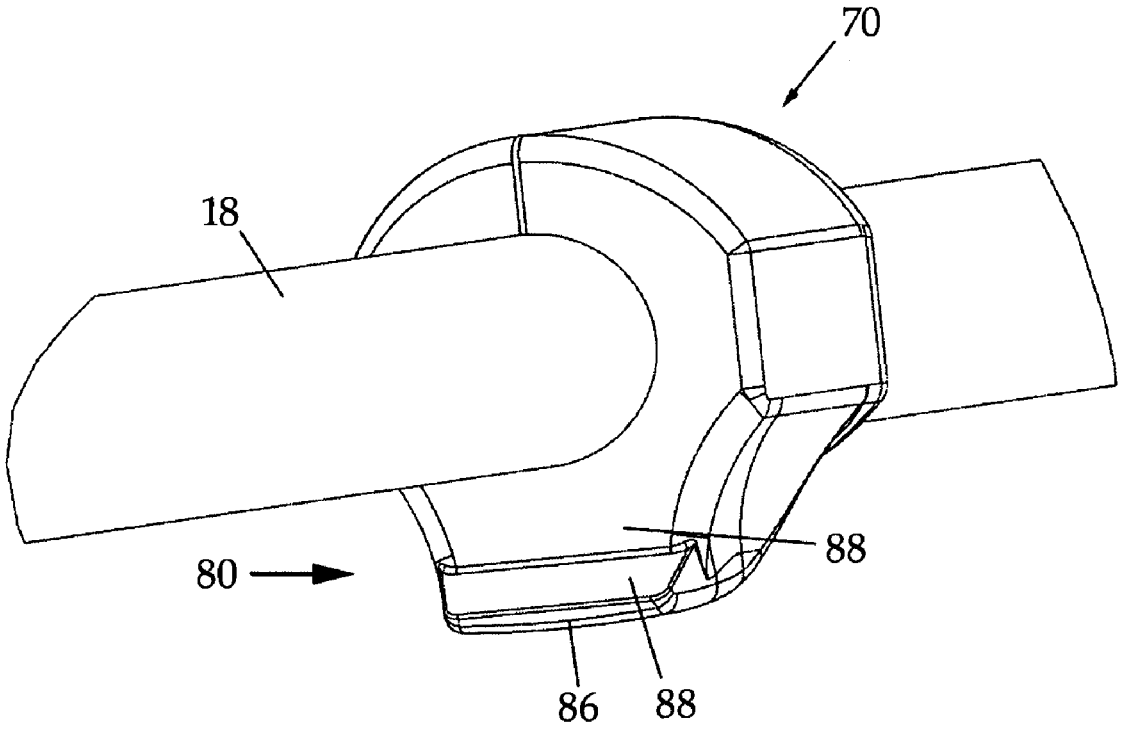
FIG. 28 is a perspective view of the front pole mounted base supporting the front pole coupling formation in the beveled tooth embodiment of the front pole coupling formation.

In this embodiment, the front pole coupling formation 80 is likewise ingenious in that it couples with the surfaces of a standard toe piece shroud 46. FIGS. 26, 27, and 28 depict front pole mounted base 70. The entire pole mounted base 70 is shown here in one piece secured by one tightening screw 94. This limits its use as a retrofit of existing poles, but has an advantage of quick, one step boot length adjustment. As stated previously, this configuration is by no means limiting. The clamping front pole mounted base 70 depicted in the figures to this patent is only illustrative of the various fastening means for the front pole coupling formation 80 or its parent coupling means. The front pole mounted base can be tightened with a single tightening screw 94, a cam or lever or other suitable tightening means. It could be an expanding plug mounted in a track cut into the pole 12, or a very small clamping unit attached to a rail on the shaft 18. It could be the shaft itself formed into the means. It could include a variety of other means to secure the front pole coupling formation 80 to the shaft 18 of the pole 12. FIGS. 26, 27, and 28 also show the securing surface 88 and the positioning surface 86 in detail. Of particular note is their flat, beveled shape, making the bulk of the front pole coupling formation 80 into a beveled tooth. The lower front portion of the front pole mounted base 70 also serves as part of the front pole coupling formation 80 by providing a securing surface 88 to keep the entire arrangement snug, urging the rear pole coupling formation 78 into the rear ski coupling formation 84.

Figure 29:
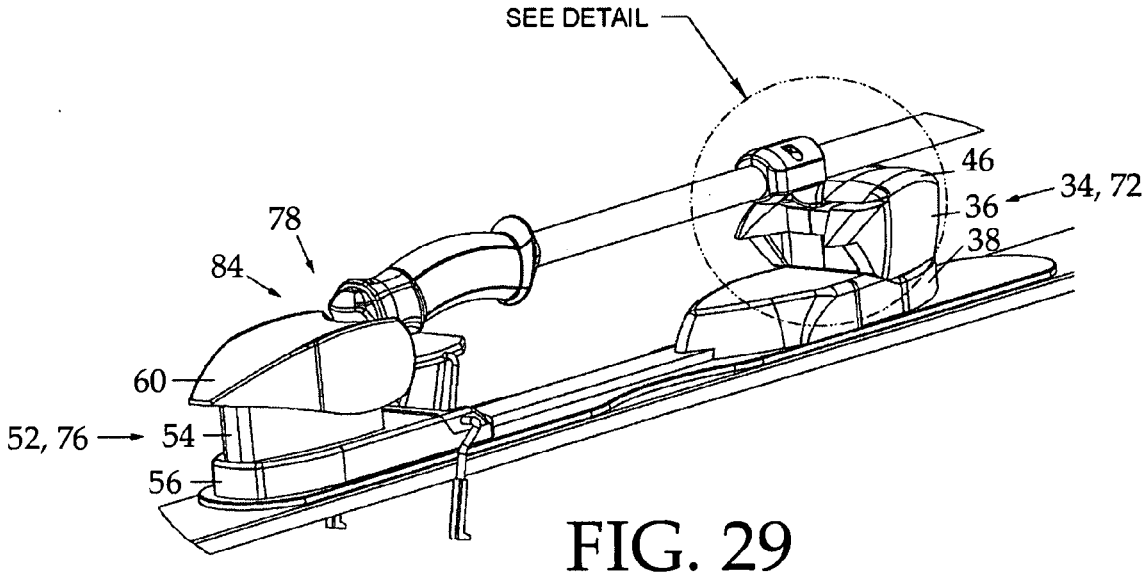
FIG. 29 is a perspective view of an engaged coupling performed by the canted seat embodiment of the rear pole coupling formation paired with the beveled tooth embodiment of the front pole coupling formation.

FIG. 29 shows another view of the rear coupling of this embodiment, with the rear pole coupling formation 78 in its engaged position relative the rear ski coupling formation 84, which is on the heel piece release lever 60. Demonstrated again is the fact that the rear binding 52 serves as the rear ski mounted base 76. Also shown are its subcomponents: the heel piece release lever 60, the heel piece 54, and the heel piece platform 56. This figure also demonstrates how the front binding 34 forms the front ski mounted base 72. Also shown are its subcomponents, the toe piece shroud 46, the toe piece 36 and the toe piece platform 38.

Figure 30:
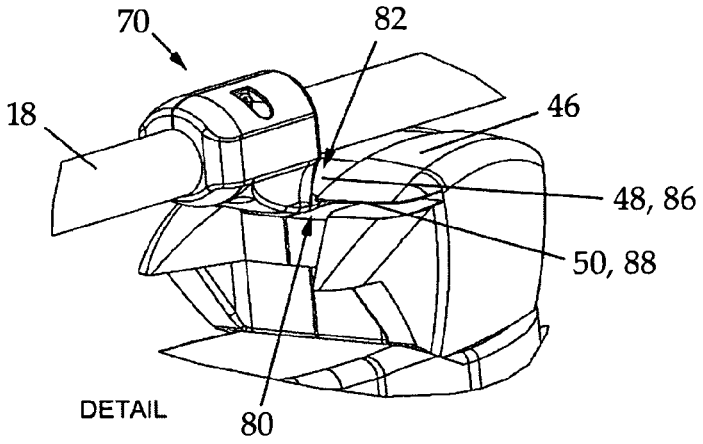
FIG. 30 is a perspective detail view of an engaged coupling performed by the beveled tooth embodiment of the front pole coupling formation.

FIG. 30 also demonstrates the ingenious use of the standard front binding parts in dual roles. It shows how a positioning surface 86 of the front pole coupling formation 80 (the beveled tooth depicted in FIGS. 26-28) engages the shroud bevel 48 which doubles here as a positioning surface 86 of the front ski coupling formation 82 which is on the toe piece shroud 46. Upon application of downward force upon the front pole mounted base, a positioning surface 86, which is the bottom of the beveled tooth of the front pole coupling formation 80 and a positioning surface 86 (the shroud bevel 48) of the front ski coupling formation 82 slide over one another. The resulting movement will urge the entire ski pole 12, the heel piece 54, and the heel piece release lever 60 rearward, engaging the spring action of the rear binding and creating a tight coupling as shown in FIG. 29. As the arrangement snaps into place, the shroud lip 50 actually performs as a securing surface 88 of the front ski coupling formation 82 (on the toe piece shroud 46).

Figure 31:
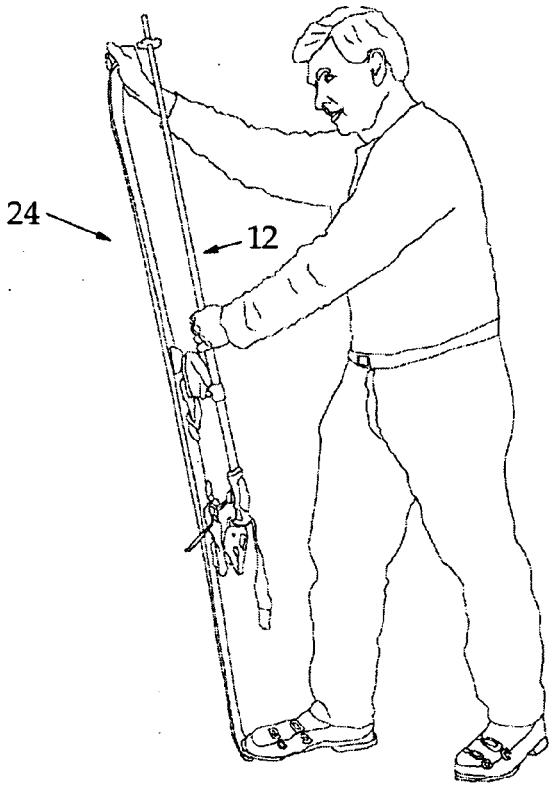
FIG. 31 is a view of a person preparing to disengage a coupled pole-ski unit in the upright orientation.
Figure 32:
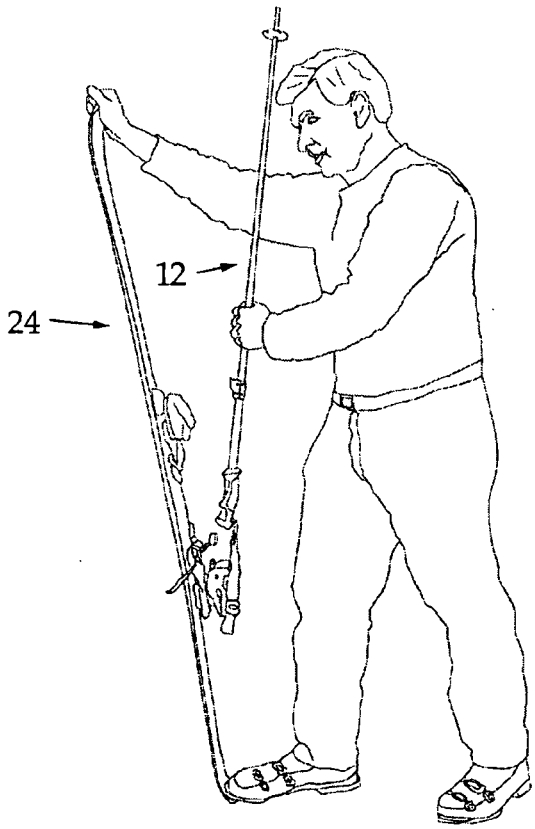
FIG. 32 is a view of a person disengaging a coupled pole-ski unit in the upright orientation.

As shown in FIGS. 31 and 32, disengagement of this embodiment is a snap. The skier simply secures the movement of the ski 24 with hand and foot and pulls on the pole 12. The pulling action forces the top of the beveled tooth (a securing surface 88) to slide against the shroud lip 50 (another securing surface 88) and urges the entire ski pole 12, the heel piece 54, and the heel piece release lever 60 rearward, engaging the spring action of the rear binding and moving the securing surface 88 of the beveled tooth past the shroud lip 50 and free.

Figure 33:
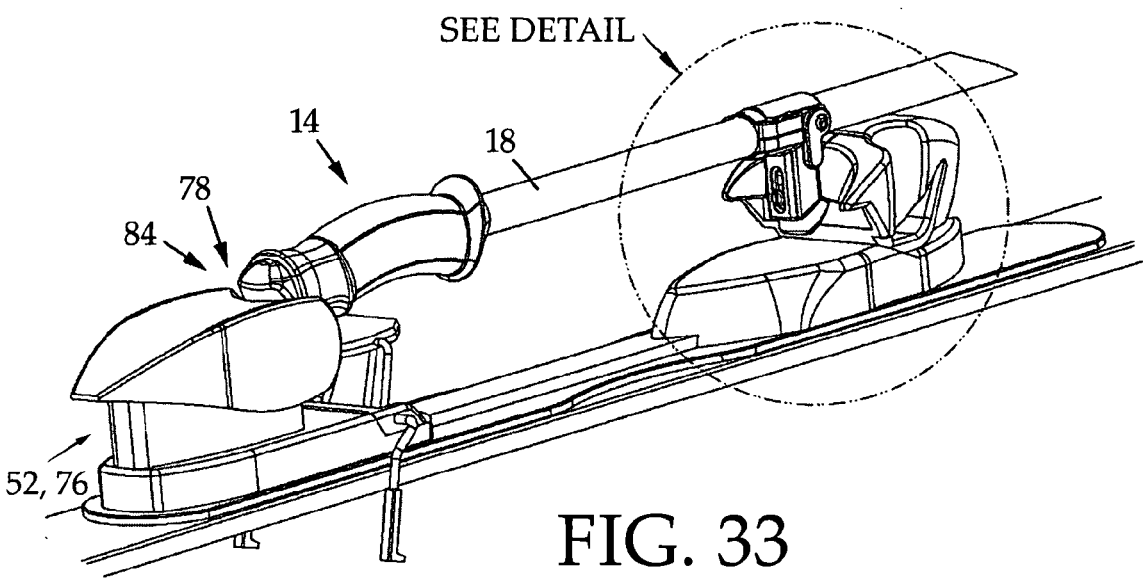
FIG. 33 is a perspective view of an engaged coupling performed by the canted seat embodiment of the rear pole coupling formation paired with the dual toothed curvature embodiment of the front pole coupling formation.

Another current embodiment is shown in FIG. 33. The rear pole to ski coupling takes place in a manner identical to that of the previous embodiment. The difference is in the front coupling detailed in FIG. 34. In this embodiment the front pole coupling formation 80 appears as a dual toothed curvature, shown in FIG. 35. This front pole coupling formation is adjustable in distance from the pole shaft 18, in order to accommodate different sizes of front bindings. This adjustability makes this embodiment a universal version, capable of coupling with the vast majority of standard beveled bindings and many shrouded bindings. Again, because poles are inexpensive to manufacture and no modification of bindings is necessary, this is an advantageous embodiment.

Figure 34:
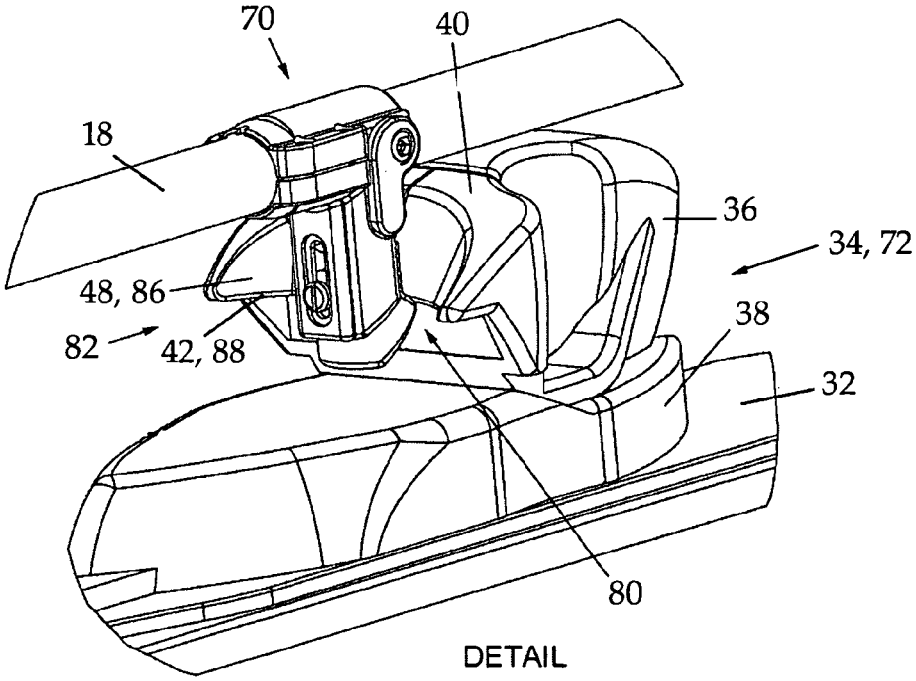
FIG. 34 is a perspective detail view of an engaged coupling performed by the dual toothed curvature embodiment of the front pole coupling formation.

FIG. 34 shows how, in this embodiment, the front binding 34 forms the front ski mounted base 72. Also shown are the toe piece 36 and the toe piece platform 38. FIG. 34 also shows the toe securing abutment 40, whose toe guiding bevel 44 and toe securing lip 42 perform the respective roles of positioning surface 86, and securing surface 88, forming the key components of the front ski coupling formation 82. The front pole coupling formation 80, with its positioning surfaces 86, and securing surfaces 88, includes a dual toothed curvature (described below).

Figure 35:
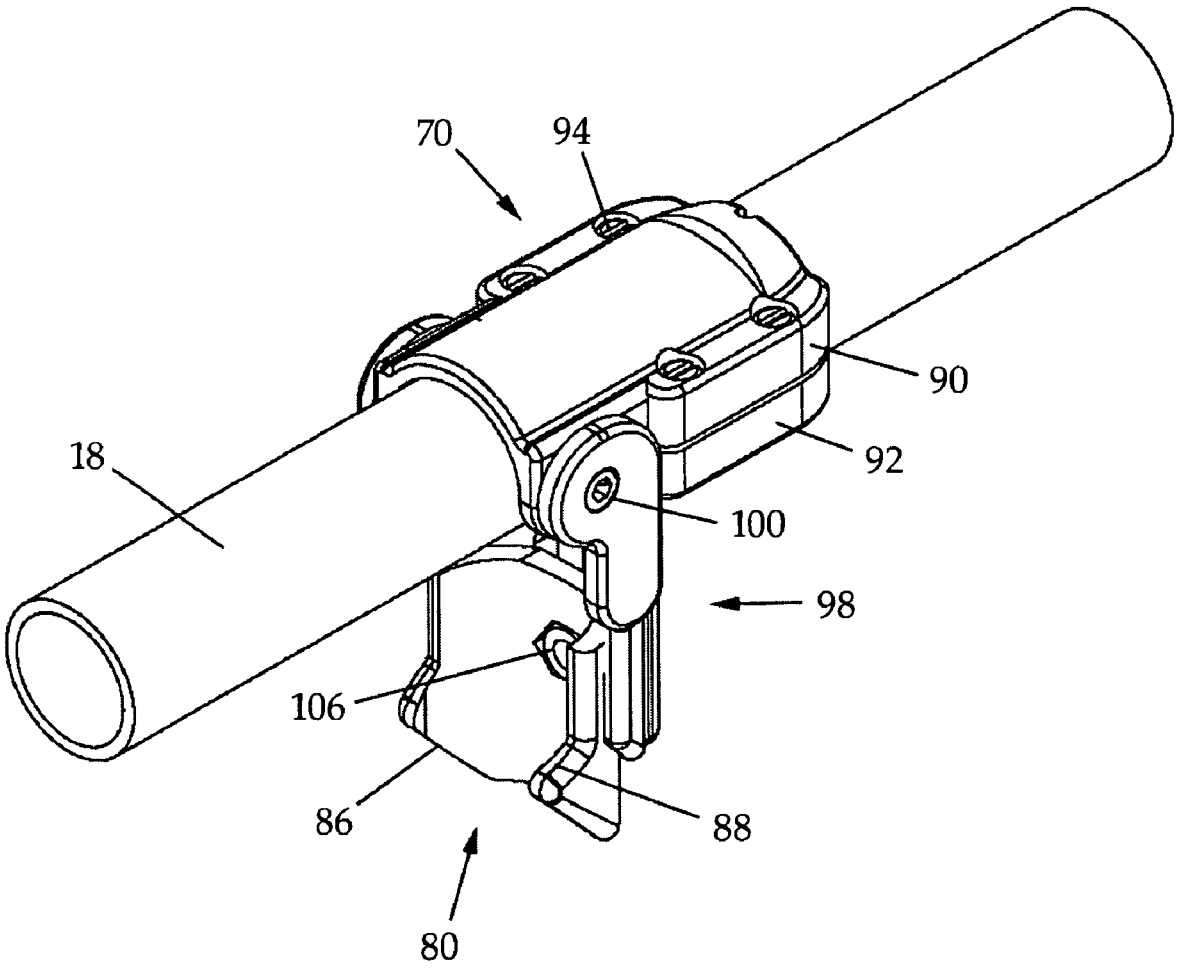
FIG. 35 is a perspective view of the front pole mounted base supporting the dual toothed curvature embodiment of the front pole coupling formation in its engaging position.
Figure 36:
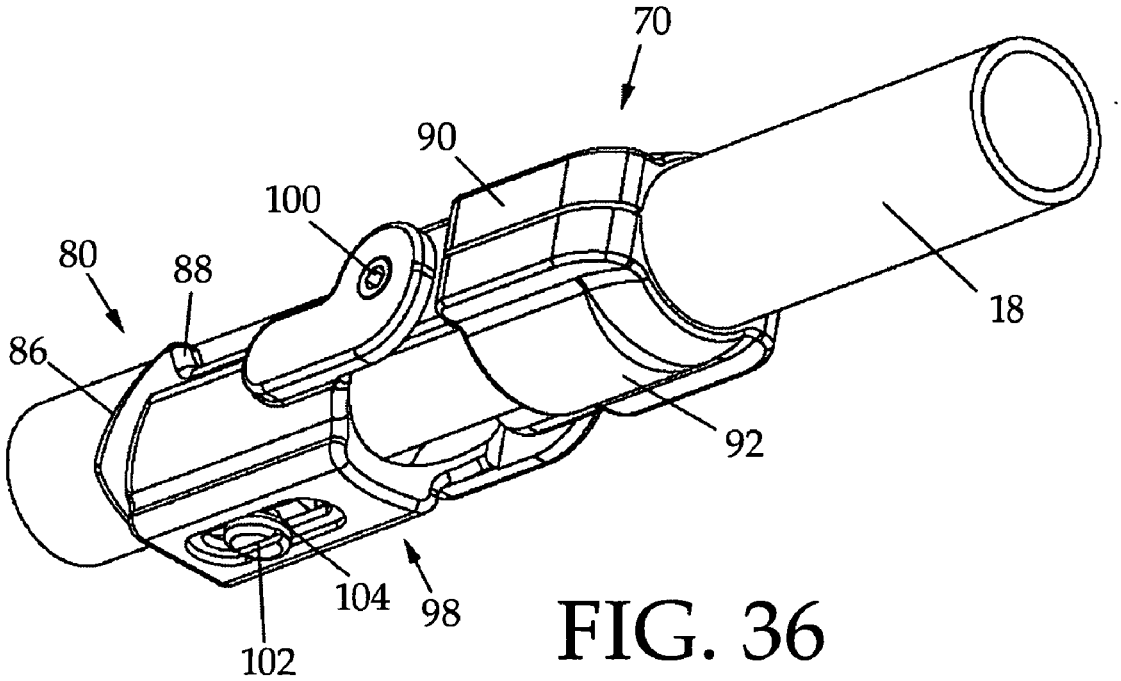
FIG. 36 is a perspective view of the front pole mounted base supporting the dual toothed curvature embodiment of the front pole coupling formation in its inactive position.
Figure 37:
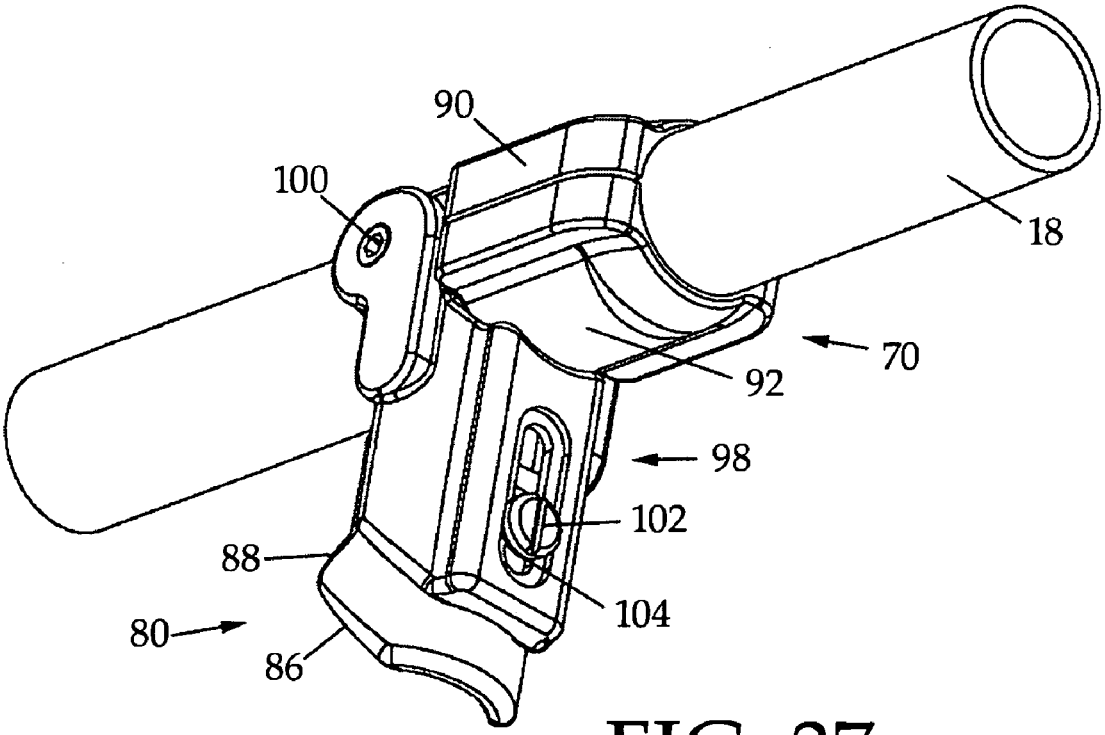
FIG. 37 is a perspective view of the front pole mounted base supporting the dual toothed curvature embodiment of the front pole coupling formation in its engaging position.

FIGS. 35, 36 and 37 show the operative parts of the front pole coupling means. A front pole mounted base 70, includes a top clamping piece 90, a bottom clamping piece 92 and an extension arm 98, and supports the front pole coupling formation 80. When the front pole coupling formation 80 is in its inactive position, it is kept clamped around the shaft 18 of the ski pole 12. The top clamping piece 90 is connected to the bottom clamping piece 92 by way of four tightening screws 40 or other suitable fastening and tightening means. This allows its use as a retrofit of existing poles. As stated previously, this configuration is by no means limiting. The clamping front pole mounted base 70 depicted in the figures to this patent are only illustrative of the various fastening means for the front pole coupling formation 80 or its parent coupling means. The front pole mounted base can be a single piece with a single tightening screw 94, an expanding plug mounted in a track cut into the shaft 18, a very small clamp fastened to a rail affixed to the shaft 18, and/or include a variety of other means to secure the front pole coupling formation 80 to the shaft 18 of the pole 12.

The extension arm 98 is pivotally attached to the bottom clamping piece 92 by a set screw 100, rivet, or other pivotal fastening means. The front pole coupling formation 80 is attached to the extension arm 98 by way of an adjustment screw 102 (or other fastening means), a lock washer 104 (or other slippage prevention means) and a hex nut 106 (or other fastening means if necessary). The front pole coupling formation 80 includes a dual toothed curvature and has securing surfaces 88 and positioning surfaces 86 along the lines of the bevels in each tooth. Its curvature allows it to snap around the shaft 18 when not in use, as shown in FIG. 36. The entire front pole mounted base 70, and its extension arm 98, can be made of aluminum, stainless steel, or a suitably rigid polymer, such as glass infused nylon. The dual toothed curvature of front pole coupling formation 80 is concave and made of a softer material, such as nylon, with sufficient durability to repeatedly engage the front ski coupling formation 82, sufficient elasticity to snap around the pole 12 in its non-active position, and sufficient softness to avoid scratching the binding. The extension arm 98 is configured such that its furthest pivot outward is perpendicular to the pole shaft 18, as shown in FIGS. 35 and 37.

Figure 38:
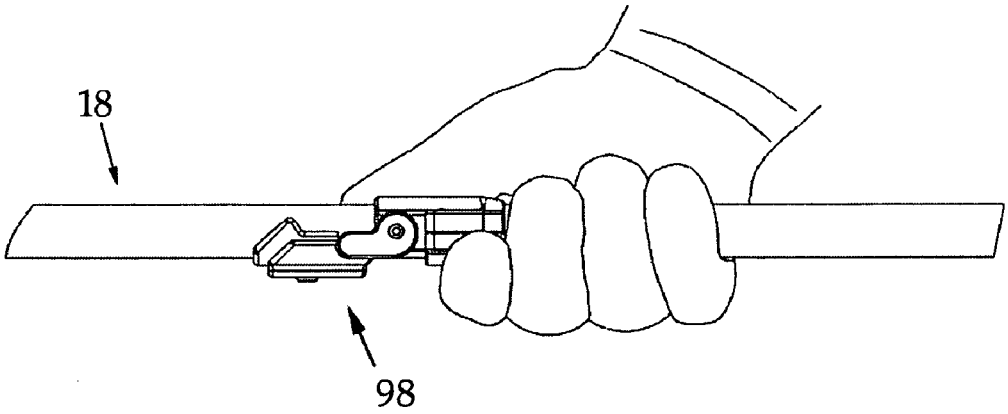
FIG. 38 is a view of a person's hand holding the pole in preparation for unfolding the arm of the front pole engagement means.
Figure 39:
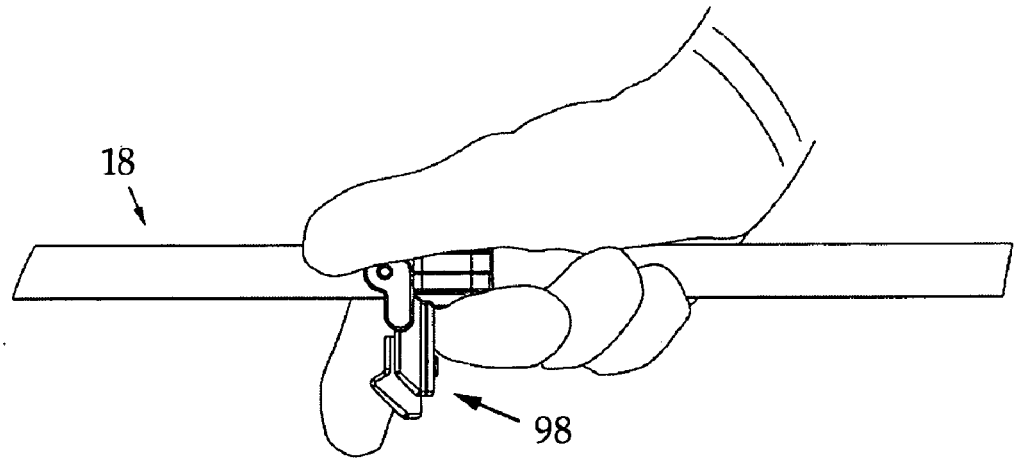
FIG. 39 is a view of a person's finger unfolding the arm of the front pole engagement means in preparation for coupling.
Figure 40:
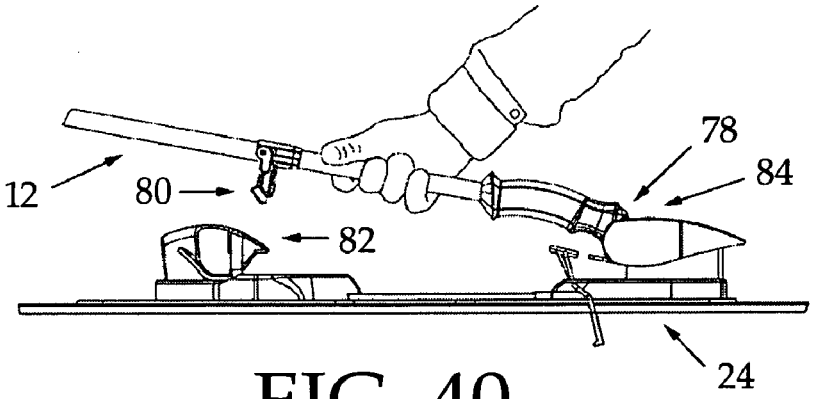
FIG. 40 is a view of a person's hand placing the rear pole engagements means in position on the rear ski engagement means in preparation for coupling.
Figure 41:
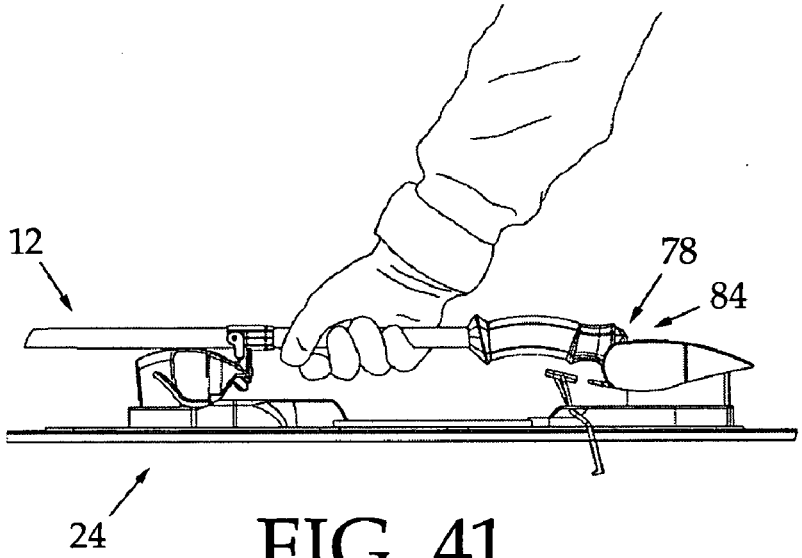
FIG. 41 is a view of a person's hand placing the front pole engagement means in position on the front ski engagement means and pressing down on the pole to begin coupling.
Figure 42:
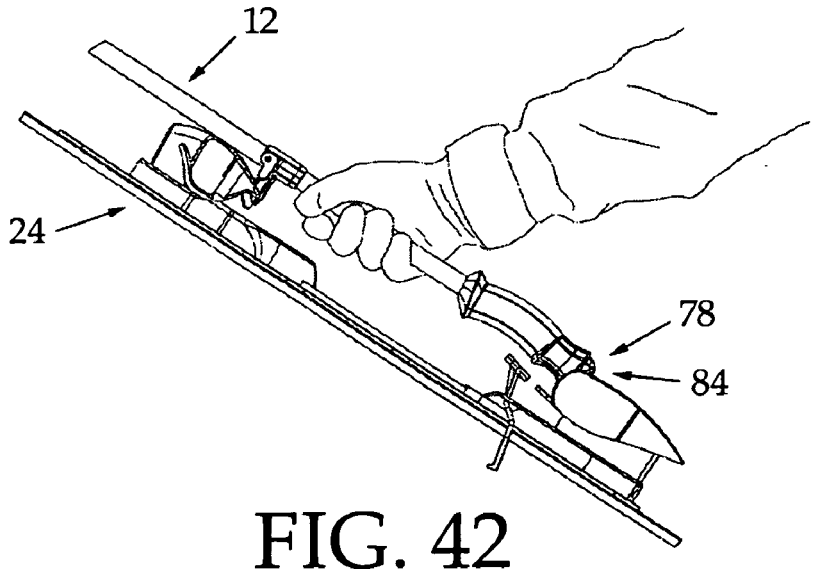
FIG. 42 is a view of a person's hand picking up the newly coupled pole-ski unit.

FIGS. 38 and 39 indicate how the skier prepares the front pole coupling formation 80 for engagement, using a finger to push the extension arm 98 downward. FIGS. 40, 41, and 42 illustrate how the coupling of this embodiment is achieved. First, the rear pole coupling formation 78 (here a "canted seat") is positioned against and under the rear ski coupling formation 84 (on the heel piece release lever 60) as shown in FIG. 40. Next, a downward force is applied. Upon application of downward force, the surfaces are engaged in the same manner as the previous embodiments. Positioning surfaces 86 of the front pole coupling formation 80 (here the bottom bevels of each tooth) will contact and slide down a positioning surface 86 (here the toe guiding bevel 44) of the front ski coupling formation 82 on the toe securing abutment 40, with the resulting movement urging the entire ski pole 12, the heel piece 54, and the heel piece release lever 60 rearward. This engages the spring action of the rear binding 52, creating a tight coupling as shown in FIG. 41. Next, as shown in FIG. 42, the skier simply picks up the newly form pole-ski unit. The entire process takes only a few seconds. Disengagement is the same as in the previous embodiment and again may be accomplished in a few seconds.

Figure 43:
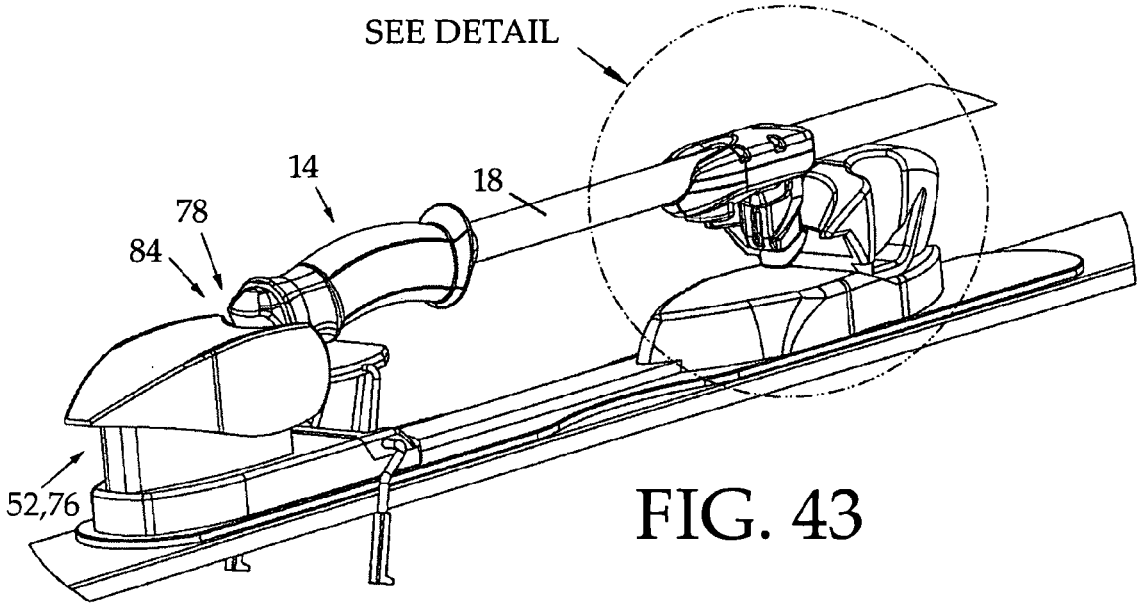
FIG. 43 is a perspective view of an engaged coupling performed by the canted seat embodiment of the rear pole coupling formation paired with the automatic released dual toothed curvature embodiment of the front pole coupling formation.
Figure 44:
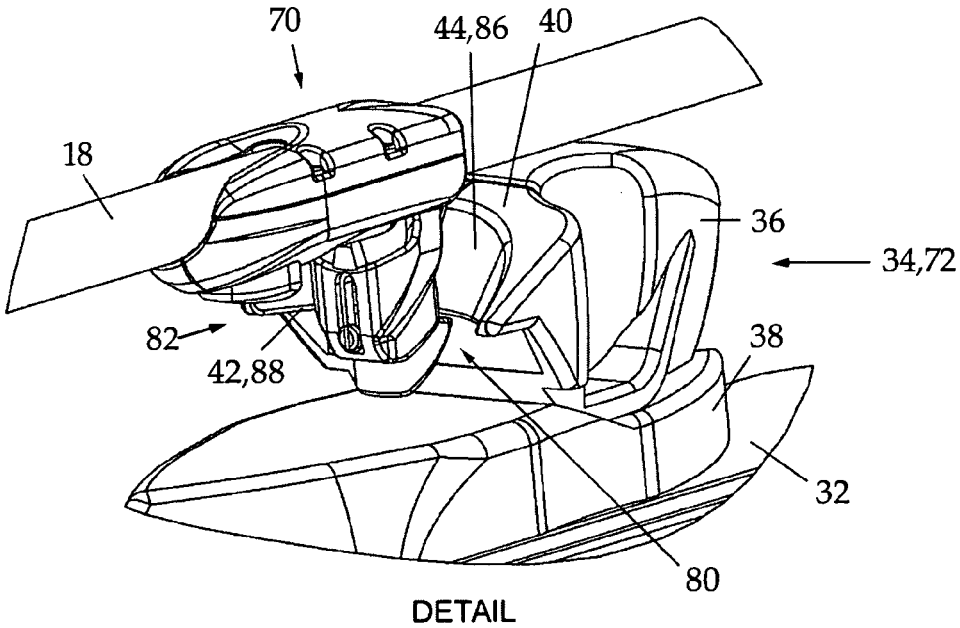
FIG. 44 is a perspective detail view of an engaged coupling performed by the automatic released dual toothed curvature embodiment of the front pole coupling formation.

Another current embodiment operates substantially the same as the previous embodiment in that its front and rear ski based coupling means are formed by most standard binding groups, as evidenced in FIGS. 7, 8, 9, and 10. As shown in FIG. 43, its rear pole coupling means are identical to the previous two embodiments, embracing the "canted seat" concept. FIG. 44 demonstrates that its front pole coupling means engage the front ski coupling means in a manner identical to the previous embodiment. The front binding 34 forms the front ski mounted base 72. Also shown are the toe piece 36 and the toe piece platform 38. FIG. 44 also shows the toe securing abutment 40, whose toe guiding bevel 44 and toe securing lip 42 perform the respective roles of positioning surface 86, and securing surface 88, forming the key components of the front ski coupling formation 82.

Figure 45:
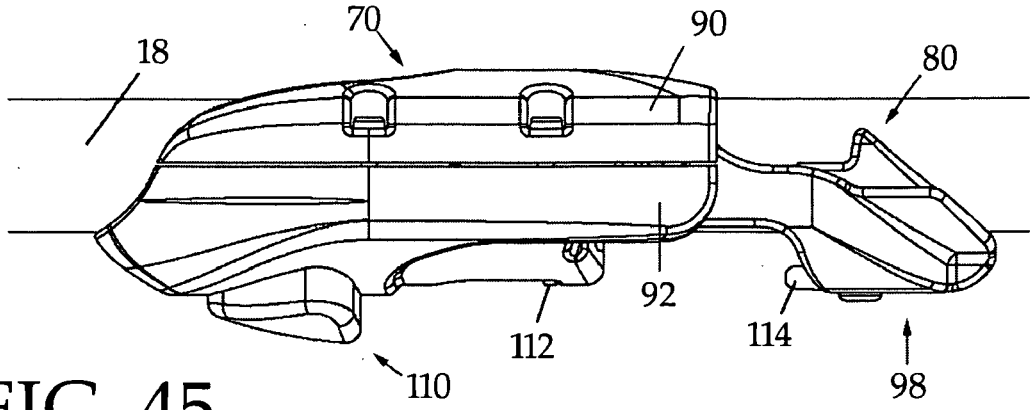
FIG. 45 is a side view of the front pole mounted base supporting the automatic released dual toothed curvature embodiment of the front pole coupling formation in its inactive position.

The key difference with this embodiment is that its front pole based coupling means has an automatic release feature. FIG. 45 discloses a front pole coupling means which includes many of the same features as the previous embodiment. Included is a front pole mounted base 70, clamped onto the shaft 18 of the pole. The front pole mounted base 70 is slightly more complex and includes a top clamping piece 90, a bottom clamping piece 92, and a previously absent center clamping piece 108 (shown only in FIGS. 48 and 49). Pivotally attached to the center clamping piece 108, is an extension arm 98, which houses a similar front pole coupling formation 80. As in previous embodiments, the front pole coupling formation 80 includes a dual toothed curvature with positioning surfaces 86 and securing surfaces 88 (shown only in FIGS. 45 and 46). In this embodiment the securing surface 88 which forms the top of each tooth is slanted at a much shallower angle than in previous embodiments. This helps prevent inadvertent release. This feature, along with the automatic release, makes this universal embodiment very advantageous.

Figure 46:
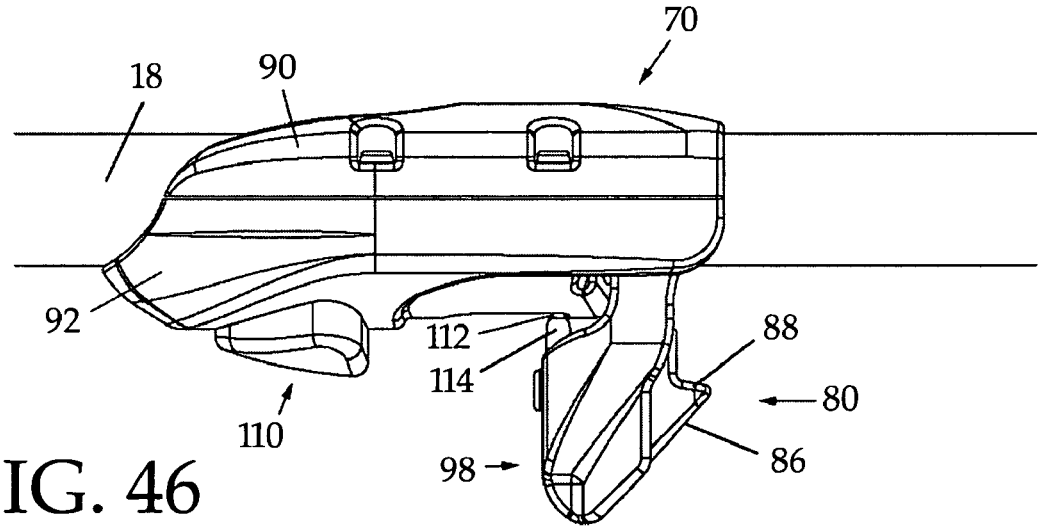
FIG. 46 is a side view of the front pole mounted base supporting the automatic release dual toothed curvature embodiment of the front pole coupling formation in its engaging position.
Figure 47:
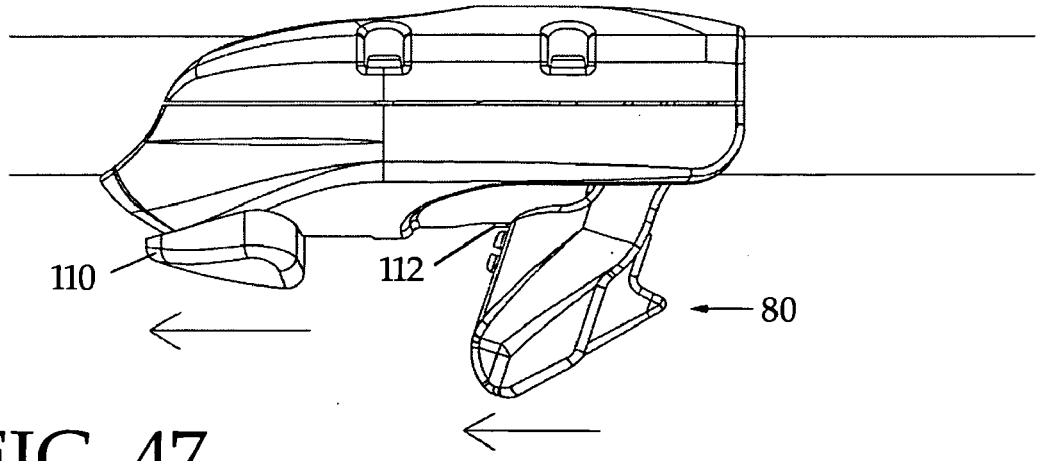
FIG. 47 is a side view of the front pole mounted base supporting the automatic release dual toothed curvature embodiment of the front pole coupling formation in its released position.
Figure 48:
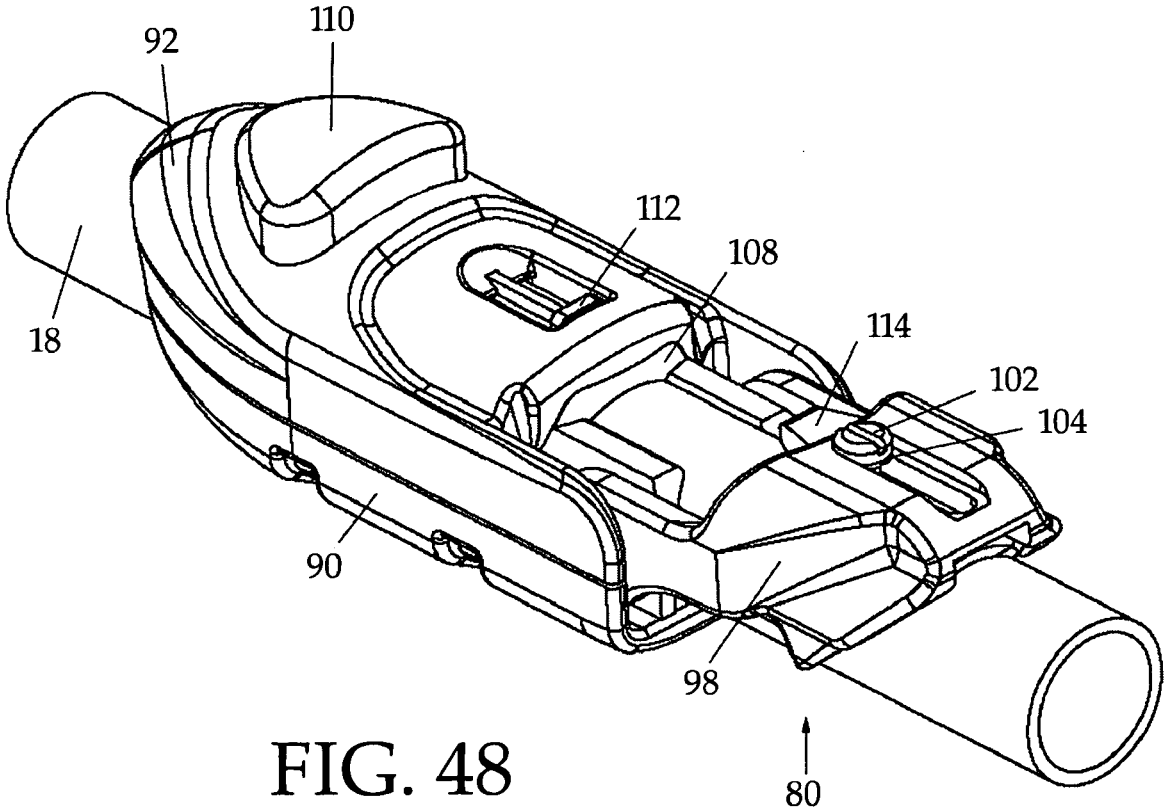
FIG. 48 is a perspective view of the bottom of the front pole mounted base supporting the automatic released dual toothed curvature embodiment of the front pole coupling formation in its inactive position.

In this embodiment, the automatic release is accomplished by a simple means. FIG. 48 shows the front pole mounted base 70 upside-down. It most accurately shows that a release lever 110 connects to a small extension arm platform 112 and the extension arm 98 exhibits an extension arm leg 114. As shown in FIG. 46, the extension arm platform 112 supports the extension arm leg 114 when the extension arm 98 is in its operative position perpendicular to the pole shaft 18. The support provided by the extension arm platform 112 in this position holds the extension arm in place at the perpendicular angle so that the front pole coupling formation 80 may engage the front ski coupling formation 82. FIG. 47 shows the action of the release. As soon as the skier pulls back on the release lever 110 (conveniently done with one finger while holding the ski-pole unit) the extension arm platform 112 is also pulled back. As the arrows in FIG. 47 show this removes the support to the extension arm leg 114. As a consequence, the weight of the ski as exerted on the securing surface 88 of the front pole coupling formation 80, urges the extension arm 98 backward, as the extension arm leg 114 fills the space previously occupied by the extension arm platform 112. The ski 24 conveniently falls to the snow, base 30 down, ready for the skier to step in.

Figure 49:
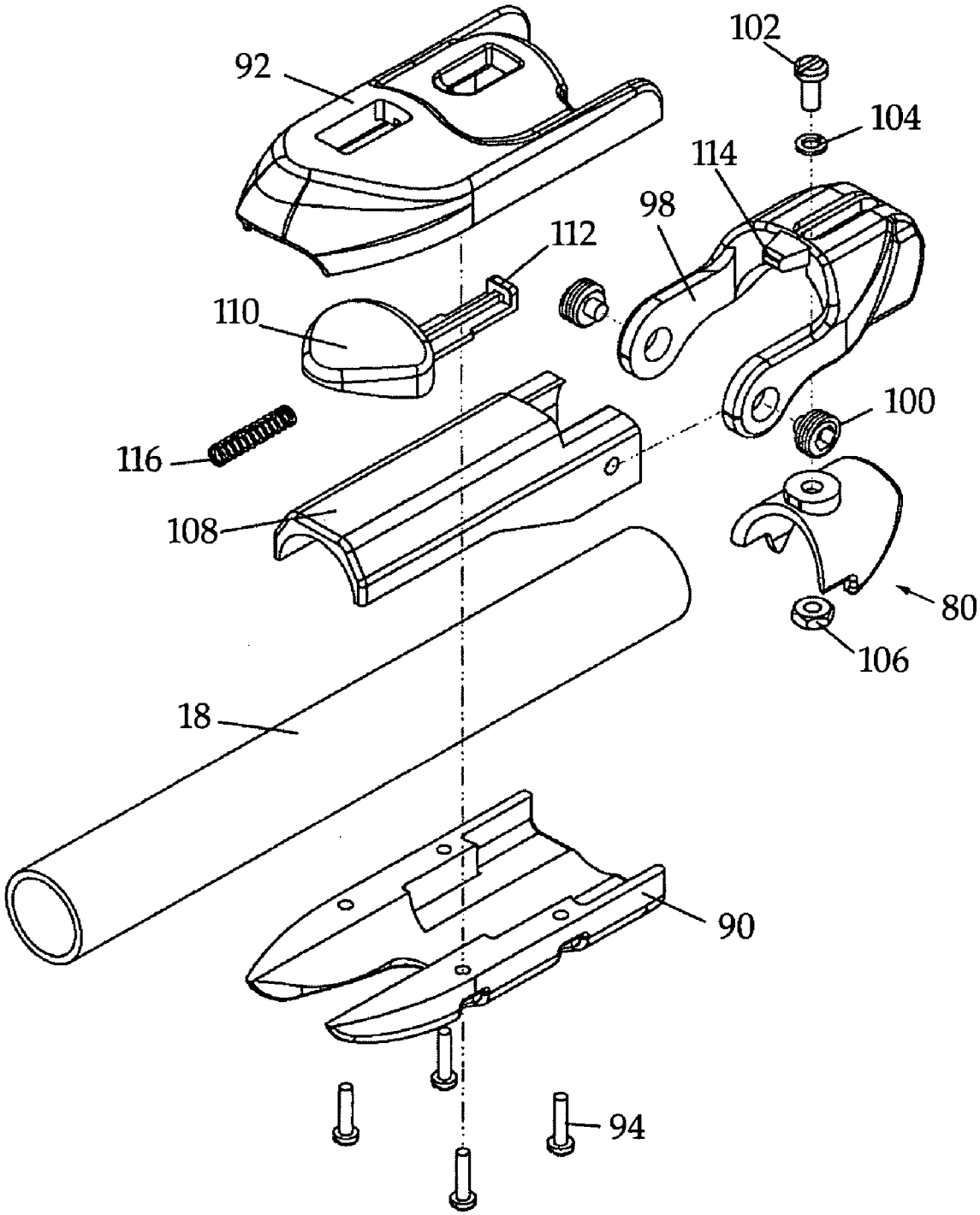
FIG. 49 is an exploded view of the automatic released dual toothed curvature embodiment of the front pole mounted base and the front pole coupling formation.

FIG. 49 is an upside-down exploded view of the various parts of the front pole coupling means of this particular embodiment. Set screws 100, rivets, or other pivotally fastening means hold the extension arm 98 pivotally to the center clamping piece 108, while the dual toothed curvature included in the front pole coupling formation 80 is held to the extension arm 98 by an adjustment screw 102 (or other suitable adjusting means), a lock washer 104 (or other suitable locking means), and a hex nut 106 (or other suitable fastening means). The release lever 110 and its attached extension arm platform 112 are slid into and behind the bottom clamping piece 92 (from outside to inside, extension arm platform 112 first). The biasing means for the release lever (not shown in previous figures) is a spring 116. In this example, the spring 116 is inside the front pole mounted base, which is held between the bottom clamping piece 92 and the center clamping piece 108. The spring 116 is situated behind the release lever 110, holding it and the extension arm platform 112 in their biased position until the release lever is pulled back by the skier's finger. The spring 116 also returns the release lever 110 and the extension arm platform 112 to such biased position immediately after pull back. The main assembly is held together by tightening screws 94 (or other suitable fastening and tightening means).

Another current embodiment also features an automatic release means. It is smaller than the previous embodiment, but sacrifices universality, as it requires a custom front ski coupling formation 82. Its reduced size makes it highly advantageous. On this embodiment, the rear coupling means are identical to the previous embodiment, using the "canted seat" version of the rear pole coupling formation 78 to engage a standard heel piece release lever 60 serving as the rear ski coupling formation 84. This is demonstrated by FIGS. 21-25.

Figure 50:
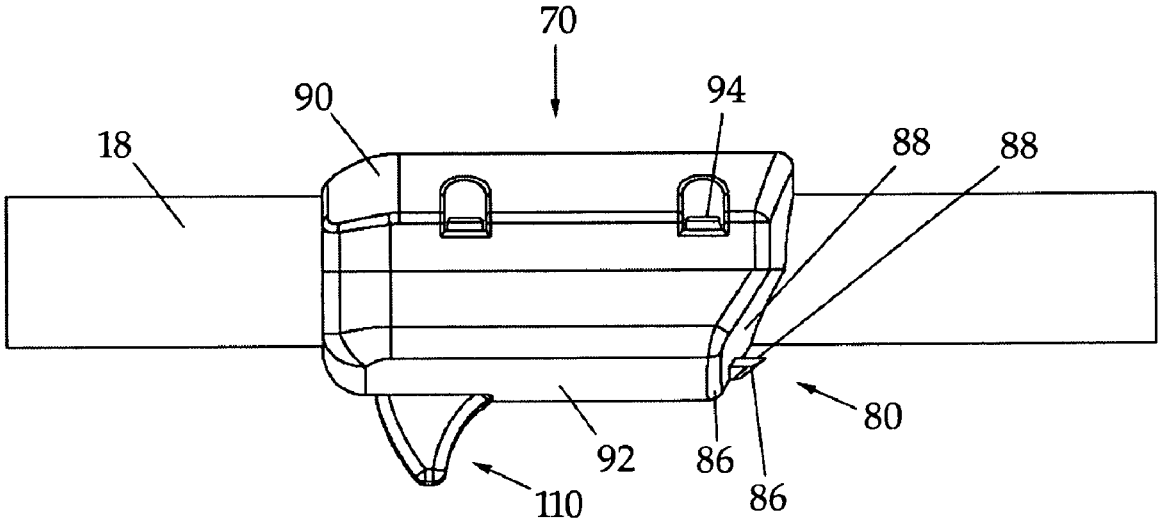
FIG. 50 is a side view of the front pole mounted base supporting the beveled bolt version of the front pole coupling formation.
Figure 51:
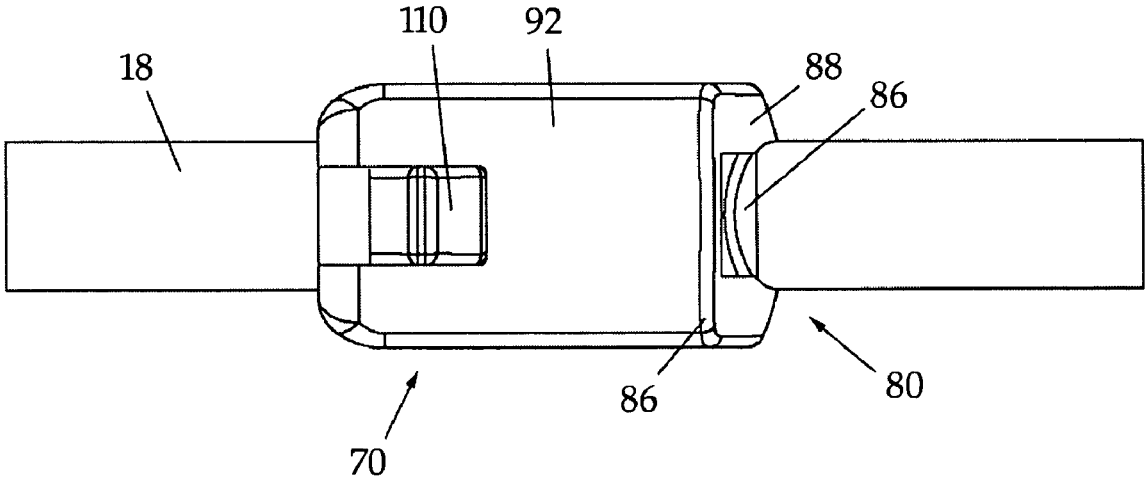
FIG. 51 is a bottom view of the front pole mounted base supporting the beveled bolt version of the front pole coupling formation.

The front coupling means are different. Although requiring modification, this embodiment can be incorporated into a shrouded binding easily, providing a manufacturing advantage. Its front pole coupling means are shown in FIGS. 50 and 51. Shown there is a front pole mounted base 70 clamped to the pole shaft 18, its top clamping piece 90 and bottom clamping piece 92 held tight by fastening means such as tightening screws 94. As stated earlier, the front pole mounted base could be a single piece or multiple pieces and could be incorporated into the surface of the pole or attached to it by a variety of means. The key to this embodiment is the front pole coupling formation 80, whose positioning surfaces 86 and securing surfaces 88 in part define a beveled bolt. Similar to the elongated node and beveled tooth embodiments, the lower front portion of the front pole mounted base 70 also serves as part of the front pole coupling formation 80 by providing an abutment which serves as a securing surface 88 to keep the entire arrangement snug, urging the rear pole coupling formation 78 into the rear ski coupling formation 84. The beveled bolt portion of the front pole coupling formation 80 is retractable (back, into and behind the surface of the abutment). It is formed from the front end of the release lever 110 which (as in the previous embodiment) is held in position by a biasing means such as a spring (not shown). Its edges can be rounded to prevent snagging.

Figure 52:
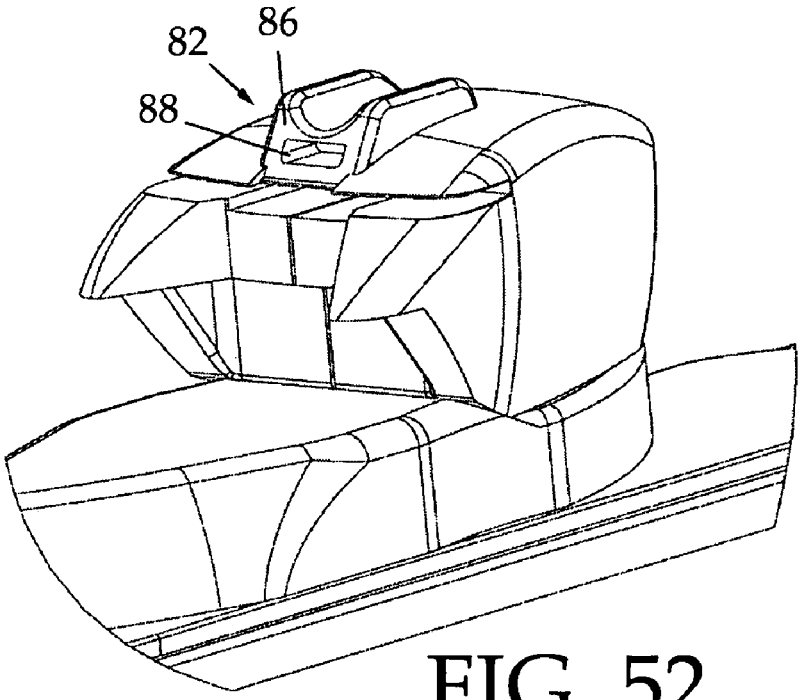
FIG. 52 is a perspective view of the front binding serving as a front ski mounted base for the slot version of the front ski coupling formation.
Figure 53:
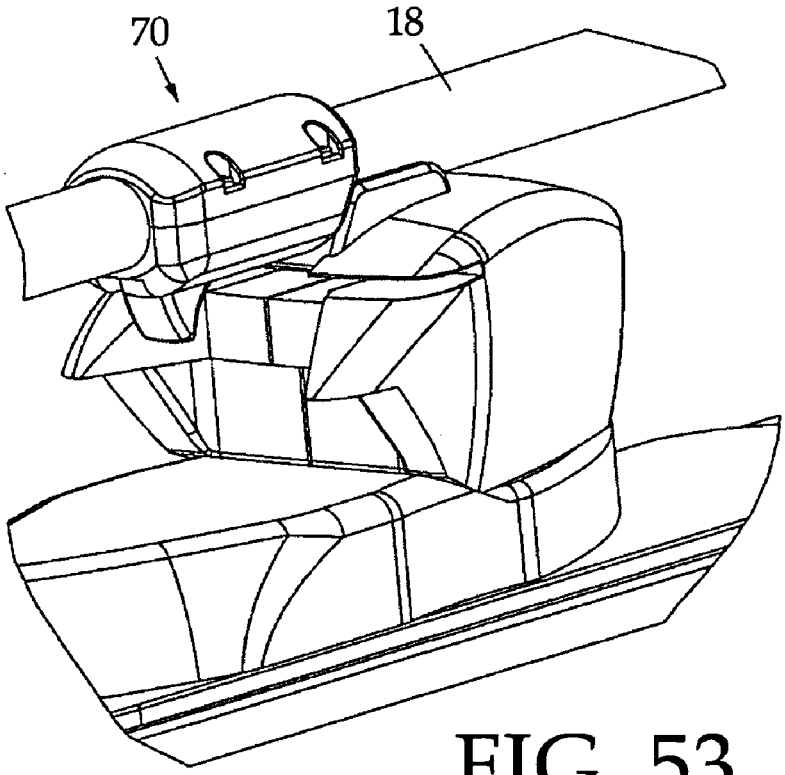
FIG. 53 is a perspective view of the front binding serving as a front ski mounted base for the slot version of the front ski coupling formation coupled with the front pole mounted base supporting the beveled bolt version of the front pole coupling formation.
Figure 54:
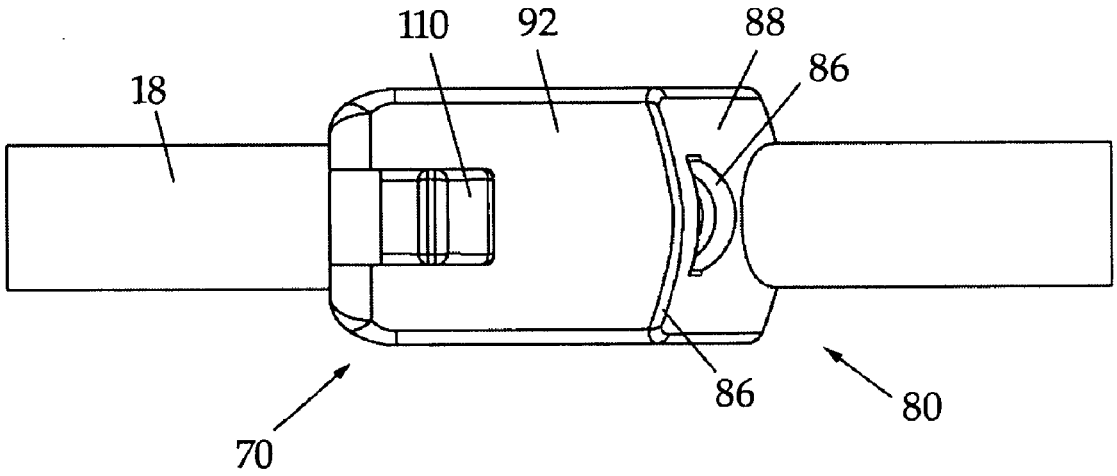
FIG. 54 is a bottom view of the front pole mounted base supporting the rounded beveled bolt version of the front pole coupling formation.
Figure 55:
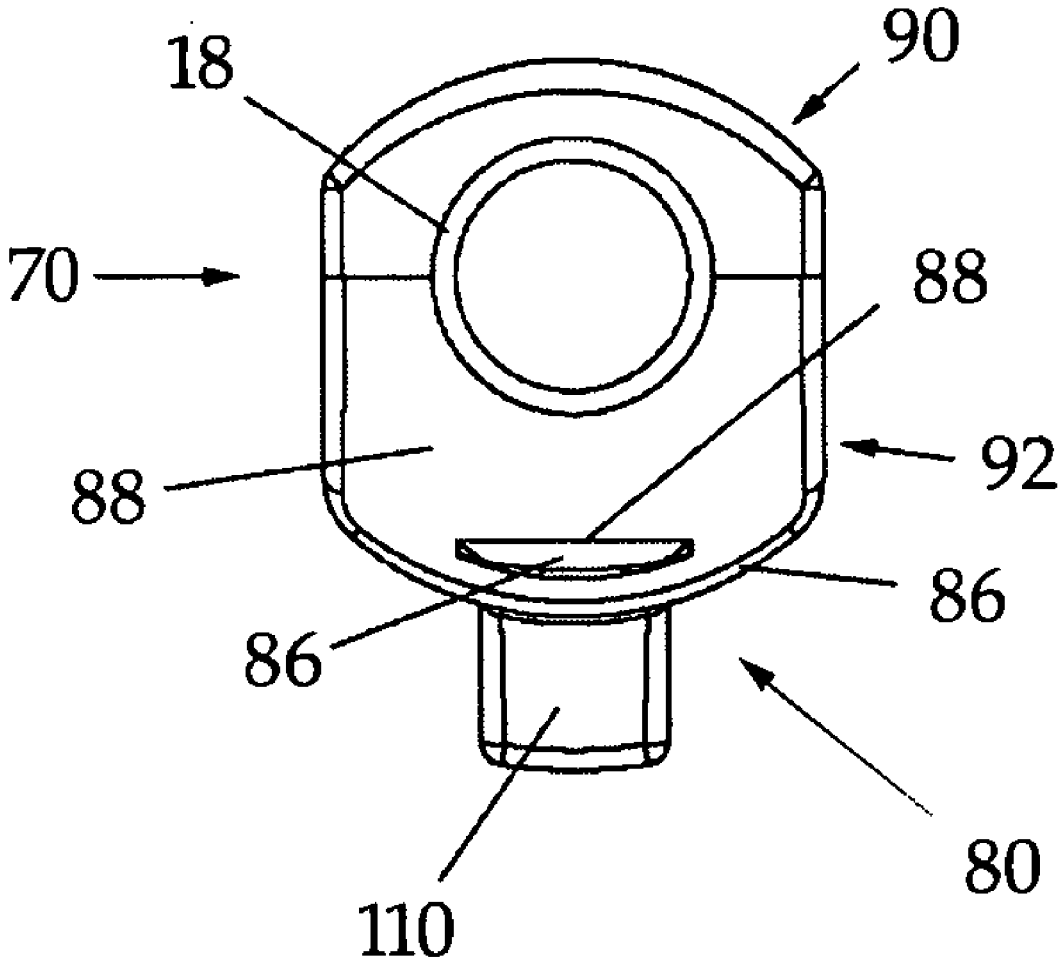
FIG. 55 is a front view of the front pole mounted base supporting the rounded beveled bolt version of the front pole coupling formation.
Figure 56:
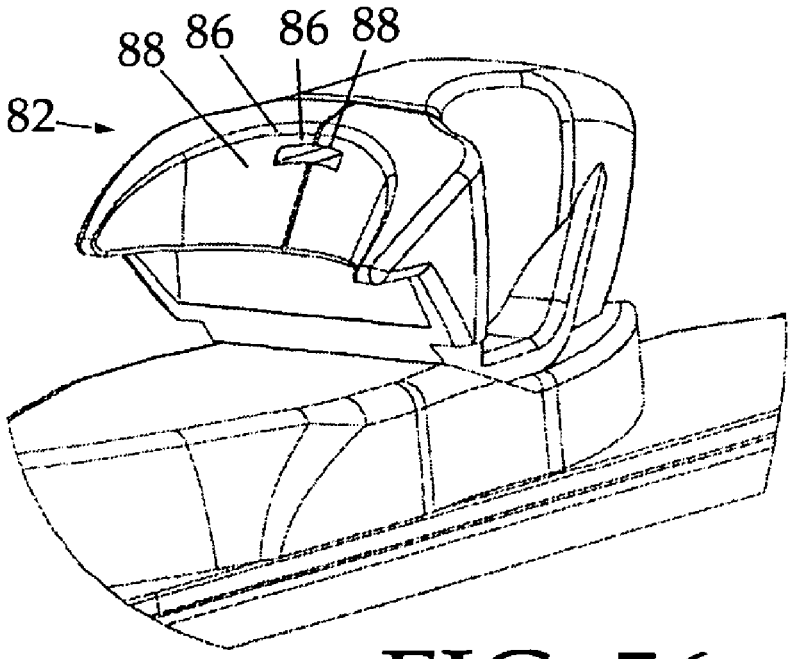
FIG. 56 is a perspective view of the front binding serving as a front ski mounted base for the rounded slot version of the front ski coupling formation.
Figure 57:
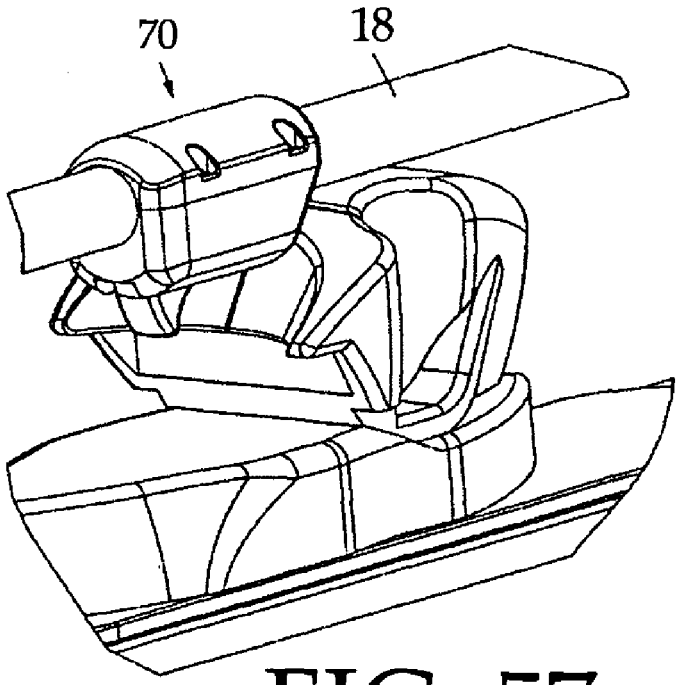
FIG. 57 is a perspective view of the front binding serving as a front ski mounted base for the rounded slot version of the front ski coupling formation coupled with the front pole mounted base supporting the rounded beveled bolt version of the front pole coupling formation.

Engagement is simple and easy. After the rear pole coupling formations are placed together, the front pole coupling formation 80 is pushed downward toward the front ski coupling formation 82 (shown in FIG. 52). Then a positioning surface 86 (the bevel) on the bolt portion of the front pole coupling formation 80, first contacts a positioning surface 86 (a striker) directly above a securing surface 88 (a slot) on the front ski coupling formation 82. Upon the continued application of downward force, the bolt portion of the front ski coupling formation 82 is urged rearward against the bias. Consequently, the release lever 110 moves with it. Upon the continued application of downward force, the front portion of the front pole mounted base 70 contacts and continues to slide down the striker (a positioning surface 86) of the front ski coupling formation 82. This motion urges the rear pole coupling formation 78 into the rear ski coupling formation 84, creating a snug fit. This downward motion continues until the securing surface 88 which forms the top portion of the bolt reaches the securing surface 88 which forms the top portion of the slot. At that moment, the bolt is urged forward by the biasing means, and its securing surfaces 88 slide into the slot and are consequently surrounded by the securing surfaces 88 making up slot. This upward and side-to-side securement, combined with the front-to-back and downward securement provided by the other securing surfaces creating a firm coupling as shown in FIG. 53. Release of the coupling is performed by using one finger to pull back on the release lever, removing the securing surfaces 88 of the bolt portion of the front pole coupling formation 80 from under the securing surfaces 88 of the slot portion of the front ski coupling formation 82. This causes the positioning surfaces 86 of the front pole coupling formation 80 and the front ski coupling formation 82 to slide against one another and separate. This loosens the entire coupling arrangement and the ski falls to the snow, the floor, or into the skier's hand.

FIGS. 54, 55, 56 and 57 show how merely changing the shape of the previous embodiment creates an only slightly different embodiment which is readily incorporated into a standard beveled binding. This is accomplished by altering only the curvature of some of the securing surfaces 88 and some of the positioning surfaces 86 of the front pole coupling formation 80 and the front ski coupling formation 82. This embodiment features a rounded beveled bolt, a rounded striker and rounded slot. This embodiment is also highly advantageous because of its small size and quick release. This embodiment is engaged and released in a manner identical to that of the previous embodiment.

Figure 58:
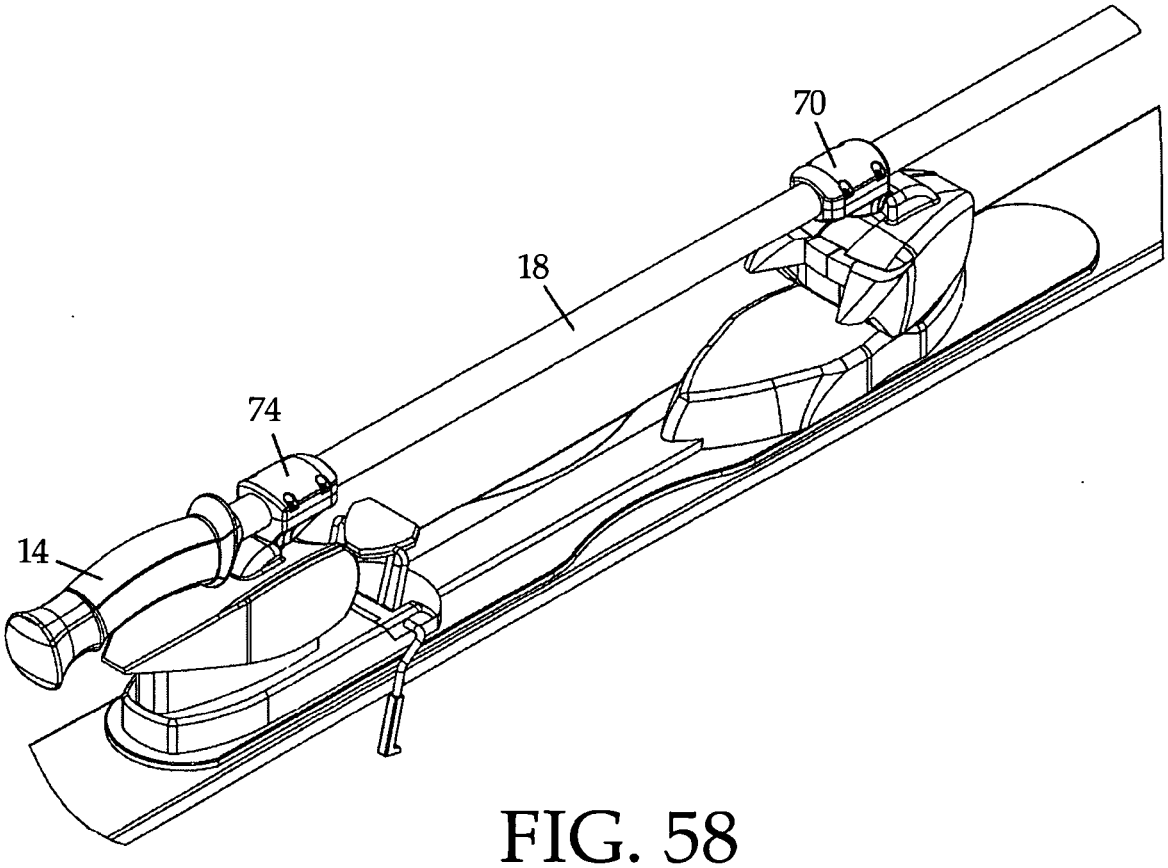
FIG. 58 is a view of a coupling arrangement using dual pole mounted bases for pole coupling surfaces and using the bindings as the bases for the ski coupling surfaces.

Many alternate embodiments of the invention can be constructed. FIG. 58 shows how the rear pole coupling means could take the form of a rear pole mounted base 74 which actually clamps to the pole 12 next to the grip 14, rather than being incorporated into or mounted on the grip 14. This embodiment could form a retrofit of poles without modification.

It may also be possible to configure the rear pole mounted base 74 as shown in FIG. 58 with a rear pole coupling formation 78 in the form of a canted seat or other universal coupling means. Combining such rear coupling means with the front pole coupling formations 80 from the previous embodiments could form a combination that does not require the modification of the pole or the bindings, resulting in an embodiment that serves as a universal retrofit kit.

Figure 59:
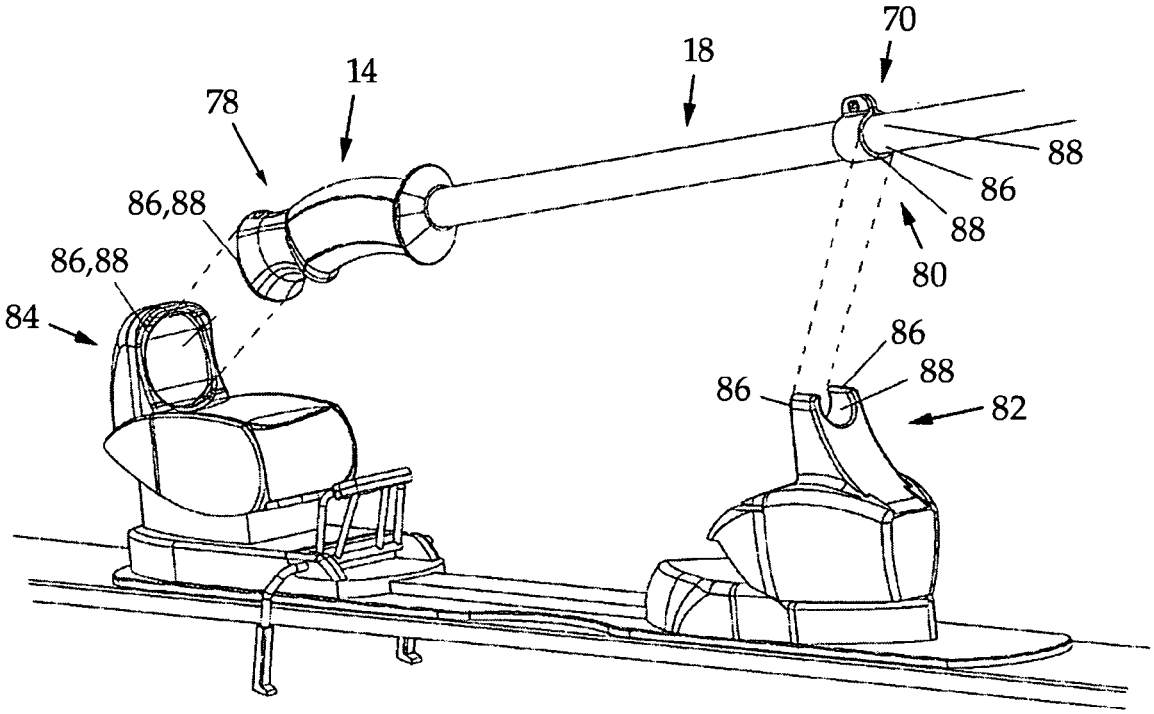
FIG. 59 is a perspective view of a front ski binding servings as a front ski mounted base for the clamp version of the front ski coupling formation, a rear binding serving as the rear ski mounted base for the cup version of the rear ski coupling formation, a pole shaft and collar serving as the front pole coupling formation and its pole mounted base, and a typical grip forming the rear pole mounted base supporting rear pole coupling formation which includes the top of the typical grip.

Another embodiment avoids the modification of the pole. FIG. 59 shows how by altering the shape of the positioning surfaces 86 and securing surfaces 88 of the rear ski coupling formation 84 to form a cup, one can avoid the modification of the pole handle, which itself becomes the rear pole coupling formation 78 with its rounded positioning surfaces 86 and securing surfaces 88. Similarly, as with all previous embodiments, modification of the pole shaft may be avoided by the use of a front pole mounted base 70. Here, the front pole mounted base 70 is a simple collar, the front edge of which combines with the surface of the pole shaft 18 to form the necessary positioning surfaces 86 and securing surfaces 88 of the front pole coupling formation 80.

In this embodiment, the front ski coupling formation 82 is in the form of a clamp, the positioning surfaces 86 of which help center the pole. To engage, the skier first places the pole handle 2 into the cup, then after a downward force is applied to the shaft of the pole near the front pole coupling means, the pole is snapped into place. The securing surfaces 88 of the clamp hold the shaft 18 down, and, in combination with the front edge of the collar, keep the pole 12 from sliding forward and out of the cup. The clamp may be made of a material which provides the requisite flexion of the securing and positioning surfaces, such as nylon, or other tensile polymer. A sharp pull in the reverse direction disengages. As with all embodiments, the four coupling formations can be incorporated into or mounted upon separate ski mounted bases or can incorporated into or mounted on the bindings (shown in FIG. 59) which can perform as ski mounted bases.

Figure 60:
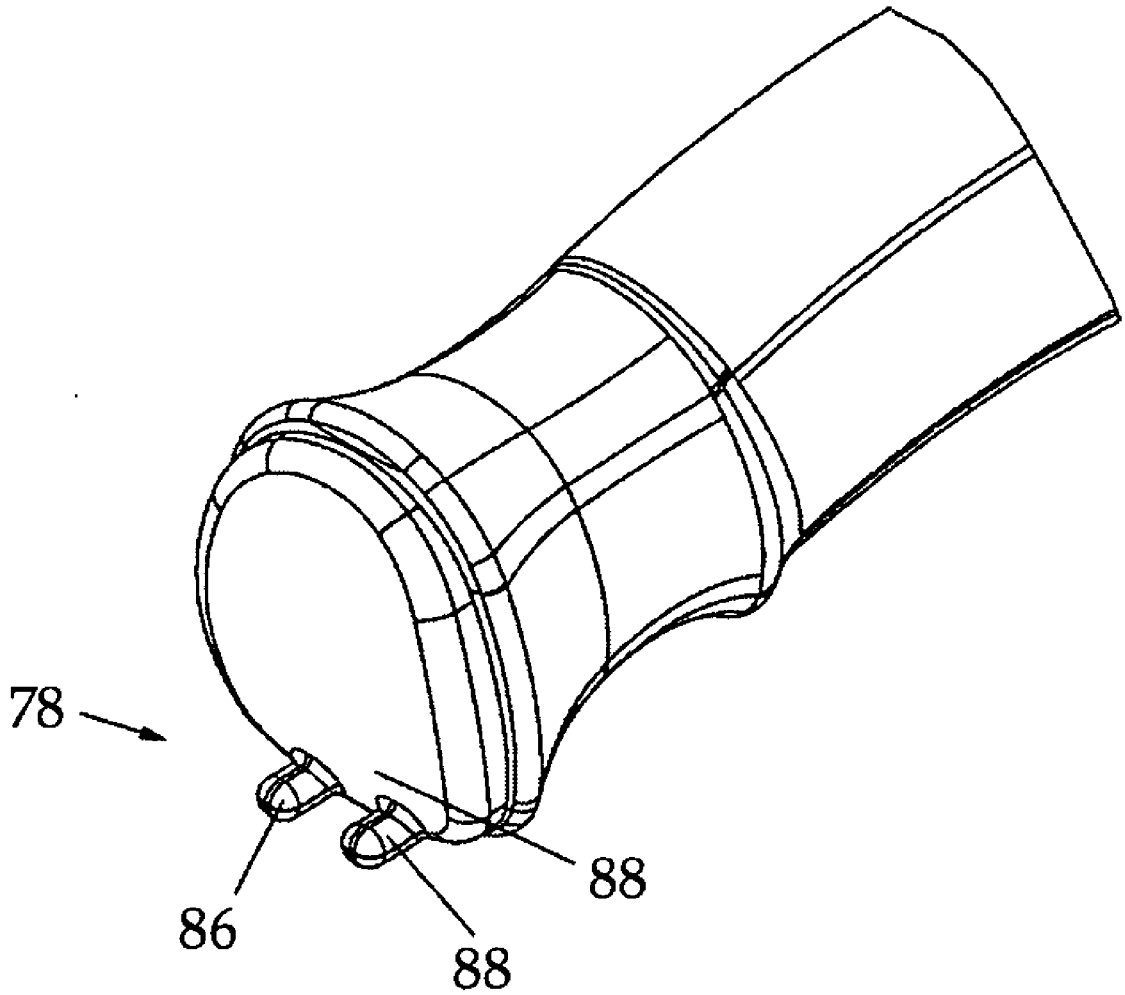
FIG. 60 is a perspective view of the ski grip supporting a rear pole mounted base supporting the dual node version of the rear pole coupling formation.
Figure 61:
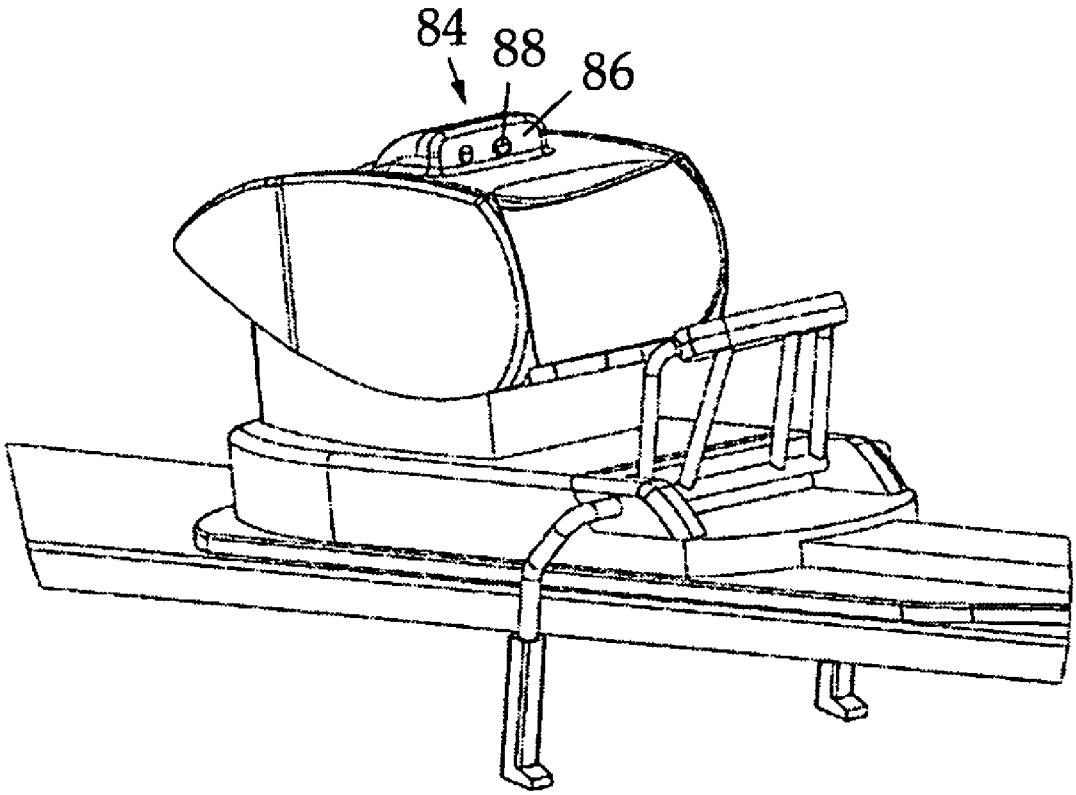
FIG. 61 is a perspective view of the rear ski binding serving as a rear pole mounted base supporting the dual node version of the rear pole coupling formation.

FIGS. 60, 61, 62, and 63 show an embodiment which illustrates how the number, size, shape and orientation of the positioning surfaces 86 and securing surfaces 88 can differ. As shown in FIGS. 60 and 61, two points of securement are supplied by connecting two nodes (that perform the role of the rear pole coupling formation 78, its positioning surfaces 86, and securing surfaces 88) with two cavities (that perform the role of the rear ski coupling formation 84, and its positioning surfaces 86 and securing surfaces 88). Though the nodes and cavities are small, the distance between them creates the necessary stability, substituting for the width of a single surface as utilized by previous embodiments. In this embodiment, the rear coupling formations are placed together and the front pole coupling formation 80 is pressed down into the front ski coupling formation 82.

Figure 62:
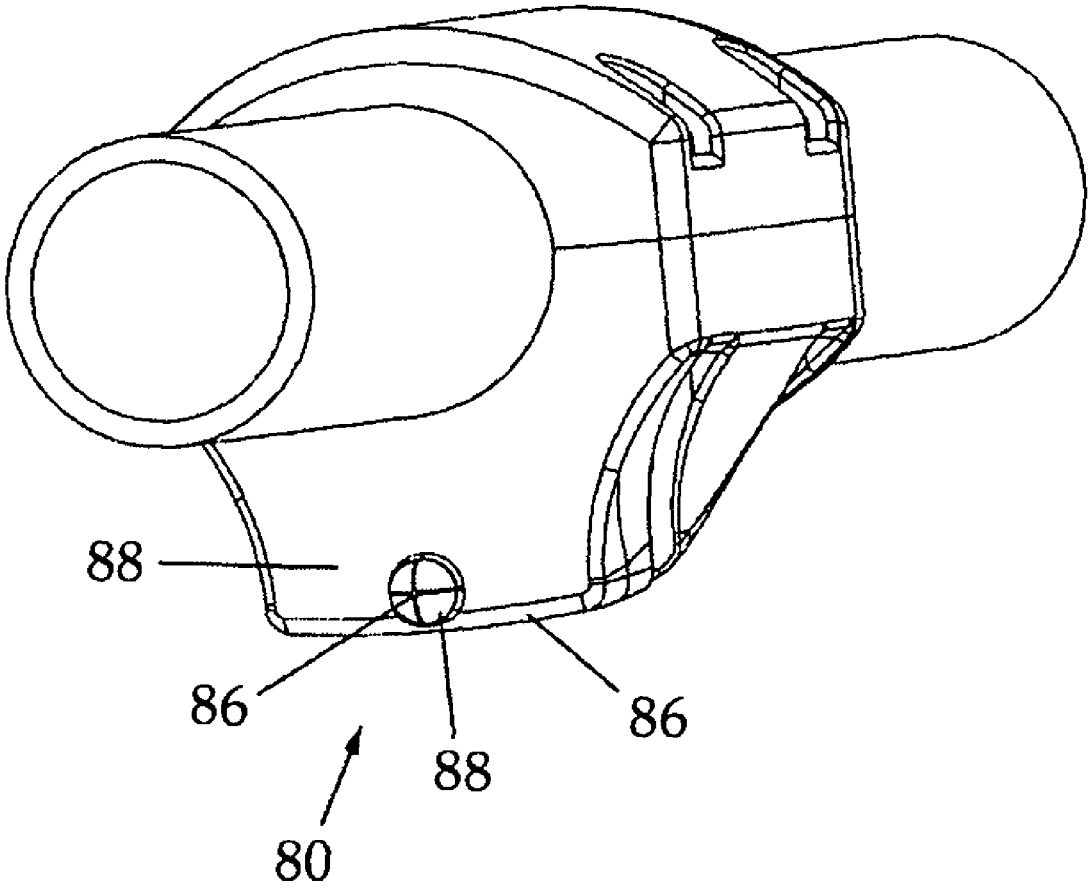
FIG. 62 is a perspective view of the front pole mounted base serving to support the front pole coupling formation which is includes a single node.
Figure 63:
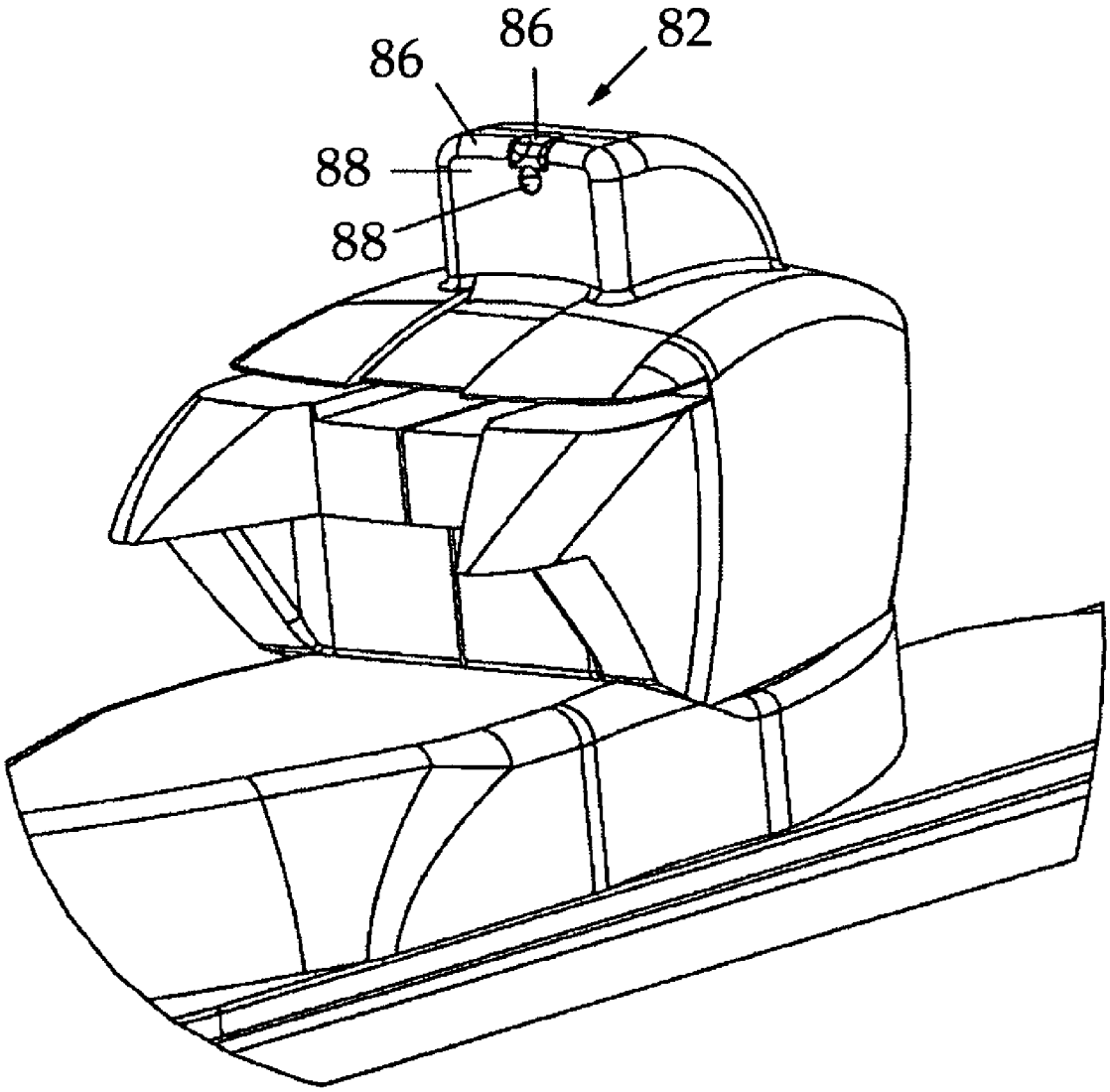
FIG. 63 is a perspective view of the front binding serving as a front pole mounted base supporting the front pole coupling means which is embodied by a single cavity and single striker.

As shown in FIG. 62, a single node can perform the role of the front pole coupling formation 80, its positioning surfaces 86, and securing surfaces 88. As shown in FIG. 63, a single cavity and a striker can perform the role of the securing surface 88 and positioning surface 86 of front ski coupling formation 82. After placing the rear pole coupling formation 78 into the rear ski coupling formation 84, the skier again presses down on the front pole coupling formation 80. The node slides down the striker, urging the pole and the rear pole coupling formation 78 rearward into the rear ski coupling formation 84. The node then snaps into the cavity creating a firm coupling as in previous embodiments.

Each node-cavity combination provides only a single practical point of securement. However, in the combination shown, they work together to control all modes of directional and rotational motion of the ski-pole unit. This is because at least 3 points of connection between the securing surfaces 88 of the pole coupling formations and the securing surfaces 88 of the ski coupling formations are all that is theoretically required. This trinity provides the necessary support, stability, and guidance for the coupling.

The three points of securement created by the front and rear coupling formations could be reoriented to place two in the front and one in the rear or two on one side and one on the other side. This embodiment is demonstrative of the wide array of possible permutations of the securing surfaces 88 and positioning surfaces 86 of the coupling formations, so long as their size, orientation, number and shape are sufficient to create a rigid coupling.

In order to maintain the coupling, all of the previously describe embodiments utilize forces which push the front pole coupling formation toward the rear of the ski and opposite forces which push the rear pole coupling formation toward the front of the ski. These forces result in a compression exerted on the linear dimension of the pole shaft between the two coupling formations. Pole compression is not the only way to achieve the pole-to-ski quick coupling arrangement.

Figure 64:
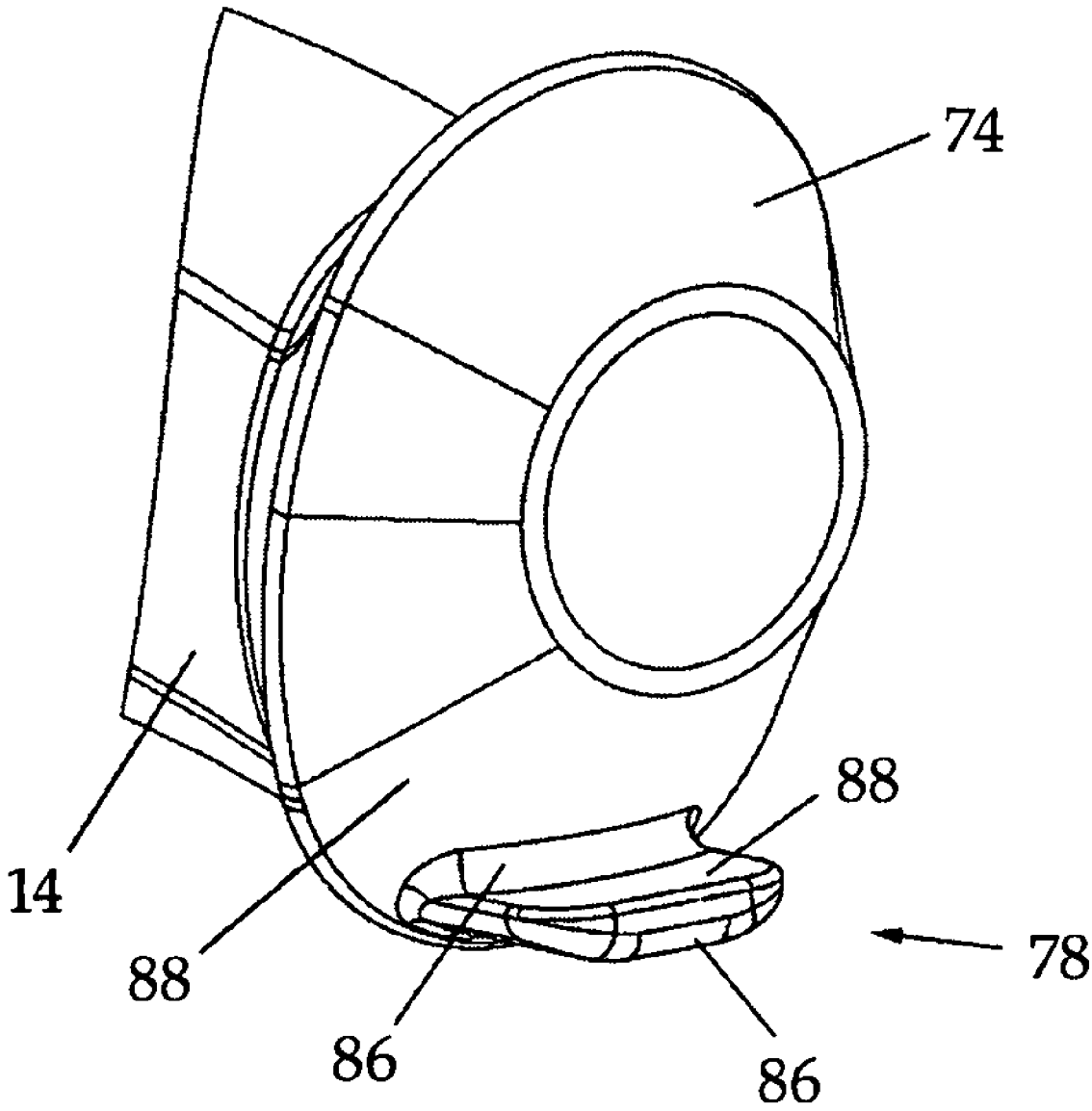
FIG. 64 is a perspective view of the bottom portion of a ski pole grip serving as a rear pole mounted base for a rear pole coupling formation which includes a tongue.
Figure 65:
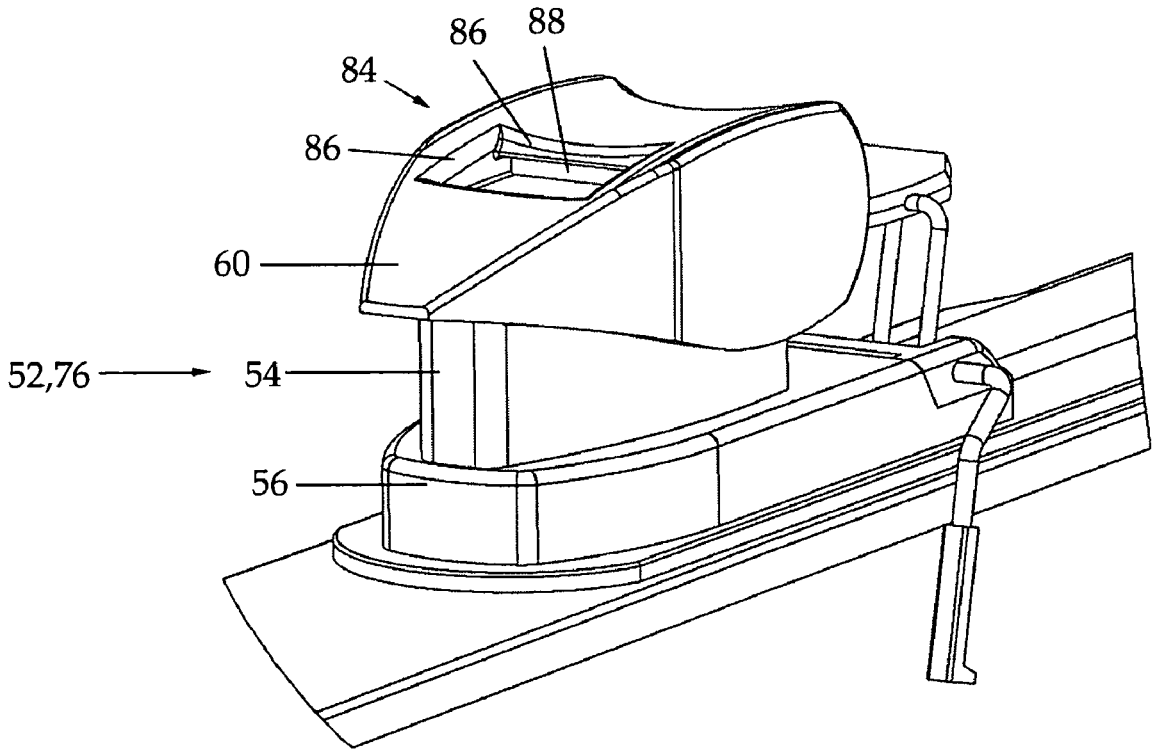
FIG. 65 is a perspective view of a rear binding serving as a rear ski mounted base for a recess and lip included in the rear ski coupling formation of a pole-tension embodiment of the invention.
Figure 66:
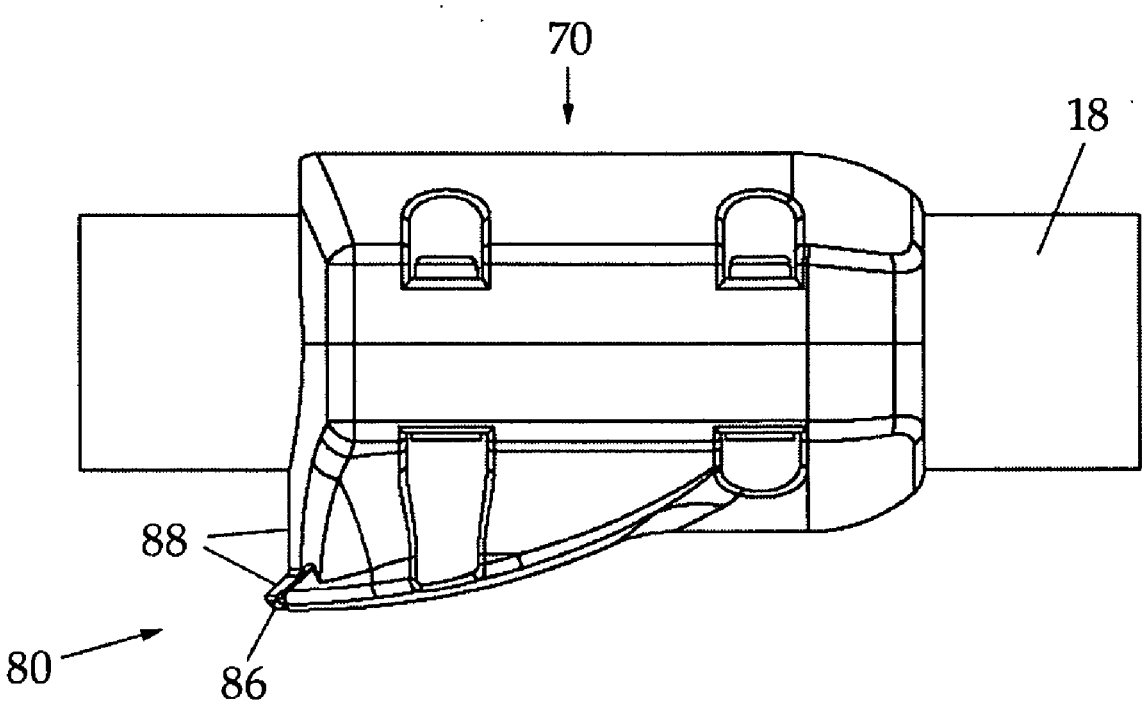
FIG. 66 is a side view of the rear facing front pole mounted base supporting a rear facing beveled tooth as part of the front pole coupling formation of a pole-tension embodiment of the invention.

An illustrated embodiment uses pole tension as a securement force by reversing the directions of the four coupling formations. This, in effect, creatively uses the entire pole half of the pole-ski unit the female half of a coupling and the entire ski half of the pole-ski unit as the male half of a coupling (reversing the roles of the units in previous embodiments). FIG. 64 shows a grip 14 serving as a rear pole mounted base 74 supporting a front facing tongue which serves as part of the rear pole coupling formation 78 and its positioning surfaces 86 and securing surfaces 88. The grip 14 can be made of a compressible rubberized polymer to allow compression of the rear pole mounted base 74. FIG. 65 shows a rear binding 52 acting as a rear ski mounted base 76 which is shown supporting a recess with a rear facing beveled lip serving as the rear ski coupling formation 84 and its positioning surfaces 86 and securing surfaces 88. Also shown are sub parts (heel piece release lever 60, a heel piece 54, and a heel piece platform 56) of the rear binding 52. FIG. 66 shows a front pole mounted base 70 supporting securing surfaces 88 and positioning surfaces 86 that form a rear facing beveled tooth. This front pole coupling formation 80 has smaller bevels than shown in previous embodiments. This is because this embodiment relies solely on the compressibility of the grip material and the natural flexion of the ski to create the movement necessary to engage the coupling and the pressure required to hold the coupling together. The smaller bevels accommodate this limited range of motion, which is substantially less than the longer range of motion created by the spring action of the rear binding 52, or by the flexion of longer plastic ski mounted bases as utilized by previous embodiments. This embodiment could employ the longer ski mounted flexible bases rather than bindings (which would allow for longer beveled surfaces).

Figure 67:
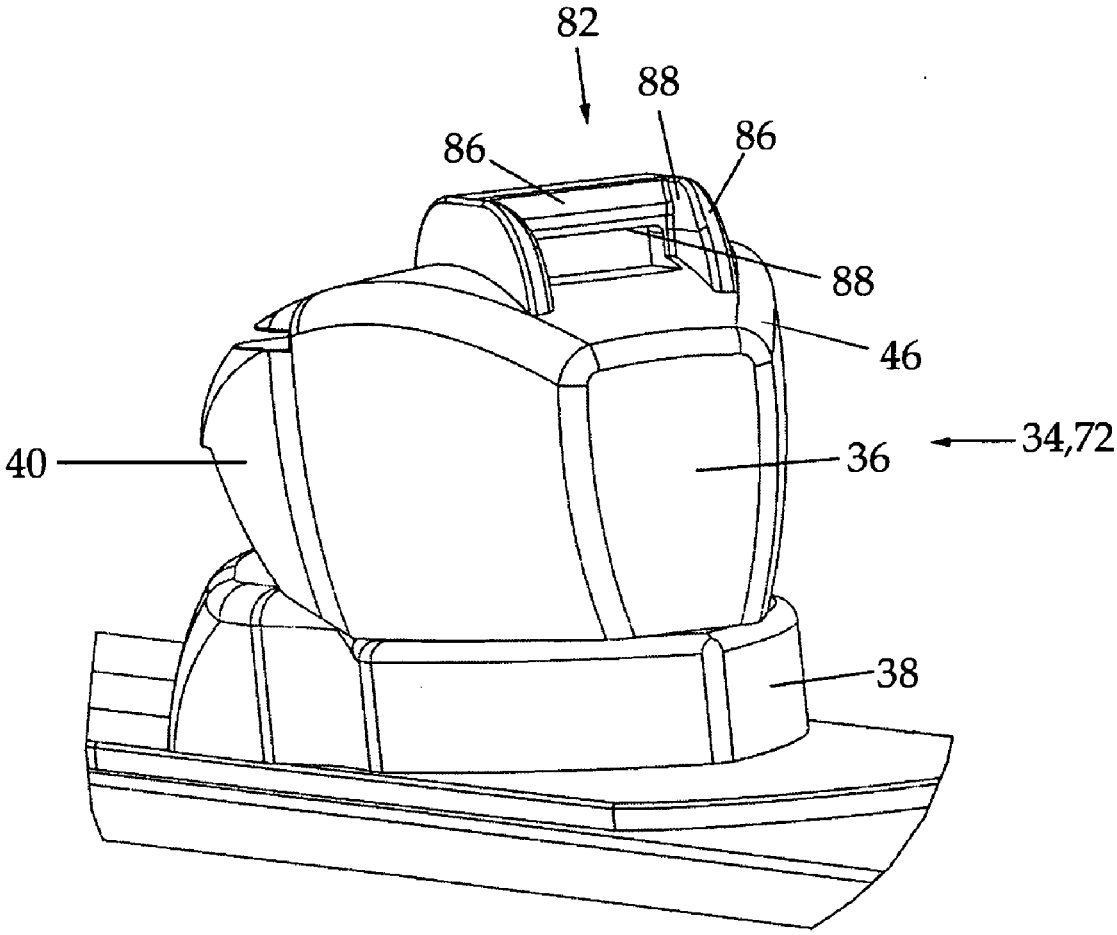
FIG. 67 is a perspective view of a front binding serving as a front ski mounted base for the front ski coupling formation which includes a striker and a lip.
Figure 68:
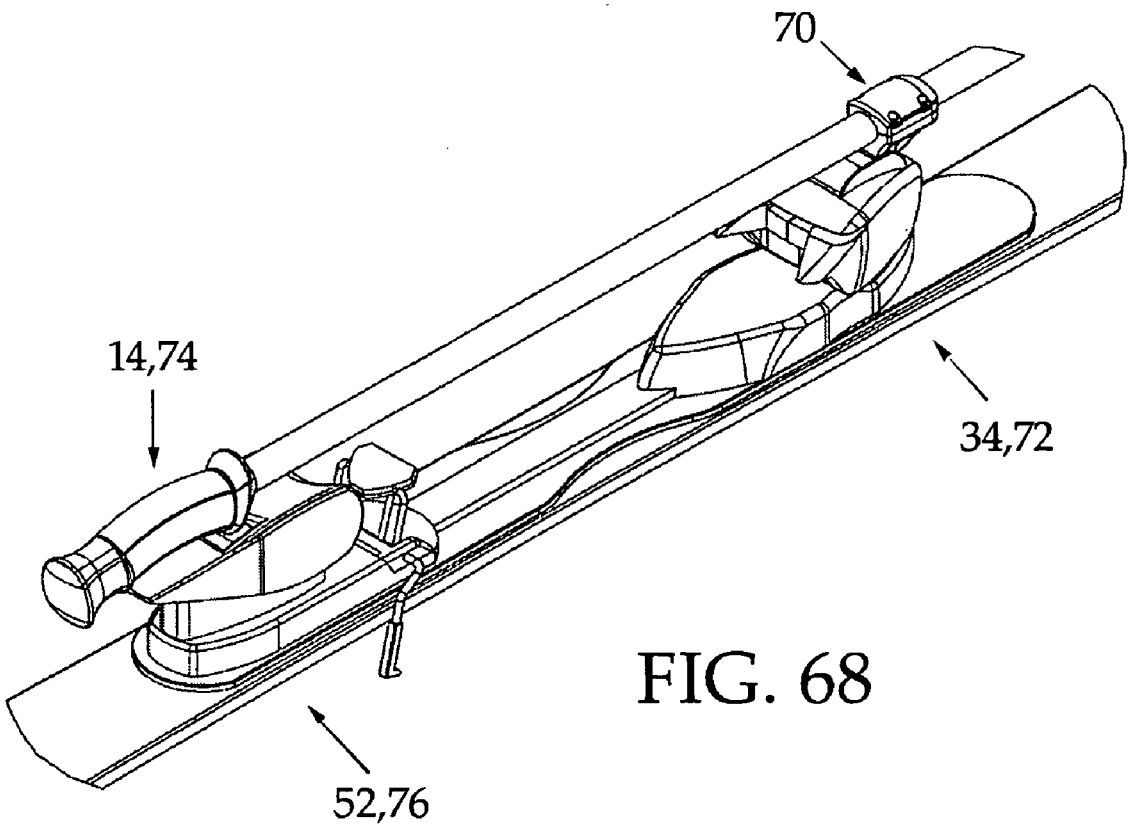
FIG. 68 is a perspective view of a completed coupling of a tongue and beveled tooth version of a pole-tension embodiment of the invention.

FIG. 67 shows a front binding 34 in the role of front ski mounted base 72 which is supporting a front ski coupling formation 82 which includes a front facing striker as a positioning surface 86 and a front facing slot as securing surfaces 88. Also shown are the subparts of the front binding 34 (toe piece platform 38, a toe piece 36, and a toe piece shroud 46, and toe securing abutment 40). When the front facing tongue is hooked over the rear facing beveled lip and the rear facing beveled tooth is pushed down against the front facing striker, the grip 14 which supports the tongue compressed and the rear facing beveled tooth snaps into the front facing slot, creating a firm coupling as shown in FIG. 68. Disengagement is accomplished by pulling in the reverse direction.

Figure 69:
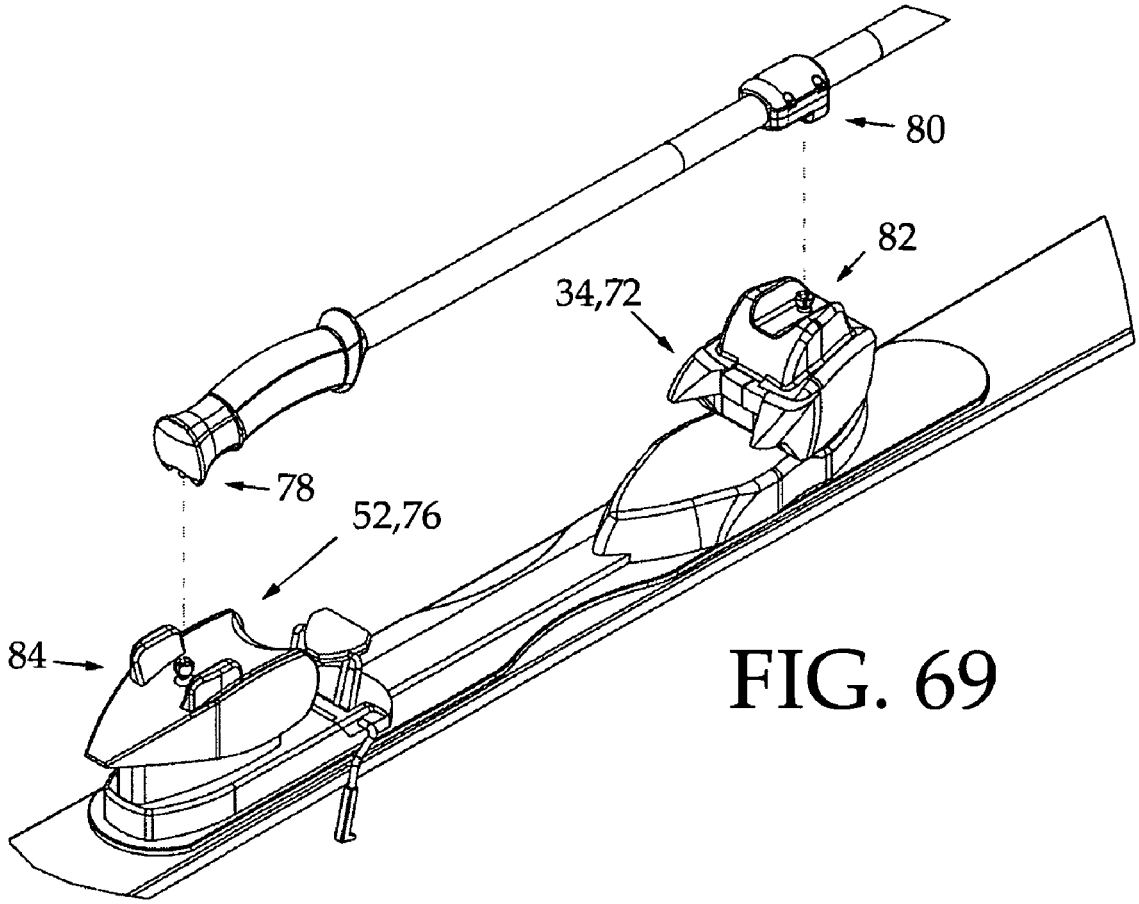
FIG. 69 is a perspective view of an unengaged ball and socket pole-neutral embodiment of the invention.
Figure 70:
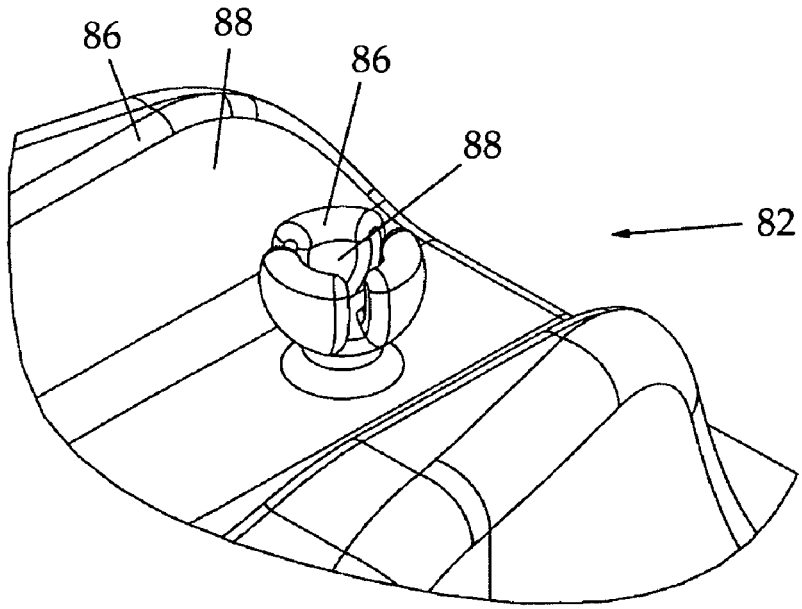
FIG. 70 is a close up perspective view of the top portion of a front binding serving a front ski mounted base for the socket half of a ball-and-socket version of the front ski coupling formation.
Figure 71:
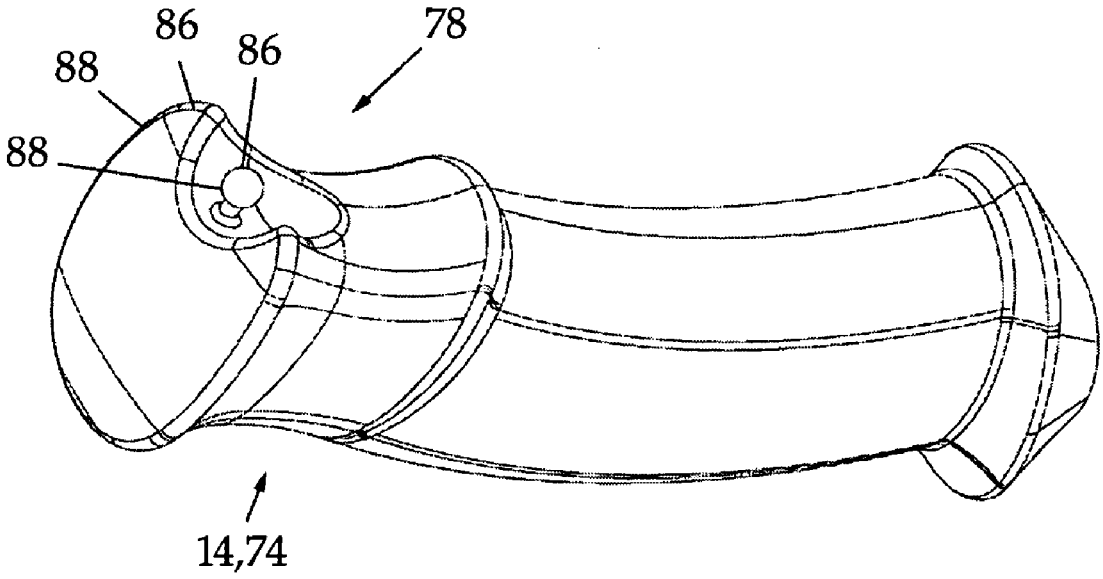
FIG. 71 is a perspective view of the bottom of a ski grip servings as the rear pole mounted base for the ball half of a ball-and-socket version of the rear pole coupling formation.
Figure 72:
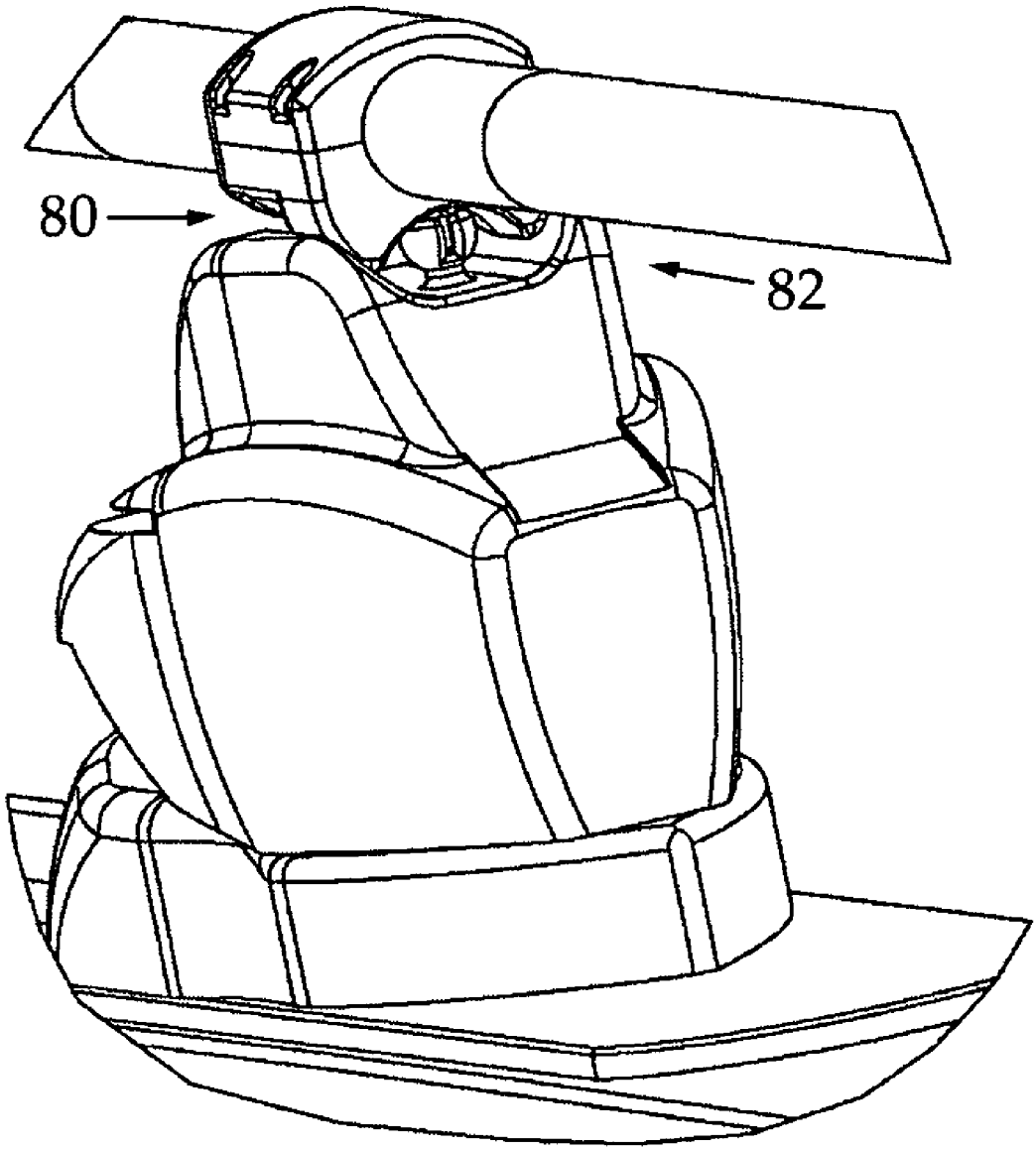
FIG. 72 is a perspective view of the front binding serving as a front ski mounted base for the socket half of a ball-and-socket version of the front ski coupling formation coupled with a front pole mounted base for the ball half of a ball-and-socket version of the front pole coupling formation.

The next group of embodiments could be said to be pole neutral in that they neither compress nor place tension on that section of the pole shaft 18 that is between the pole coupling formations. FIG. 69 illustrates an embodiment which uses a ball and socket approach. The coupling is achieved by pressing both the front pole coupling formation 80 and the rear pole coupling formation 78 onto the front ski coupling formation 82 and rear ski coupling formation 84 at the same time. The front binding 34 and the rear binding 52 again serve as the front ski mounted base 72 and the rear ski mounted base 76, respectively. The coupling force is achieved by the socket compressing around the ball. FIG. 70 shows the front ski coupling formation 82 which includes side flanges and a socket which serve as the securing surfaces 88 and positioning surfaces 86. The rear ski coupling formation 84 is substantially the same (as shown in FIG. 69). FIG. 71 illustrates the grip 14 which serves simultaneously as the rear pole mounted base 74. The edges of the grip 14, and a recess in the grip 14 to which a ball is attached, as well as the ball, combine to serve as the rear pole coupling formation 78 whose securing surfaces 88 and positioning surfaces 86 are, for the most part, identified in the illustration. FIG. 72 illustrates the joining of the front pole coupling formation 80 and the front ski coupling formation 82. The rear coupling is achieved in substantially the same manner. Disengagement of the couplings is achieved by pulling upward on the front and rear couplings at the same time. Of course, the ball and socket positions could be reversed from ski mounted to pole mounted and vice-versa.

Figure 73:
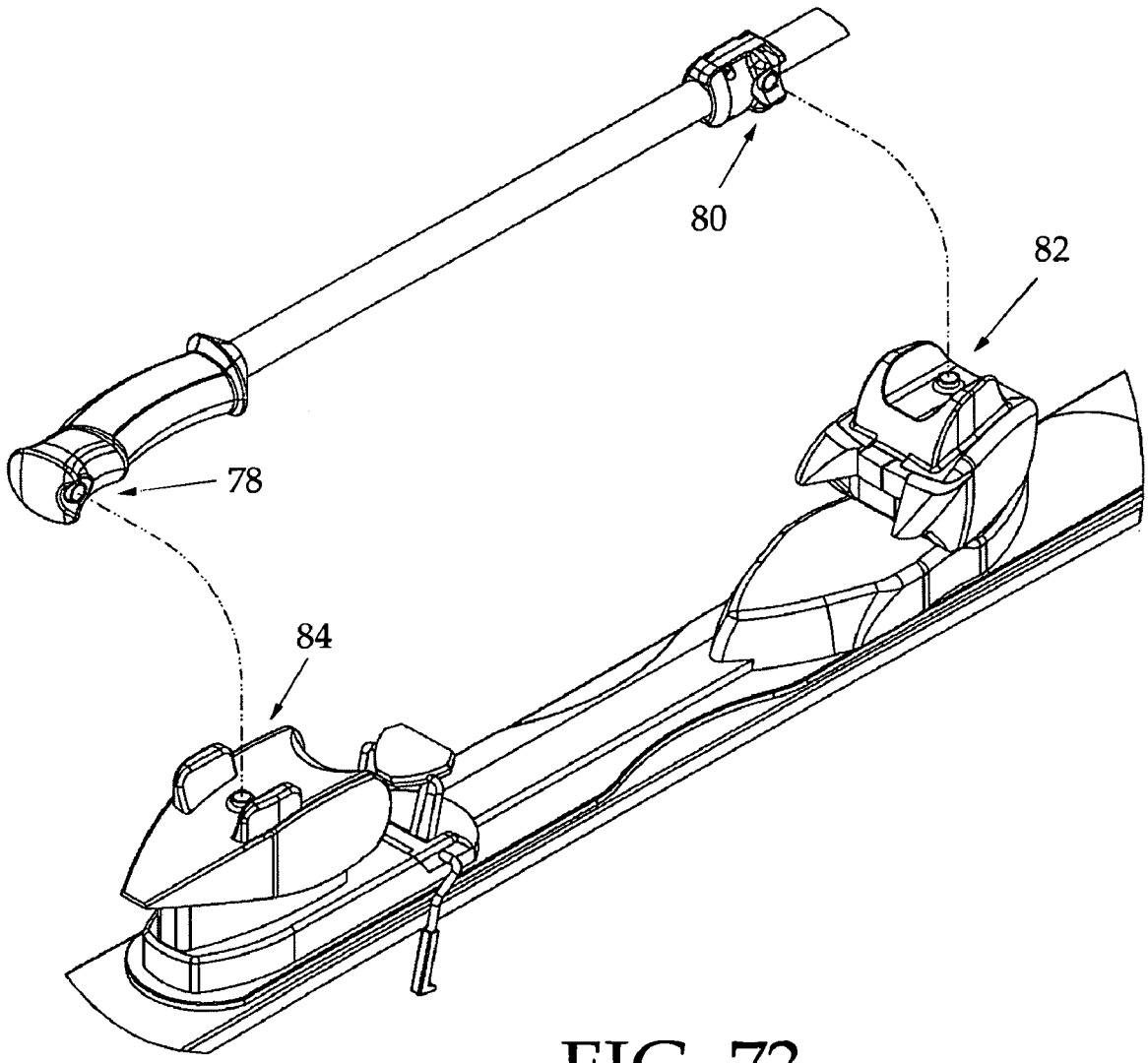
FIG. 73 is a perspective view of an unengaged magnet pole-neutral embodiment of the invention.

Another pole neutral embodiment is shown in FIG. 73. This embodiment is substantially the same as the previous embodiment with the exception that the ball and socket portions of the front pole coupling formation 80, the rear pole coupling formation 78, the front ski coupling formation 82, and the rear ski coupling formation 84, have each been replace by strongly attractive industrial magnets.

A variety of pole neutral embodiments can be envisioned. These would involve coupling formations (front pole coupling formation 80, rear pole coupling formation 78, front ski coupling formation 82, and rear ski coupling formation 84) whose securing surfaces 88 and positioning surfaces 86, in part embody a coupling means selected from the group consisting of, catches, clips, fasteners and snaps. Those skilled in the art will readily recognize that a variety of conventional coupling means can be employed without deviating from the spirit and scope of the invention.

Figure 74:
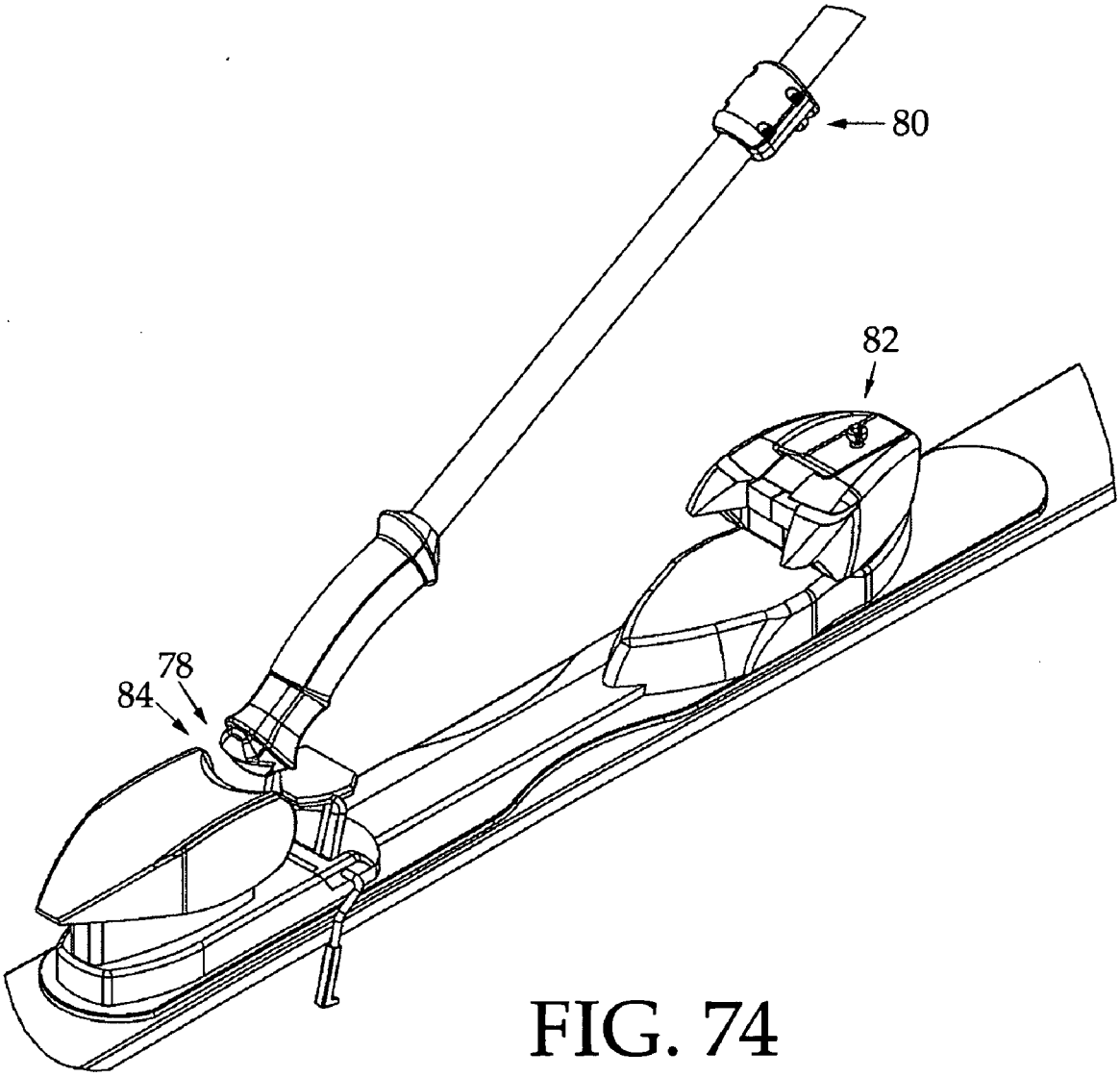
FIG. 74 is a perspective view of canted seat rear coupling means in combination with a ball and socket front coupling means.

Individual features or combinations of features from the different embodiments illustrated and described may be construed as independent inventive solutions or solutions proposed by the invention in their own right. An illustration of such a combination is FIG. 74 which shows a rear pole coupling formation 78 in the form of a canted seat and a rear ski coupling formation 84 in the form of a heel piece release lever 60. These rear coupling features are combined with the coupling features of the previous embodiment (a front pole coupling formation 80 which includes a ball and a front ski coupling formation 82 which includes a socket).

The securing surfaces 88 of the front and rear coupling formations could be placed so close together that they could occupy a very small space—so small that they could fit on one small portion of the ski or pole, although directional stability would be somewhat compromised. FIG. 75 shows an embodiment in which a elongated clamp serving as a single ski coupling formation 118 (and its positioning surfaces 86 and securing surfaces 88) is incorporated into the front binding 34 which serves simultaneously as a single ski mounted base 122. The elongated clamp which serves as the only ski coupling formation 118 can be made of a polymer such as nylon, or other sufficiently flexible but rigid material. On the pole is placed and oddly shaped dual collar, which with the shaft 18 of the pole 12, create both the only pole mounted base 124 and the only pole coupling formation 120, which is more closely organized with its positioning surfaces 86 and securing surfaces 88. Pressing the portion of the pole between the two ends of the dual collar into the elongated clamp creates the coupling. Release is performed by pulling the pole out of the elongated clamp.

While a number of illustrated embodiments of the integrated pole-to-ski quick coupling arrangement have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as aluminum, stainless steel, magnesium, titanium or other metal or nylon, glass infused nylon, various polymers, composites, carbon fibers, or other plastic of sufficient hardness, rigidity and tensile properties for the intended function, may be used instead of the materials described earlier. Also, any arrangement of positioning surfaces 86 and securing surfaces 88 regardless of how flat or how sharp, how acutely or obtusely angled, how rounded or flattened, may suffice to create the coupling. Also, any configuration of pole coupling formations, no matter how close together or far apart, no matter how affixed to, or incorporated into, the ski 24 and/or pole 12, now matter how oriented (facing front, rear, side, down or up) may suffice to create equivalent functions to those illustrated in the drawings.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An integrated pole-to-ski coupling arrangement comprising:

a first pole coupling formation, said first pole coupling formation being operable to attach to a single ski pole, and said first pole coupling formation being operable to releasably couple the ski pole to a first ski coupling formation attached to a single ski having a rear tail, wherein the rear tail of the ski is clear and unencumbered when the first pole coupling formation and first ski coupling formation couple together to releasably couple the ski pole to the ski, wherein the ski pole is substantially parallel to the ski, said ski pole can be used as a handle to lift and move the ski, and said coupling formations are arranged such that the pole is immobilized sufficiently to permit movement of the ski and the ski pole with six degrees of freedom after said coupling.

2. The coupling arrangement of claim 1, wherein said first pole coupling formation is on a grip of the ski pole.

3. The coupling arrangement of claim 1, wherein said first pole coupling formation is attached to a shaft of the ski pole.

4. The coupling arrangement of claim 1, wherein the first ski coupling formation is on a binding group.

5. The coupling arrangement of claim 4, wherein the first ski coupling formation is on a front binding.

6. The coupling arrangement of claim 4, wherein the first ski coupling formation is on a rear binding.

7. The coupling arrangement of claim 1, further comprising a second pole coupling formation operable to attach to the ski pole having a grip and a shaft, and operable to releasably couple to a second ski coupling formation attached to the ski.

8. The coupling arrangement of claim 7, wherein said first pole coupling formation is on the grip of the pole.

9. The coupling arrangement of claim 7, wherein the first pole coupling formation is attached to the shaft of the pole.

10. The coupling arrangement of claim 7, wherein the first ski coupling formation is on a front binding and the second ski coupling formation is on a rear binding.

11. The coupling arrangement of claim 10 wherein the first ski coupling formation includes surfaces on a toe piece shroud of the front binding and the second ski coupling formation includes surfaces on a heel piece release lever of the rear binding.

12. The coupling arrangement of claim 10 wherein the first ski coupling formation includes surfaces on a toe securing abutment of the front binding and the second ski coupling formation includes surfaces on a heel piece release lever of the rear binding.

13. An integrated pole-to-ski coupling arrangement comprising:

a single ski pole, said ski pole including a shaft and a grip; and a pole coupling formation attached to said ski pole;

said pole coupling formation being operable to releasably couple said ski pole to a ski coupling formation attached to a single ski, wherein a rear tail of the ski is clear and unencumbered when the pole coupling formation and ski coupling formation couple together to releasably couple the ski pole to the ski, wherein the ski pole is substantially parallel to the ski, said ski pole can be used as a handle to lift and move the ski, and said coupling formations are arranged such that the pole is immobilized sufficiently to permit movement of the ski and the ski pole with six degrees of freedom after said coupling.

14. The coupling arrangement of claim 13, wherein the pole coupling formation is on the grip of the ski pole.

15. The coupling arrangement of claim 13, wherein the pole coupling formation is attached to the shaft of the ski pole.

16. The coupling arrangement of claim 13, wherein the ski coupling formation is on a binding group.

17. The coupling arrangement of claim 13, wherein the ski coupling formation is on a front binding.

18. The coupling arrangement of claim 13, wherein the ski coupling formation is on a rear binding.

19. The coupling arrangement of claim 13, further comprising:

a plurality of pole coupling formations attached to the ski pole, said pole coupling formations being operable to releasably couple the ski pole to a plurality of ski coupling formations attached to the ski.

20. The coupling arrangement of claim 19, wherein at least one of the pole coupling formations is attached to the shaft of the pole.

21. The coupling arrangement of claim 20, wherein one of the pole coupling formations is on the grip of the pole.

22. The coupling arrangement of claim 19, wherein:

said pole coupling formations comprise securing and positioning surfaces on a base;

said ski coupling formations comprise securing and positioning surfaces on a base; and said pole coupling formations being operable to releasably couple the ski pole to the ski by coupling the securing surfaces of the pole coupling formations to the securing surfaces of the ski coupling formations.

23. The coupling arrangement of claim 19, wherein one of said ski coupling formations is attached to the ski in front of a front binding and one of the ski coupling formations is attached to the ski behind a rear binding.

24. The coupling arrangement of claim 23, wherein rebound from flexion of the ski coupling formations and the ski creates a coupling action between said pole coupling formations and said ski coupling formations.

25. The coupling arrangement of claim 19, wherein one of said ski coupling formations is attached to a front binding and one of the ski coupling formations is attached to a rear binding.

26. The coupling arrangement of claim 25, wherein a spring action exerted by the rear binding creates a coupling action between the pole coupling formations, the front binding, and the rear binding.

27. The coupling arrangement of claim 19, wherein said pole coupling formations are separated from one another by a distance that is substantially equal to a distance between the ski coupling formations.

28. The coupling arrangement of claim 27, wherein the distance between said ski coupling formations is determined by the length of a user's ski boot.

29. The coupling arrangement of claim 20, wherein the shaft of the pole is placed in compression by said pole coupling formations while said pole coupling formations are coupled to said ski coupling formations.

30. The coupling arrangement of claim 19, wherein the shaft of the pole is placed in tension by the pole coupling formations while said pole coupling formations are coupled to said ski coupling formations.

31. The coupling arrangement of claim 19, wherein the grip of the pole is placed in compression by said pole coupling formations while said pole coupling formations are coupled to said ski coupling formations.

32. The coupling arrangement of claim 19, wherein the shaft of the pole is neither compressed nor tensioned by the pole coupling formations while the pole coupling formations are coupled to said ski coupling formations.

33. The coupling arrangement of claim 19, wherein said pole coupling formations and said ski coupling formations comprise a coupling means selected from the group consisting of catches, clips, fasteners, snaps, hook and loop fasteners, ball and socket connectors, and magnets.

34. An integrated pole-to-ski coupling arrangement comprising:

a ski coupling formation attached to a single ski including a rear tail, said ski coupling formation being operable to releasably couple a shaft of a single ski pole to the ski, wherein the rear tail of the ski is clear and unencumbered when the ski coupling formation releasably couples the ski pole to the ski, wherein the ski pole is substantially parallel to the ski, said ski pole can be used as a handle to lift and move the ski, and said coupling formations are arranged such that the pole is immobilized sufficiently to permit movement of the ski and the ski pole with six degrees of freedom after said coupling.

35. The coupling arrangement of claim 34, further comprising:

a base, said base attached to the ski;

wherein said ski coupling formation includes securing and positioning surfaces on said base.

36. The coupling arrangement of claim 35, wherein said base is on a binding.

37. The coupling arrangement of claim 36, wherein said base is selected from the group comprising a front binding and a rear binding.

38. The coupling arrangement of claim 34, wherein at least one ski coupling formation is releasably coupled to one or more ski pole coupling formations by at least one of the group comprising catches, clips, hook and loop fasteners, fasteners, snaps, ball and socket connectors, and magnets.

39. The coupling arrangement of claim 34, further comprising:

a plurality of pole coupling formations attached to the shaft of the ski pole.

40. The coupling arrangement of claim 36, wherein the binding comprises a clamp that is operable to receive the shaft of the ski pole.

41. The coupling arrangement of claim 37, wherein the pole coupling formations are separated from one another by a distance that is substantially equal to the length of the distance between the front binding and the rear binding.

42. An integrated pole-to-ski coupling arrangement comprising:

a single ski pole, said ski pole including a shaft and a grip;

first and second pole coupling formations attached to said ski pole, wherein said second pole coupling formation is attached to the shaft of said pole; and front and rear ski coupling formations on a binding group having a front binding and a rear binding attached to a single ski including a rear tail, wherein said front ski coupling formation is on the front binding and the rear ski coupling formation is on the rear binding;

wherein said ski coupling formations and said pole coupling formations are operable to releasably couple said pole to the ski, wherein the rear tail of the ski is clear and unencumbered when the pole coupling and ski coupling formations releasably couple said pole to the ski, wherein the ski pole is substantially parallel to the ski, said ski pole can be used as a handle to lift and move the ski, and said coupling formations are arranged such that the pole is immobilized sufficiently to permit movement of the ski and the ski pole with six degrees of freedom after said coupling.

43. The coupling arrangement of claim 42, further comprising:

said front ski coupling formation including a positioning surface and a securing surface;

one of said pole coupling formations having a positioning surface and a securing surface adapted to couple to said front ski coupling formation;

wherein said pole coupling formation couples to said front binding by sliding said positioning surfaces over one another to secure said securing surfaces.

44. The coupling arrangement of claim 43, further comprising:

said positioning surface of said front ski coupling formation comprising a shroud bevel;

said securing surface of said front ski coupling formation being a shroud lip;

said positioning surface and said securing surface of said second pole coupling formation comprising a beveled tooth.

45. The coupling arrangement of claim 43, further comprising:

said positioning surface of said front ski coupling formation being a toe guiding bevel;

said securing surface of said front ski coupling formation being a toe securing lip; and said positioning surface and said securing surface of said pole coupling formation being a dual toothed curvature.

46. The coupling arrangement of claim 43, further comprising:

said positioning surface of said front ski coupling formation being a striker;

said securing surface of said front ski coupling formation being a slot; and said positioning surface and said securing surface of said pole coupling formation comprising a bolt.

47. The coupling arrangement of claim 43, further comprising:

said positioning surface of said front ski coupling formation being a rounded striker;

said securing surface of said front ski coupling formation being a rounded slot; and said positioning surface and said securing surface of said pole coupling formation comprising a rounded bolt.

48. The coupling arrangement of claim 42, further comprising:

said positioning surface of said rear ski coupling formation being at least one of a heel guiding bevel and a heel piece release lever;

said securing surface of said rear ski coupling formation being a heel securing lip; and said positioning surface and said securing surface of said first pole coupling formation being a canted seat lying above a contact avoidance recess.

* * * * *